US005740494A

United States Patent [19]

Shoji et al.

[11] Patent Number: 5,740,494

[45] Date of Patent: Apr. 14, 1998

[54] CONFIGURED TO ENHANCE TONER COLLECTING EFFICIENCY AND TONER REDEPOSITING EFFICIENCY

[75] Inventors: Hisashi Shoji; Osamu Endo, both of Kawasaki; Kei Yasutomi, Yokohama; Masako Yoshii, Kawasaki; Hidetoshi Yano, Yokohama; Yasushi Nakazato, Tokyo; Takayuki Kimura, Yokohama, all of Japan

[73] Assignee: Ricoh Company, Ltd., Tokyo, Japan

[21] Appl. No.: 699,922

[22] Filed: Aug. 20, 1996

[30] Foreign Application Priority Data

| | | | |
|---|---|---|---|
| Aug. 20, 1995 | [JP] | Japan | 7-233382 |
| Sep. 1, 1995 | [JP] | Japan | 7-248882 |
| Oct. 2, 1995 | [JP] | Japan | 7-278437 |
| Oct. 10, 1995 | [JP] | Japan | 7-287832 |
| Oct. 17, 1995 | [JP] | Japan | 7-293271 |
| Nov. 8, 1995 | [JP] | Japan | 7-314676 |
| Nov. 15, 1995 | [JP] | Japan | 7-321006 |

[51] Int. Cl.[6] ..... G03G 21/00

[52] U.S. Cl. ..... 399/71; 399/149; 399/343

[58] Field of Search ..... 399/148, 149, 399/349, 71, 343, 357, 358; 361/214, 221; 15/256.51, 256.52; 492/1.51, 18; 430/56, 125

[56] References Cited

U.S. PATENT DOCUMENTS

| | | | |
|---|---|---|---|
| 4,772,253 | 9/1988 | Koizumi et al. | 474/266 |
| 4,908,898 | 3/1990 | Kubo | 492/56 X |
| 5,124,757 | 6/1992 | Ikegawa | 399/148 |
| 5,195,430 | 3/1993 | Rise | 492/56 X |
| 5,235,384 | 8/1993 | Oka et al. | 399/27 |
| 5,260,754 | 11/1993 | Yano et al. | 399/123 |
| 5,283,618 | 2/1994 | Hosoya et al. | 430/125 X |
| 5,333,041 | 7/1994 | Ito et al. | 399/149 |
| 5,517,289 | 5/1996 | Ito et al. | 399/149 |
| 5,559,593 | 9/1996 | Yoshinaga et al. | 399/343 |
| 5,576,815 | 11/1996 | Teschendorf et al. | 15/256.51 |
| 5,606,408 | 2/1997 | Yano et al. | 399/343 |

FOREIGN PATENT DOCUMENTS

| | | |
|---|---|---|
| 48-71649 | 9/1973 | Japan . |
| 54-24640 | 2/1979 | Japan . |
| 63-35067 U | 3/1988 | Japan . |
| 63-246780 | 10/1988 | Japan . |
| 1-118874 | 5/1989 | Japan . |
| 5-61388 | 3/1993 | Japan . |
| 5-188831 | 7/1993 | Japan . |
| 6-51672 | 2/1994 | Japan . |
| 7-122774 | 12/1995 | Japan . |
| 08-160809 | 6/1996 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

An image forming apparatus includes a cleaning member for collecting toner left on an image carrier after image transfer, and then redepositing it on the carrier, so that a developing unit can collect the redeposited toner to reuse it. Even when the frictional charging ability of the cleaning member falls due to aging or varying environment, the charge of the toner left on the image carrier is regulated to preselected polarity before the toner reaches the cleaning member, thereby enhancing a toner collecting efficiency and a toner redepositing efficiency. The charge of the toner redeposited on the image carrier and moved away from the cleaning member is regulated to preselected polarity while being increased, thereby reducing a load to act on the developing unit. The toner is redeposited on the image carrier efficiently without regard to the polarity of the toner collected by the cleaning member. The developing unit is allowed to collect all the toner redeposited on the image carrier, thereby freeing the background of an image from contamination. When the cleaning member collects the toner from the image carrier, the toner is prevented from being transferred from the cleaning member to the image carrier, thereby obviating defective cleaning. An image forming speed is increased by reducing the interval between consecutive image forming areas. A pressure is caused to act uniformly between the cleaning member and the image carrier in the axial direction of the roller, further enhancing the toner collecting efficiency and toner redepositing efficiency while obviating background contamination.

40 Claims, 37 Drawing Sheets

CONFIGURED TO ENHANCE TONER COLLECTING EFFICIENCY AND TONER REDEPOSITING EFFICIENCY

BACKGROUND OF THE INVENTION

The present invention relates to an image forming apparatus of the type transferring a toner image from a photoconductive drum or similar image carrier to a paper or similar recording medium, collecting toner left on the image carrier after the image transfer with a cleaning unit, again depositing the collected toner on the surface of the image carrier, and causing the image carrier to convey the toner to a developing unit in order to reuse it for development.

In an image forming apparatus of the type described, e.g., copier, printer, facsimile apparatus or their combination, it is a common practice to clean the surface of an image carrier after image transfer. A cleaning unit has customarily been constructed to convey toner collected from the image carrier to, e.g., a waste toner tank. The toner collected in the waste toner tank is discarded at an adequate time. However, because discarding the collected toner is critical from the environment standpoint, the amount of toner to be discarded should be reduced as far as possible.

In light of the above, a cleanerless system has been proposed which increases the transfer ratio of a toner image from the image carrier to the paper to 100% and thereby allows no toner to remain on the image carrier after image transfer. This type of system makes it needless to discard the toner, eliminates the need for a cleaning unit, and simplifies the construction of the apparatus while reducing the cost of the apparatus. However, the state-of-the-art cleanerless system cannot readily implement a 100% transfer ratio and is questionable in the reliability aspect.

To return the toner collected by the cleaning unit to a developing unit for recycling it, an exclusive passageway for conveying the toner may be arranged between the cleaning unit and the developing unit, as also proposed in the past. This kind of scheme, however, brings about a problem that the passageway, e.g., a piping increases the overall size of the apparatus.

In another conventional system advantageous over the above systems, the toner left on the image carrier after image transfer is collected by a cleaning member included in the cleaning unit, and returned to, or redeposited on, the image carrier to be collected by the developing unit. Specifically, a bias voltage opposite in polarity to the charge deposited on the toner for development is applied to the cleaning member, e.g., a cleaning roller. In this condition, the toner is electrostatically transferred from the image carrier to the cleaning member and collected thereby. After the toner collection, the polarity of the bias voltage is switched to the same polarity as the toner. As a result, the toner is electrostatically returned from the cleaning member to the image carrier. With this scheme, it is possible to reuse the collected toner without increasing the size of the apparatus.

Systems of the kind described and specific arrangements for practicing them are disclosed in, e.g., Japanese Patent Laid-Open Publication Nos. 5-188831, 63-202784, 48-71649, 6-51672, 63-246780, 1-118874, 54-24640, and 5-61388 as well as in Japanese Utility Model Laid-Open Publication No. 63-35067.

However, the conventional system having the function of collecting the toner from the image carrier and the function of redepositing it on the image carrier has the following problems (1)–(7).

(1) To enhance the toner collecting function or efficiency and the toner redepositing function or efficiency, it is necessary that the charge of the toner to be collected by the cleaning roller be regulated to preselected polarity beforehand. Usually, however, to transfer the toner image from the image carrier to the paper by an image transfer unit, a voltage opposite in polarity to the charge deposited on the toner image is applied to the image transfer unit. As a result, the toner left on the image carrier after image transfer is partly charged to polarity opposite to its original polarity deposited for development. It follows that toner particles of the original polarity and toner particles of opposite polarity exit on the image carrier together.

If the particles of opposite polarity are charged to the original polarity by the cleaning member by friction, then the entire toner to be collected will be regulated to its original polarity. However, the charging ability of the cleaning member falls due to aging or changes in environmental conditions. This makes it difficult to fully regulate the charge of the toner to the original polarity assigned to development. Moreover, it is difficult for the cleaning member to collect all the particles. Particularly, when the particles of opposite polarity move away from the cleaning member without being collected thereby, the following problems are given rise to.

To charge the surface of the image carrier uniformly, a main charger implemented by a corona discharger is often used. Particularly, in an image forming apparatus using reversal or negative-to-positive development, a voltage of the same polarity as the charge deposited on the toner for development is applied to the main charger. Assume that the main charger has not fully charged the image carrier when the part of the image carrier cleaned by the cleaning member arrives thereat. At this time, because the charger is active, the above voltage is continuously applied to a charge wire included in the charger. In this condition, if the particles of opposite polarity and moved away from the cleaning member are brought to the position where the charger is located, they fly about and deposit on the charge wire despite that the charger is spaced from the image carrier. Such toner particles contaminate the charge wire and render charging irregular, thereby lowering the quality of toner images to be formed later. This is also true when the main charger is implemented by a conductive roller rotatable in contact with the image carrier.

(2) When the toner is charged by friction between the cleaning member and the image carrier, it is necessary not only to regulate the polarity of the charge but also to increase the charge to a preselected level. In practice, however, the toner unavoidably contains some particles of short charge despite the frictional charging effected by the cleaning member. Particularly, it is likely that the particles of polarity opposite to the original polarity remain short of charge even when restored to the original polarity. In addition, the particles of opposite polarity are apt to deposit on the cleaning member.

Assume that the particles of short charge and the particles of opposite polarity are collected by the cleaning member, redeposited on the image carrier, and then collected by the developing unit. Then, the developing unit must charge the toner to the preselected polarity, and in addition to the preselected amount. However, the charge of the toner collected in the developing unit cannot be increased to the preselected amount in a short time without increasing the load on the developing unit. For example, paddies for charging the toner by friction must be rotated at a high speed, resulting in the need for greater drive power. Further, the high-speed rotation of the paddles causes heavy stresses to act on the toner and accelerates its deterioration.

(3) When toner particles of original or expected polarity are collected by the cleaning member due to the application of the previously stated bias voltage, even the particles of opposite polarity deposit on the cleaning member due to the mechanical scraping force of the cleaning member. If such particles are returned from the cleaning member to the image carrier during toner collection, they are apt to contaminate the background of an image and the main charger, resulting in poor images.

Assume that the cleaning member is implemented as a roller and rotated, at the time of toner collection from the image carrier, in the direction opposite to the image carrier, as seen at a nip between them. Also, assume that the cleaning member is capable of collecting all the toner from the image carrier by less than one rotation thereof. Then, the toner collected by the cleaning member is prevented from again contacting the image carrier. In addition, the toner of opposite polarity is prevented from being electrostatically returned from the cleaning member to the cleaned surface of the image carrier during collection.

However, to return the toner from the cleaning member to the image carrier, a bias voltage opposite in polarity to the particles of opposite polarity is applied to the cleaning member. As a result, the particles of opposite polarity are left on the cleaning member. In the event of the next toner collection, the particles of opposite polarity are again deposited on the image carrier due to the voltage identical in polarity with the particles of opposite polarity, contaminating the main charger. Particularly, when the main charger is implemented as a charge roller rotatable in contact with the image carrier, the particles of opposite polarity are apt to contaminate it. The particles contaminated the main charger are apt to bring about irregular charging and lower the quality of images to be formed later. In addition, the toner of opposite polarity and deposited on the image carrier is likely to contaminate the background alone.

(4) The developing unit includes, e.g., an elongate developing roller playing the role of a developer carrier. The developing roller is rotatable in a preselected direction. The developing roller, cleaning member, image carrier or similar rotary member oscillates, if a little, in the axial direction. The oscillation or play in the axial direction amounts even to about 1 mm by way of example. The developer carrier conveys the developer to a nip between it and the image carrier in order to develop a latent image formed on the image carrier. The region where the developer carrier actually develops the latent image has an effective developing width. The above axial play sometimes causes the toner collected by the cleaning member to be again deposited on the image carrier over a range axially broader than the effective developing width. Therefore, if the effective developing width is smaller than the axial length of the cleaning member, the developing unit cannot collect the toner redeposited from the cleaning member on the image carrier. The toner not collected by the developing unit remains on the image carrier and contaminates the background of an image.

On the other hand, to enhance the toner collection efficiency of the cleaning member, i.e., to enhance the cleaning effect, it is preferable that the length of the cleaning member be greater than the effective developing width. Specifically, although the toner flies about and deposits on the axially outer portions of the image carrier, such a long cleaning member can collect the toner even from the outer portions. As a result, the image carrier can be effectively cleaned over its broad axial range. However, the cleaning member having a length greater than the effective developing width has the following problem. The toner deposited on the axially outer portions of the image carrier is collected by the cleaning member while spreading toward the axially opposite ends of the member (outside of the effective developing width). Such toner cannot be collected from the image carrier by the developing unit, again resulting in background contamination.

(5) The cleaning member may be implemented as a cleaning roller rotatable in pressing contact with the image carrier. The cleaning roller may be rotated such that it moves in the same direction as the image carrier, as seen at their nip, or such that it moves in the opposite direction to the image carrier, as seen at the nip. If the roller is moved in the same direction as the image carrier during toner collection, then the toner deposited on the roller is transferred toward the image carrier before it is redeposited on the image carrier, resulting in defective cleaning. Defective cleaning causes the main charger and the background of an image to be contaminated by the toner.

(6) The toner is redeposited from the cleaning member on the area of the image carrier where an image is absent, i.e., a non-image area. This prevents the toner from effecting the next latent image. Specifically, after the toner image has been transferred from the image area of the image carrier to the paper, the image area arrives at the cleaning member. At this instant, the toner remaining on the image carrier is transferred to the cleaning member. After the trailing edge of the image carrier has moved away from the cleaning member, the toner is redeposited on the non-image area of the image carrier following the image area. The next latent image is formed on the area of the image carrier following the area where the toner has been redeposited.

However, because the area of the image carrier between the two consecutive image areas is used as the non-image area for depositing the toner returned from the cleaning member, the non-image area should be provided with a substantial length. This prevents a high-speed image forming apparatus from being implemented.

(7) The cleaning roller, for example, has a rigid shaft and an elastic body mounted on the shaft. The shaft is rotatably supported by opposite ends thereof. While the roller is in rotation, its circumferential surface is held in pressing contact with the image carrier in order to collect the toner and then redeposit it. To insure efficient toner collection from the image carrier and efficient toner redeposition on the same, it is necessary that the roller be pressed against the image carrier by the same pressure throughout its axial dimension. If the pressure is locally reduced in the axial direction of the roller, then the collection efficiency and redeposition efficiency are locally lowered.

However, in the above configuration, the pressure acting between the cleaning roller and the image carrier is lower at the axially intermediate portion of the roller than at the axially opposite end portions. In this condition, the body of the roller cannot be uniformly pressed against the image carrier in the axial direction. This lowers the toner collection efficiency and toner redeposition efficiency at the intermediate portion of the roller.

The fall of the toner collection efficiency causes a small amount of toner to be conveyed by the image carrier away away from the cleaning roller and contaminate the background of the next toner image. The fall of the toner redeposition efficiency causes a great amount of toner to remain on the cleaning roller. As a result, the toner collection efficiency falls when the roller again collects the toner later, preventing the image carrier from being fully cleaned. This also contaminates the background of the next toner image.

To promote efficient toner collection, an arrangement may be made such that the toner left on the image carrier is charged to preselected polarity by friction acting between it and the cleaning roller and electrostatically transferred to the roller thereby. However, assume that the pressure acting between the roller and the image carrier locally decreases in the axial direction of the roller. Then, the charging ability locally decreases. This also lowers the toner collection efficiency and toner redeposition efficiency and thereby contaminates the background of a toner image.

SUMMARY OF THE INVENTION

It is therefore an object of the present invention to solve the above problem (1), i.e., to provide an image forming apparatus capable of regulating, even when the frictional charging ability of a cleaning member falls due to aging or varying environment, the charge of toner left on an image carrier after image transfer to preselected polarity before the toner reaches the cleaning member, thereby enhancing a toner collecting function or efficiency and a toner redepositing function or efficiency.

It is another object of the present invention to solve the problem (2), i.e., to provide an image forming apparatus capable of regulating the charge of toner redeposited on an image carrier and moved away from a cleaning member to preselected polarity while increasing it, thereby reducing a load to act on a developing unit.

It is another object of the present invention to solve the problem (3), i.e., to provide an image forming apparatus capable of redepositing toner on an image carrier efficiently without regard to the polarity of the toner collected by a cleaning member.

It is another object of the present invention to solve the problem (4), i.e., to provide an image forming apparatus allowing a developing unit to collect all the toner redeposited on an image carrier, thereby freeing the background of an image from contamination.

It is another object of the present invention to solve the problem (5), i.e., to provide an image forming apparatus capable of preventing, when collecting toner remaining on an image carrier with a cleaning member, the toner from being transferred form the cleaning member to the image carrier, thereby obviating defective cleaning.

It is another object of the present invention to solve the problem (6), i.e., to provide an image forming apparatus capable of increasing an image forming speed by reducing the interval between consecutive image forming areas.

It is another object of the present invention to solve the problem (7), i.e., to provide an image forming apparatus capble of causing a pressure to act uniformly between a cleaning roller and an image carrier in the axial direction of the roller, thereby enhancing a toner collecting function or efficiency and a toner redepositing function or efficiency and obviating background contamination.

In accordance with the present invention, an image forming apparatus has a rotatable image carrier, a latent image forming section for electrostatically forming a latent image on the surface of the image carrier, a developing unit for developing the latent image to thereby produce a corresponding toner image, and an image transfer unit for transferring the toner image to a recording medium. A cleaning unit collects toner left on the image carrier after the transfer of the toner image, and then redeposits it in the area of the surface of the image carrier which does not effect the formation of the next latent image. The toner redeposited on the image carrier is collected by the developing unit. A charge regulating device is positioned downstream of the image transfer unit, but upstream of the cleaning unit, in the direction of rotation of the image carrier, and charges the toner being conveyed by the image carrier toward the cleaning unit to the original polarity deposited on the toner at the time of development.

Also, in accordance with the present invention, an image forming apparatus has a rotatable image carrier, a charger for charging the surface of the image carrier uniformly, a latent image forming section for exposing the charged surface of the image carrier to thereby electrostatically forming a latent image, a developing unit for developing the latent image to produce a corresponding toner image, and an image transfer unit for transferring the toner image to a recording medium. A cleaning unit collects toner left on the image carrier after the transfer of the toner image, and then redeposits the toner in the area of the surface of the image carrier which does not effect the formation of the next latent image. The toner redeposited on the image carrier is collected by the developing unit. A charge regulating device is positioned downstream of the cleaning unit, but upstream of the charger, in the direction of rotation of the image carrier, and charges the toner moved away from the cleaning unit and charged to a polarity opposite to the original polarity deposited on the toner at the time of development to the original charge.

Also, in accordance with the present invention, an image forming apparatus has a rotatable image carrier, a charger for charging the surface of the image carrier uniformly, a latent image forming section for exposing the charged surface of the image carrier to thereby electrostatically forming a latent image, a developing unit for developing the latent image to produce a corresponding toner image, and an image transfer unit for transferring the toner image to a recording medium. A cleaning unit collects toner left on the image carrier after the transfer of the toner image, and then redeposits the toner in the area of the surface of the image carrier which does not effect the formation of the next latent image. The toner redeposited on the image carrier is collected by the developing unit. A charge regulating device is positioned downstream of the cleaning unit, but upstream of the charger, in the direction of rotation of the image carrier, and charges the toner redeposited on the area of the image carrier to a polarity identical with the original polarity deposited on the toner at the time of development.

Also, in accordance with the present invention, an image forming apparatus has a rotatable image carrier, a charger for charging the surface of the image carrier uniformly, a latent image forming sectopm for exposing the charged surface of the image carrier to thereby electrostatically form a latent image, a developing unit for developing the latent image to produce a corresponding toner image, and an image transfer unit for transferring the toner image to a recording medium. A cleaning member collects toner left on the image carrier after the transfer of the toner image, and then redeposits it in the area of the surface of the image carrier which does not effect the formation of the next latent image. The toner redeposited on the image carrier is collected by the developing unit. A controller causes, when the cleaning member collects the toner from the image carrier, a voltage of polarity opposite to the original polarity deposited on the toner at the time of development to be applied to the cleaning member to thereby electrostatically transfer the toner of the original polarity to the cleaning member, and causes the cleaning member to rotate in the opposite direction to the image carrier at a nip between them. The controller causes the cleaning member to collect the toner by less than one rotation.

Also, in accordance with the present invention, an image forming apparatus has a rotatable image carrier, a charger for charging the surface of the image carrier uniformly, a latent image forming section for exposing the charged surface of the image carrier to thereby electrostatically form a latent image, a developing unit having a developer carrier for conveying a developer deposited thereon, and for developing the latent image to produce a corresponding toner image. A cleaning member collects toner left on the image carrier after the transfer of the toner image, and then redeposits it in the area of the surface of the image carrier which does not effect the formation of the next latent image. The toner redeposited on the image carrier is collected by the developing unit. An effective developing width over which the developer carrier actually develops the latent image in the axial direction thereof is greater than the axial length of the cleaning member such that the cleaning member is confined in the effective developing width.

Further, in accordance with the present invention, an image forming apparatus has a rotatable image carrier, a charger for charging the surface of the image carrier uniformly, a latent image forming section for exposing the charged surface of the image carrier to thereby electrostatically form a latent image, a developing unit having a developer carrier for conveying a developer deposited thereon, and for developing the latent image to produce a corresponding toner image, and an image transfer unit for transferring the toner image to a recording medium. A cleaning member collects toner left on the image carrier after the transfer of the toner image, and then redeposits it in the area of the surface of the image carrier which does not effect the formation of the next latent image. The toner redeposited on the image carrier is collected by the developing unit. An effective developing width over which the developer carrier actually develops the latent image in the axial direction thereof is greater than the axial length of the cleaning member. A shifting device shifts, when the cleaning member redeposits the toner on the image carrier, the toner on the cleaning member such that it lies in a range smaller than the effective developing width inclusive.

Furthermore, in accordance with the present invention, an image forming apparatus has a rotatable image carrier, a latent image forming section for electrostatically forming a latent image on the surface of the image carrier, a developing unit for developing the latent image to thereby produce a corresponding toner image, and an image transfer unit for transferring the toner image to a recording medium. A cleaning unit has a rotatable cleaning member and collectes toner left on the image carrier after the transfer of the toner image and then redeposits it in the area of the surface of the image carrier which does not effect the formation of the next latent image. An electric field is formed between the cleaning member and the image carrier to cause the cleaning member to electrostatically collect the toner from the image carrier. Then, the electric field is switched in direction to cause the cleaning member to redeposit the toner in the area of the surface of the image carrier which does not effect formation of the next latent imag. The toner redeposited on the image carrier is electrostatically collected by the developing unit. A controller controls the rotation of the cleaning member such that it moves, when collecting the toner, in the opposite direction to the image carrier at a nip between them, and ends collecting the toner from an image forming area of the image carrier by less than one rotation such that the leading edge, in the direction of rotation of the cleaning member, of the toner collected by the cleaning member is brought to a position where the toner cannot be transferred to said the carrier, and causese the cleaning member to rotate at a higher speed when collecting the toner than when redepositing the toner.

Moreover, in accordance with the present invention, an image forming apparatus has a rotatable image carrier, a latent image forming section for electrostatically forming a latent image on the surface of the image carrier, a developing unit for developing the latent image to thereby produce a corresponding toner image, and an image transfer unit for transferring the toner image to a recording medium. A cleaning unit collects toner left on the image carrier after the transfer of the toner image, and then redepositing it in the area of the surface of the image carrier which does not effect the formation of the next latent image. A cleaning controller controls the cleaning unit such that when the intermediate between the leading and trailing edges of an image forming area defined on the image carrier moves away from the cleaning member, the function of the cleaning member is switched from toner collection to toner redeposition.

In addition, in accordance with the present invention, an image forming apparatus has a rotatable image carrier, a latent image forming section for electrostatically forming a latent image on the surface of the image carrier, a developing unit for developing the latent image to thereby produce a corresponding toner image, an image transfer unit for transferring the toner image to a recording medium, and a cleaning roller for collecting toner left on the image carrier after transfer of the toner image, and then redepositing it in the area of the surface of the image carrier which does not effect the formation of the next latent image. The cleaning roller has a rigid shaft rotatably supported at axially opposite ends thereof, and an elastic body mounted on the shaft. The cleaning roller collects the toner from the image carrier and redeposits it on the image carrier with the circumference of the roller pressingly contacting the surface of the image carrier.

BRIEF DESCRIPTION OF THE DRAWINGS

The above and other objects, features and advantages of the present invention will become apparent from the following detailed description taken with the accompanying drawings in which.

In the figures, like reference numerals designated like constituent parts.

DESCRIPTION OF THE PREFERRED EMBODIMENTS

Figure 1:
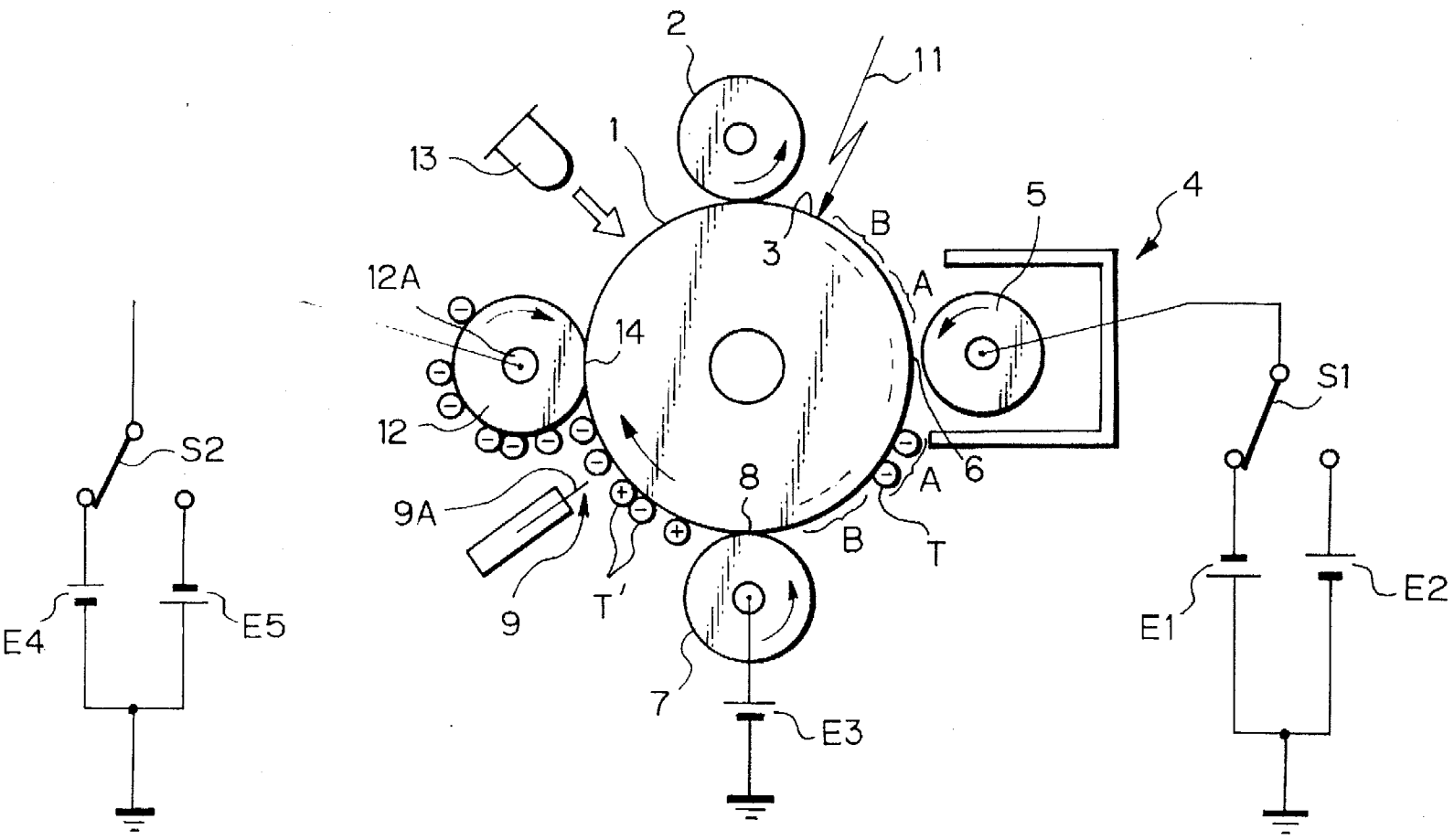
FIG. 1 is a view showing the general construction of a first embodiment of the image forming apparatus in accordance with the present invention.

Preferred embodiments of the image forming apparatus in accordance with the present invention will be described hereinafter.

1st Embodiment

An embodiment of the present invention addressing the problem (1) discussed earlier will be described with reference to FIG. 1. As shown, an image forming apparatus has an image carrier in the form of a photoconductive drum 1. The drum 1 is rotated clockwise, as viewed in FIG. 1, by drive means, not shown. A main charger implemented as a charge roller 2 by way of example charges the surface of the drum 1 in rotation uniformly. In the illustrative embodiment, the charge roller 2 charges the surface of the drum 1 to negative polarity, e.g., about −850 V. The charge roller 2 may, of course, be replaced with a corona discharger. At an exposing position 3, a modulated laser beam 11 scans the charged surface of the drum 1 and thereby electrostatically forms a latent image thereon. Specifically, the surface of the drum 1 has its potential varied to about −150 V in a portion A scanned by the laser beam 11, while maintaining the potential of about −850 V in the other portion B.

A developing unit 4 includes a developing roller 5 facing the drum 1 and which is a specific form of a developer carrier. A bias voltage source $E_1$ applies a bias voltage of about −600 V to the developing roller 5. In the embodiment, the developing unit 4 stores a two-ingredient type developer, i.e., toner and carrier mixture, not shown. The toner is charged to negative polarity due to friction acting between it and the carrier. Assume that the toner has been charged to negative polarity at the time of development.

The developing roller 5 conveys the developer toward a developing position 6 while rotating counterclockwise, as viewed in FIG. 1. At the developing position 6, the toner identical in polarity with the drum 1 and contained in the developer is electrostatically transferred from the roller 5 to the scanned portion A of the drum 1, thereby developing the latent image. In the illustrative embodiment, a reversal or negative-to-positive developing system is used by way of example.

An image transfer unit is implemented as a transfer roller 7 and positioned below the drum 1. The transfer roller 7 is rotated in the same direction as the drum 1 and held in contact with the drum 1 to define an image transfer position 8. A paper or similar recording medium, not shown, is fed to the image transfer position 8. The roller 7 transfers the toner image formed on the drum 1 by the developing unit 4 to the paper. Specifically, a power source E3 applies a voltage opposite in polarity to the charge of the toner, e.g., +950 V to the roller 7. As a result, the toner, labeled T and schematically shown in FIG. 1, is electrostatically transferred from the drum 1 to the paper. The paper with the toner image is separated from the drum 1 by a separating device, not shown, and then fed to a fixing unit, not shown. The fixing unit fixes the toner image on the paper.

After the above image transfer, a part of the toner T remains on the surface of the drum 1. This part of the toner, labeled T', is conveyed to a cleaning position 14 by the drum 1. At the position 14, a cleaning roller 12 which is a specific form of a cleaning member collects the toner T' from the drum 1.

The toner T moving away from the developing position 6 toward the image transfer position 8 is substantially entirely of negative polarity. On the other hand, the toner T' left on the drum 1 after the image transfer is partly of positive polarity due to the positive bias applied to the transfer roller 7. Specifically, about 80% of the toner T' is of positive polarity while the rest is of negative polarity. In any case, the toner T' consisting of particles of positive polarity and particles of negative polarity reaches the cleaning position 14.

Figure 2:
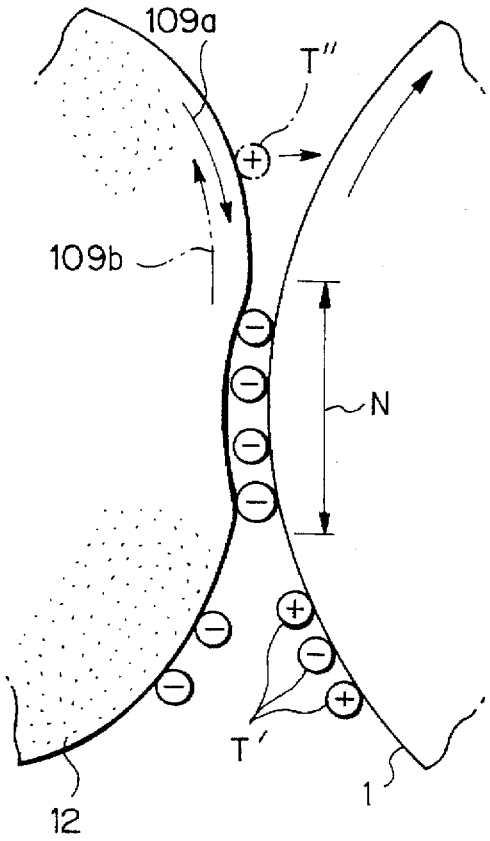
FIG. 2 is a fragmentary enlarged sketch of a nip between a photoconductive element and a cleaning roller included in the embodiment.

The cleaning roller 12 is formed of, e.g., a foam material having a medium specific volume resistivity. The roller 12 is rotated clockwise, as viewed in FIG. 1, in frictional contact with the surface of the drum 1. As shown in FIG. 2, at a nip N between the dram 1 and the roller 12, the roller 12 is elastically deformed by the drum 1 while pressingly contacting it. The nip N defines a cleaning region 14. At the nip N, both the positive and negative particles of the toner T' are charged to the same polarity as the toner T (negative polarity in the embodiment) by friction while contacting the roller 12.

A bias voltage source E4 applies a bias voltage opposite in polarity to the charge of the toner, e.g., +300 V to the cleaning roller 12. In this condition, the toner T' reached the cleaning position 14 is electrostatically transferred to the roller 12 and collected thereby. As a result, the surface of the drum 1 is cleaned.

A discharge lamp 13 discharges the surface of the drum 1 having been cleaned by the cleaning roller 12. The discharge lamp 13 is a specific form of a discharger. Thereafter, the previously stated image forming procedure is repeated. The portion of the drum 1 where the toner image is formed and the portion following it will be referred to as an image area and a non-image area, respectively. After the trailing edge of the image area has moved away from the main charger or charge roller 2, the roller 2 is released from the surface of the drum 1. After the trailing edge of the image area has moved away from the developing roller 5, a switch $S_1$ is operated to connect the roller 5 to another bias voltage source $E_2$. The voltage source $E_2$ applies a bias voltage opposite in polarity to the charge of the toner, e.g., +150 V to the roller 5 in order to prevent the toner from depositing on the drum 1. After the trailing edge of the image area has moved away from the image transfer position 8, the application of the voltage to the transfer roller 7 is interrupted.

Further, after the trailing edge of the image area of the drum 1 has moved away from the cleaning roller 12, a switch S2 is operated to connect the roller 12 to another bias voltage source $E_5$. The voltage source $E_5$ applies a bias voltage identical in polarity with the charge of the toner, e.g., −500 V to the roller 12. As a result, an electric field is formed between the roller 12 and the non-image area of the drum 1 in the direction tending to return the toner from the roller 12 to the drum 1. By this electric field, the toner collected on the roller 12 is redeposited on the non-image area of the drum 1. The toner so redeposited on the drum 1 is conveyed by the drum 1 to the developing unit 4 via the discharge lamp 13 and charge roller 2 now spaced from the drum 1. The developing roller 5 applied with the positive bias electrostatically collects the toner of negative polarity from the drum 1 and introduces in into the developer existing in the developing unit 4.

When the image forming operation is continuously performed, the above procedure is repeated a preselected number of times.

As stated above, the toner remaining on the drum 1 after image transfer is collected by the cleaning roller 12, then redeposited from the roller 12 on the drum 1, and then collected by the developing unit 4 to be reused. This makes it needless to discard the collected toner. In addition, a piping or similar exclusive passageway for returning the toner collected by the roller 12 to the developing unit 4 is not necessary.

The toner is returned from the cleaning roller 12 to the non-image area of the drum 1 following the trailing edge of the image area. Therefore, the toner redeposited on the drum 1 does not effect either the latent image formed first or a latent image to be formed next. If desired, the toner may be redeposited on a trailing portion of the inside of the image area.

The cleaning roller 12 functions to charge the toner remaining on the drum 1 on the basis of friction acting between it and the drum 1, as stated above. Specifically, when the toner conveyed to the roller 12 by the drum 1 contains particles charged to the polarity opposite to the original polarity for development, the roller 12 restores the toner to its original polarity. For this purpose, the roller 12 is formed of a material capable of charging the toner to its original polarity (negative polarity in the embodiment).

However, when the cleaning roller 12 is deteriorated due to aging or varying environment, the charging ability of the roller 12 falls. The fall of the charging ability directly translates into the fall of the toner collecting function or efficiency from the drum 1 and the fall of the toner redepositing function or efficiency on the drum 1. Consequently, the background of the drum 1 is contaminated by the toner. Moreover, the toner sequentially accumulating on the roller 12 accelerates the fall of such functions or efficiencies.

In light of the above, as shown in FIG. 1, a needle electrode type charger or charge regulating means 9 is located downstream of the image transfer position 8, but upstream of the cleaning roller 12, in the direction of rotation of the drum 1. The charger 9 deposits a charge identical in polarity as the original charge on the toner T' moving toward the roller 12. In this sense, the charger 9 plays the role of a precleaning charger (PCC).

Figure 3:
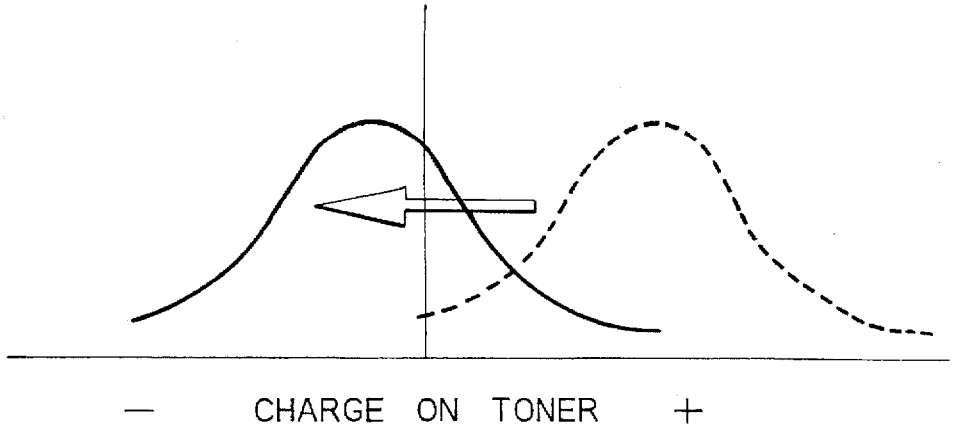
FIG. 3 shows specific toner charge distributions demonstrating how the polarity of toner before cleaning is regulated to its original polarity deposited at the time of development.

Specifically, the charger 9 is implemented as an about 0.1 mm thick sheet of, e.g., stainless steel. The edge portion of the sheet facing the drum 1 is formed with a number of needle-like electrodes 9A arranged in the axial direction of the drum 1. The electrodes 9A are spaced from the surface of the drum 1. A voltage source, not shown, applies a DC voltage to the charger 9 in order to cause a discharge current of, e.g., about −100 μA to flow between the electrodes 9A and the drum 1. As a result, the entire toner moving toward the cleaning position 14 is restored to its original polarity deposited at the time of development. As shown in FIG. 3, the PCC 9 shifts the charge distribution of the toner T' from the positive side (phantom curve) to the negative side (solid curve).

The charger 9 obviates the previously stated problems ascribable to the aging of the cleaning roller 12 and the varying environment. At the same time, the charger 9 obviates the problem ascribable to the accumulation of the toner on the roller 12.

Figure 4:
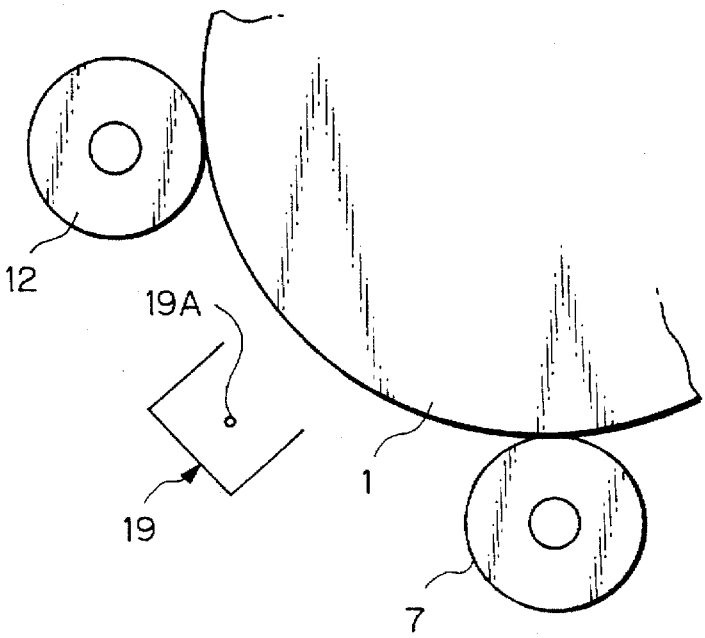
FIGS. 4–7 are views each showing a specific form of charge regulating means included in the embodiment.

FIG. 4 shows a corona discharger 19 which may be used in place of the charger 9 as the charge regulating means. As shown, the corona discharger 19 is spaced from the drum 1 and has a charge wire 19A. A voltage of preselected polarity is applied to the charge wire 19A in order to cause negative corona discharge to occur. This also successfully restores the entire toner moving toward the cleaning roller 12 to its original polarity, i.e., negative polarity. The needle electrode type charger 9 and corona discharger 19 are specific forms of charge regulating means which does not contact the drum 1. This kind of charging regulating means is free from contamination ascribable to the toner and therefore faults ascribable to the contamination.

If desired, the DC voltage to be applied to the charger 9 or the corona discharger may be biased by an AC voltage in order to regulate the amount of charge and the potential of the toner T' itself. In any case, the voltage to be applied to the charger 9 or the corona discharger 19 should only be high enough to simply help the cleaning roller 12 charge the toner by friction, and therefore does not need a high-tension power source. This is desirable from the cost standpoint and in respect of the generation of ozone.

Figure 5:
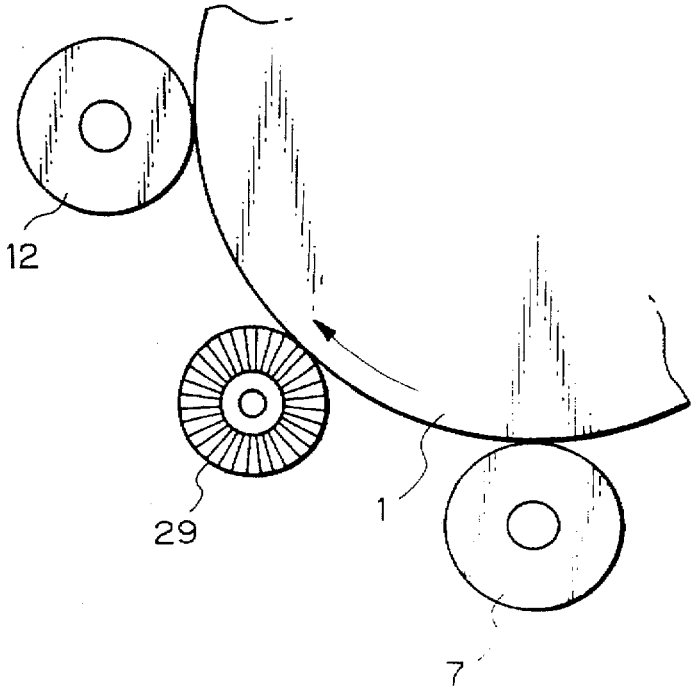

FIG. 5 shows another charge regulating means implemented as a roller-like brush 29. The brush 29 rotates while rubbing itself against the surface of the drum 1. The brush 29 also restores the toner moving toward the cleaning roller 12 to its original polarity due to friction acting between it and the drum 1.

Figure 6:
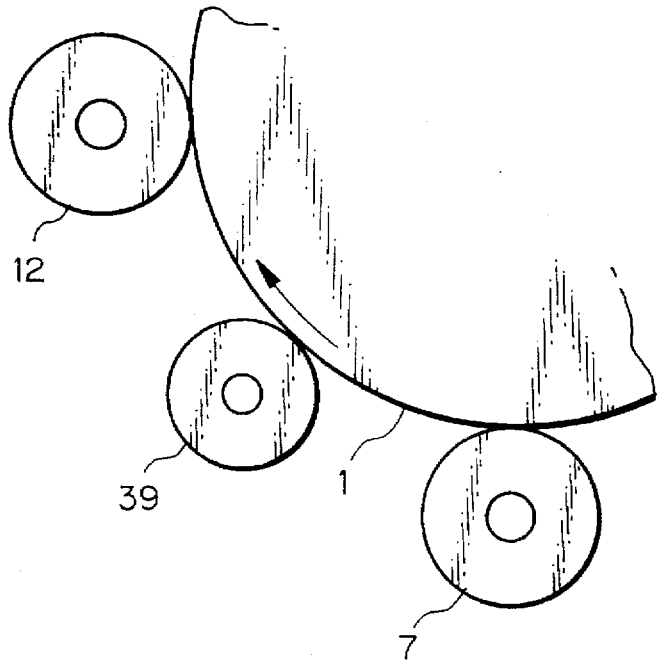

FIG. 6 shows still another charge regulating means implemented as a roller 39. The roller 39, like the brush 29, rotates in contact with the drum 1 in order to restore the toner moving toward the cleaning roller 12 to its original polarity.

Figure 7:
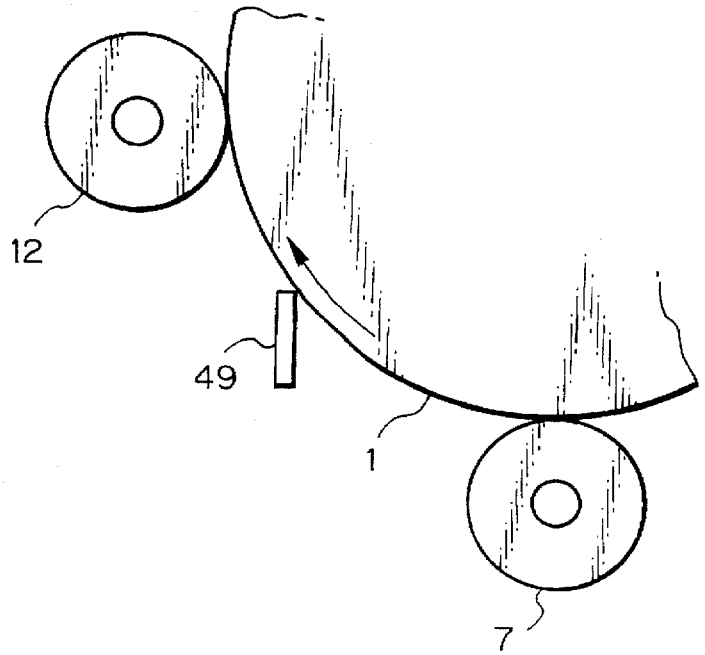

FIG. 7 shows a further charge regulating means implemented as a flat blade 49. The blade 49 also restores the toner moving toward the cleaning roller 12 to its original polarity in contact with the surface of the drum 1.

A bias voltage of negative polarity may also be applied to any one of the charge regulating means shown in FIGS. 5–7. Again, this does not need a high-tension power source and causes a minimum of ozone to be produced. Of course, a bias voltage is not applied to the charge regulating, an exclusive power source is not necessary.

Figure 8:
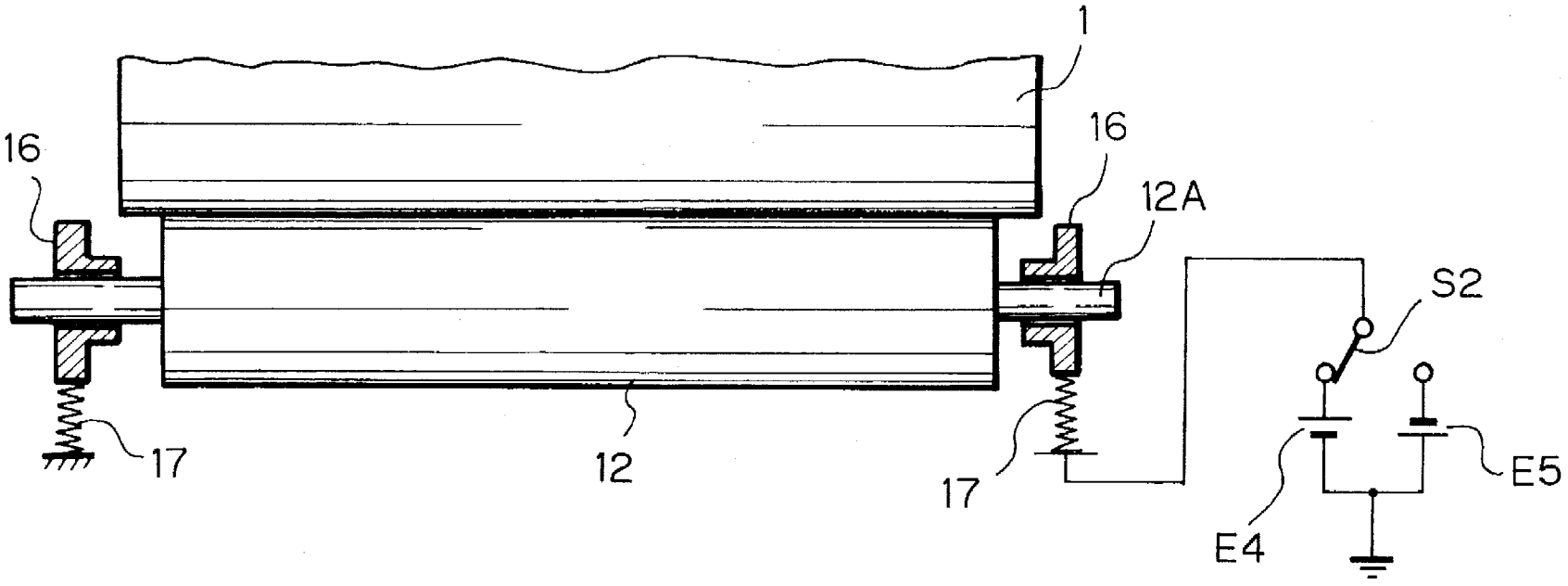
FIG. 8 is a view showing a specific arrangement for applying a bias voltage to the cleaning roller.

To selectively connect the voltage source $E_4$ or $E_5$ to the cleaning roller 12, the roller 12 may be supported by a specific arrangement shown in FIG. 8. As shown, the roller 12 has a conductive shaft 12A whose opposite ends are each rotatably supported by a respective conductive bearing 16. The bearings 16 are movable in the radial direction of the drum 1. Compression springs 17 are respectively loaded between the bearings 16 and spring seats formed on the body of the apparatus, constantly urging the roller 12 against the drum 1. Because the springs 17 are also conductive, the voltage sources E4 and E5 are selectively connected to the drum 12 via one of the springs 17, one of the bearings 16, and shaft 12A.

Figure 9:
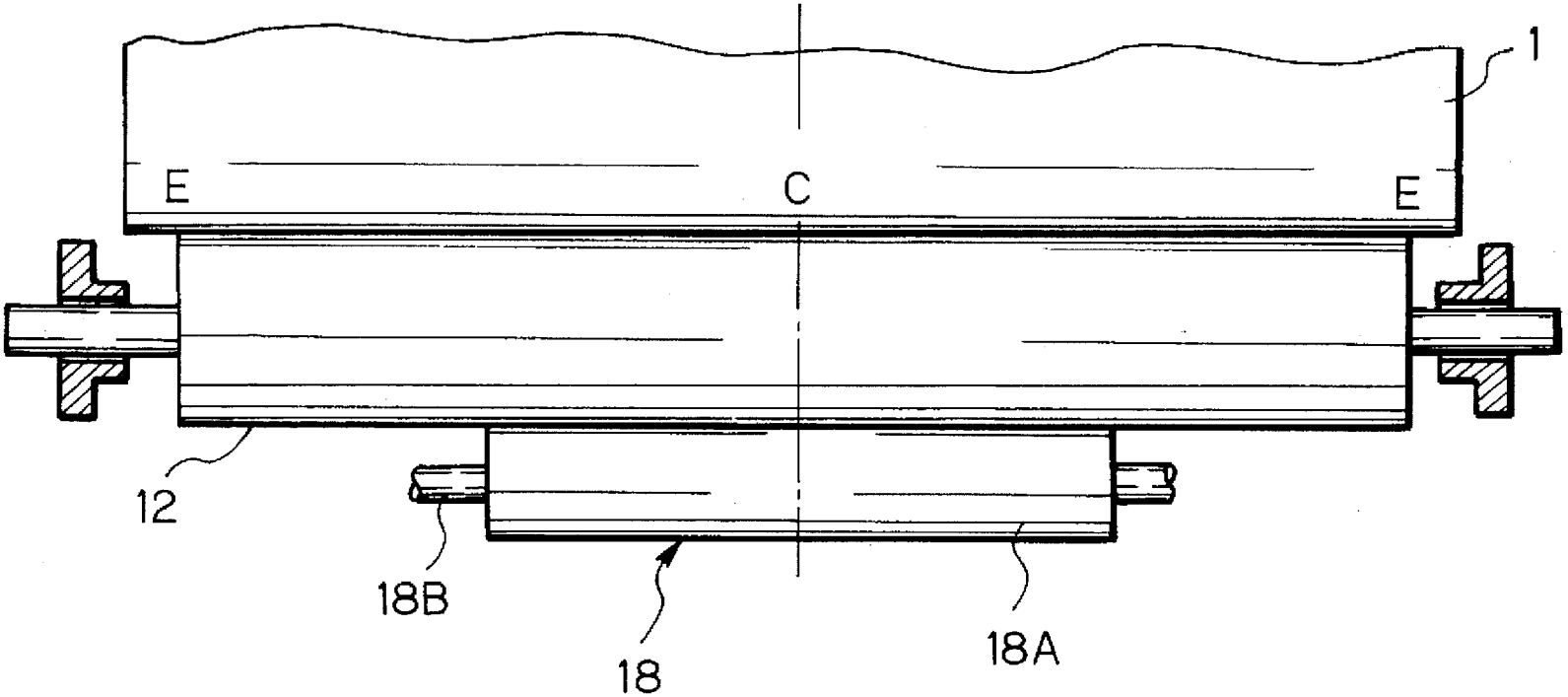
FIG. 9 shows a specific arrangement for uniformizing pressure to act between the cleaning roller and the photoconductive element.

As shown in FIG. 9, when the cleaning roller 12 is pressed against the drum 1 by the springs 17, the pressure acting on the drum 1 is minimum at the center of the roller 12 in the axial direction and sequentially increases toward the opposite ends E. Such an uneven pressure distribution prevents the roller 12 from charging the toner uniformly by friction and lowers the charging ability particularly at and around the center C. To solve this problem, as also shown in FIG. 9, a press roller 18 is held in pressed against the intermediate portion of the roller 12 including the center C. The press roller 18 urges the roller 12 against the drum 1 and is shorter than the roller 12. In this configuration, the press roller 18 allows the roller 12 to press the drum 1 uniformly over its entire length and thereby prevents the charging ability from falling at and around the center C.

Figure 10:
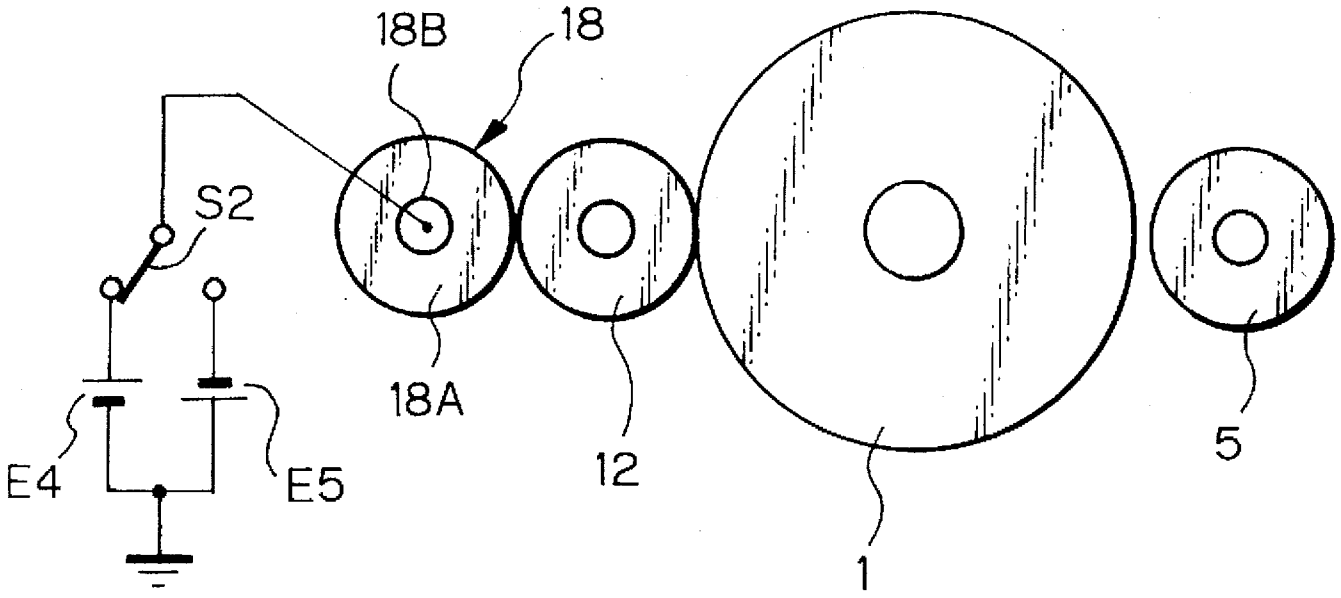
FIG. 10 show another specific arrangement for applying the bias voltage to the cleaning roller.

The press roller 18 consists of a body 18A and a shaft 18B which may both be formed of a conductive material. Then, as shown in FIG. 10, the bias voltage can be applied to the cleaning roller 12 via the shaft 18B and body 18A.

While the embodiment has concentrated on negative-to-positive development, it is also practicable with positive-to-positive development. Positive-to-positive development is such that the portion of the drum 1 uniformly charged, but not illuminated, forms a latent image and then developed by toner charged to the polarity opposite to the polarity of the charge. The cleaning roller 12 may be replaced with an endless belt, if desired. Likewise, the photoconductive drum 1 may be replaced with a photoconductive belt. In addition, the apparatus may be so modified as to transfer the toner image from the drum 1 to a paper by way of an intermediate image transfer body.

As stated above, even when the charging ability of the cleaning member 12 falls due to aging or varying environment, the charge regulating means preceding the cleaning member 12 regulates the entire remaining toner to its original charge polarity. This prevents the toner collecting function or efficiency from the drum 1 and the toner redepositing function on the drum 1 from being deteriorated, thereby freeing the background of an image from contamination. In addition, the accumulation of toner on the cleaning member 12 which would aggravate the above occurrence is eliminated.

2nd Embodiment

Figure 11:
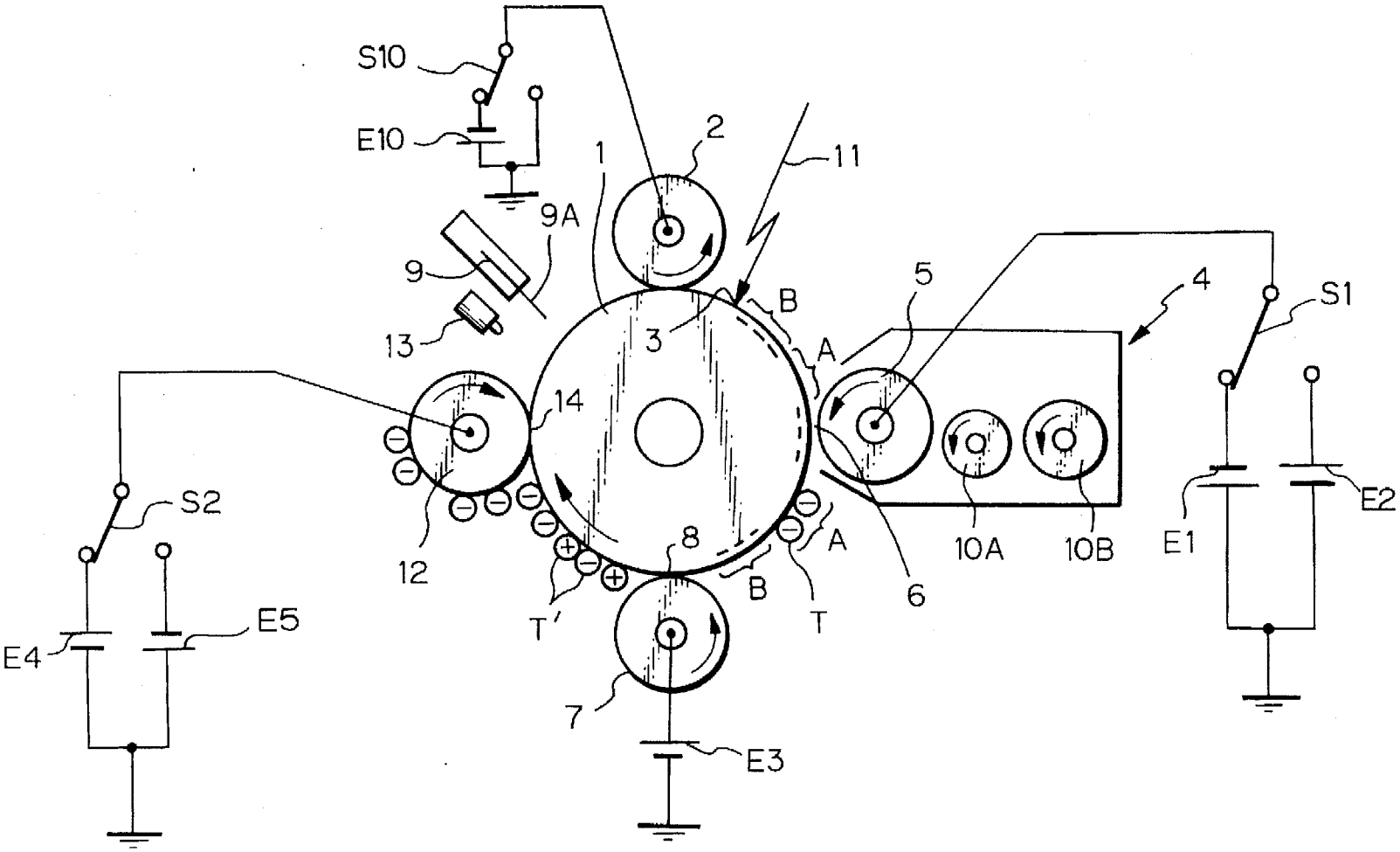
FIG. 11 shows the general construction of a second embodiment of the present invention.

This embodiment is constructed and arranged to solve the previously discussed problem (2). As shown in FIG. 11, the drum 1 is also rotated clockwise by drive means, not shown. The charge roller or main charger 2 charges the surface of the drum 1 in rotation uniformly to the preselected polarity. In the illustrative embodiment, the charge roller 2 is connected to a negative bias voltage source $E_{10}$ and uniformly charges the surface of the drum 1 to negative polarity in contact therewith. Specifically, the charge roller 2 charges the surface of the drum 1 to −850 V. At the exposing position 3, the modulated laser beam 11 scans the charged surface of the drum 1 and thereby electrostatically forms a latent image thereon. Again, the surface of the drum 1 has its potential varied to about −150 V in the portion A scanned by the laser beam 11, while maintaining the potential of about −850 V in the other portion B.

The developing unit 4 includes a pair of paddles 10A and 10B in addition to the developing roller 5. The voltage source $E_1$ applies a bias voltage of about −600 V to the developing roller 5. The voltage applied to the roller 5 is of the same polarity as the charge deposited on the drum 1. In the embodiment, the developing unit 4 also stores a two-ingredient type developer, i.e., toner and carrier mixture, not shown. The toner is charged to the same polarity as the charge deposited on the drum 1, i.e., negative polarity by friction due to the rotation of the paddies 10A and 10B. In this manner, the toner has been charged to negative polarity at the time of development.

The roller 5 conveys the developer toward the developing position 6 while rotating counterclockwise, as viewed in FIG. 11. At the developing position 6, the toner identical in polarity with the drum 1 and contained in the developer is electrostatically transferred from the roller 5 to the scanned portion A of the drum 1, thereby developing the latent image. This embodiment also uses the reversal or negative-to-positive developing system.

The transfer roller or image transfer unit 7 is positioned below the drum 1. The roller 7 is rotated in the same direction as the drum 1 and held in contact with the drum 1 to define the image transfer position 8. A paper or similar recording medium, not shown, is fed to the image transfer position 8. The roller 7 transfers the toner image formed on the drum 1 by the developing unit 4 to the paper. Specifically, the voltage source E3 applies a voltage of polarity opposite to the polarity of the toner deposited on the drum 1, e.g., +950 V. As a result, the toner, labeled T and schematically shown in FIG. 11, is electrostatically transferred from the drum 1 to the paper. The paper with the toner image is separated from the drum 1 by the separating device, not shown, and then fed to the fixing unit. The fixing unit fixes the toner image on the paper.

After the above image transfer, a part of the toner T remains on the surface of the drum 1. This part of the toner, labeled T', is conveyed to the cleaning position 14 by the drum 1. The cleaning roller or cleaning member 12 collects the toner T' from the drum 1.

The toner T moving away from the developing position 6 toward the image transfer position 8 is substantially entirely of negative polarity. On the other hand, the toner T' left on the drum 1 after the image transfer is partly of positive polarity due to the positive bias applied to the transfer roller 7. Specifically, about 80% of the toner T' is of positive polarity while the rest is of negative polarity. In any case, the toner T' consisting of particles of positive polarity and particles of negative polarity reaches the cleaning position 14.

The cleaning roller 12 is formed of, e.g., a foam material having a medium specific volume resistivity. The roller 12 is rotated clockwise, as viewed in FIG. 1, in frictional contact with the surface of the drum 1. As shown in FIG. 2, at the nip N between the drum 1 and the roller 12, the roller 12 is elastically deformed by the drum 1 while pressingly contacting it. The nip N defines a cleaning region. At the nip N, both the positive and negative particles of the toner T' are charged to the same polarity as the toner T (negative polarity in the embodiment) by friction while contacting the roller 12.

Referring again to FIG. 11, the voltage source E4 applies a bias voltage opposite in polarity to the toner, e.g., +300 V to the cleaning roller 12. In this condition, the toner T' reached the cleaning position 14 is electrostatically transferred to the roller 12 and collected thereby. As a result, the surface of the drum 1 is cleaned. Specifically, the bias voltage applied to the roller 12A forms an electric field between the roller 12 and the drum 1 in the direction tending to transfer the toner from the drum 1 to the roller 12. Before the roller 12 completes one rotation in the direction counter to the drum 1, the toner T' is efficiently collected from the drum 1 by the roller 12.

The discharge lamp or discharger 13 discharges the surface of the drum 1 having been cleaned by the cleaning roller 12. Thereafter, the previously stated image forming procedure is repeated. After the trailing edge of the previously stated image area has moved away from the charge roller 2, the roller 2 is released from the drum 1. At this instant, the switch $S_{10}$ is operated to interrupt the bias voltage to the charge roller 2. After the trailing edge of the image area has moved away from the developing roller 5, the switch $S_1$ is operated to connect the roller 5 to the voltage source $E_2$. The voltage source $E_2$ applies a bias voltage opposite in polarity to the charge of the toner, e.g., +150 V to the roller 5 in order to prevent the toner from depositing on the drum 1. After the trailing edge of the image area has moved away from the image transfer position 8, the application of the voltage to the transfer roller 7 is interrupted.

Further, after the trailing edge of the image area of the drum 1 has moved away from the cleaning roller 12, the switch $S_2$ is operated to connect the roller 12 to the voltage source $E_5$. The voltage source $E_5$ applies a voltage identical in polarity with the charge of the toner, e.g., −500 V to the roller 12. As a result, an electric field is formed between the roller 12 and the non-image area of the drum 1 in the direction tending to return the toner from the roller 12 to the drum 1. By this electric field, the toner collected on the roller 12 is redeposited on the non-image area of the drum 1. The toner redeposited on the drum 1 is conveyed by the drum 1 to the developing unit 4 via the discharge lamp 13 and charge roller 2 now released from the drum 1. The developing roller 5 applied with the positive bias electrostatically collects the toner of negative polarity from the drum 1 and introduces it into the developer existing in the developing unit 4.

When the image forming operation is continuously performed, the above procedure is repeated a preselected number of times.

As stated above, the toner remaining on the drum 1 after image transfer is collected by the cleaning roller 12, then redeposited on the drum 1, and then collected by the developing unit 4 to be reused. This makes it needless to discard the collected toner. In addition, a piping or similar exclusive passageway for returning the toner collected by the roller 12 to the developing unit 4 is not necessary.

The toner is redeposited from the 12 on the non-image area of the drum 1 following the trailing edge of the image area. Therefore, the toner returned to the drum 1 does not effect either the latent image formed first or a latent image to be formed next. If desired, the toner collected by the roller 12 may be redeposited on a trailing portion of the inside of the image area.

The cleaning roller 12 functions to charge the toner remaining on the drum 1 on the basis of friction acting between it and the drum 1, as stated above. Specifically, when the toner conveyed to the roller 12 by the drum 1 contains particles charged to the polarity opposite to the original polarity, the roller 12 restores the toner to its original polarity. For this purpose, the roller 12 has at least its surface portion formed of a material capable of charging the toner to its original polarity (negative polarity in the embodiment).

In practice, however, it is difficult to restore the entire toner T' remaining on the drum 1 to its original polarity; that is, some toner particles are still of polarity opposite to the original polarity when reaching the cleaning roller 12. Another problem is that some toner particles move away from the roller 12 without being collected thereby. If the toner of opposite polarity moves away from the roller 12, then the problems discussed earlier are brought about.

Specifically, assume that the toner of opposite polarity (positive polarity in the embodiment) and moved away from the cleaning roller 12 reaches the charge roller 2 via the cleaning position 14. Then, because the negative bias is applied from the power source $E_{10}$ to the charge roller 2, the toner is electrostatically transferred from the drum 1 to the roller 2 and contaminates it. Further, assume that the drum 1 has not been fully charged when the portion of the drum 1 cleaned by the cleaning roller arrives at the roller 2. Then, the negative bias is applied from the power source $E_{10}$ to the charge roller 2 still contacting the drum 1. As a result, the toner with negative polarity and moved away from the cleaning roller 12 is electrostatically transferred to the charge roller 2. The toner transferred to the charge roller 2 brings about irregular charging and thereby lowers the quality of toner images to be formed later.

To solve the above problems, as shown in FIG. 11, the needle electrode type charger or charge regulating means 9 is located downstream of the cleaning roller 12, but upstream of the charge roller or main charger 2, in the direction of rotation of the drum 1. The charger 9 faces the drum 1 and deposits a charge of polarity identical with the original polarity on the toner of polarity opposite to the original polarity and moved away from the roller 12. The charger 9 is implemented as an about 0.1 mm thick sheet of, e.g., stainless steel. The edge portion of the sheet facing the drum 1 is formed with a number of needle-like electrodes 9A arranged in the axial direction of the drum 1. The electrodes 9A are spaced from the surface of the drum 1. A voltage source, not shown, applies a DC voltage to the charger 9 in order to cause a discharge current to flow between the electrodes 9A and the drum 1. As a result, the toner of opposite or positive polarity and moved away from the cleaning position 14 is charged to negative polarity. Hence, all the toner moved away from the charger 9 has the original polarity. It follows that despite the negative voltage applied to the charge roller 2, the toner is scarcely transferred from the drum 1 to the roller 2 due to electrical repulsion acting between the roller 2 and the toner. This frees the roller 2 from contamination ascribable to the toner and thereby reduces irregular charging which would lower image quality.

When the toner restored to its original charge by the charger 9 arrives at the developing unit 4 via the charge roller 2, it is collected by the developer existing on the developing roller 5 due to a scavenging force. Even if such toner moves away from the developing unit 4, it is successfully collected by the cleaning roller 12.

Figure 12:
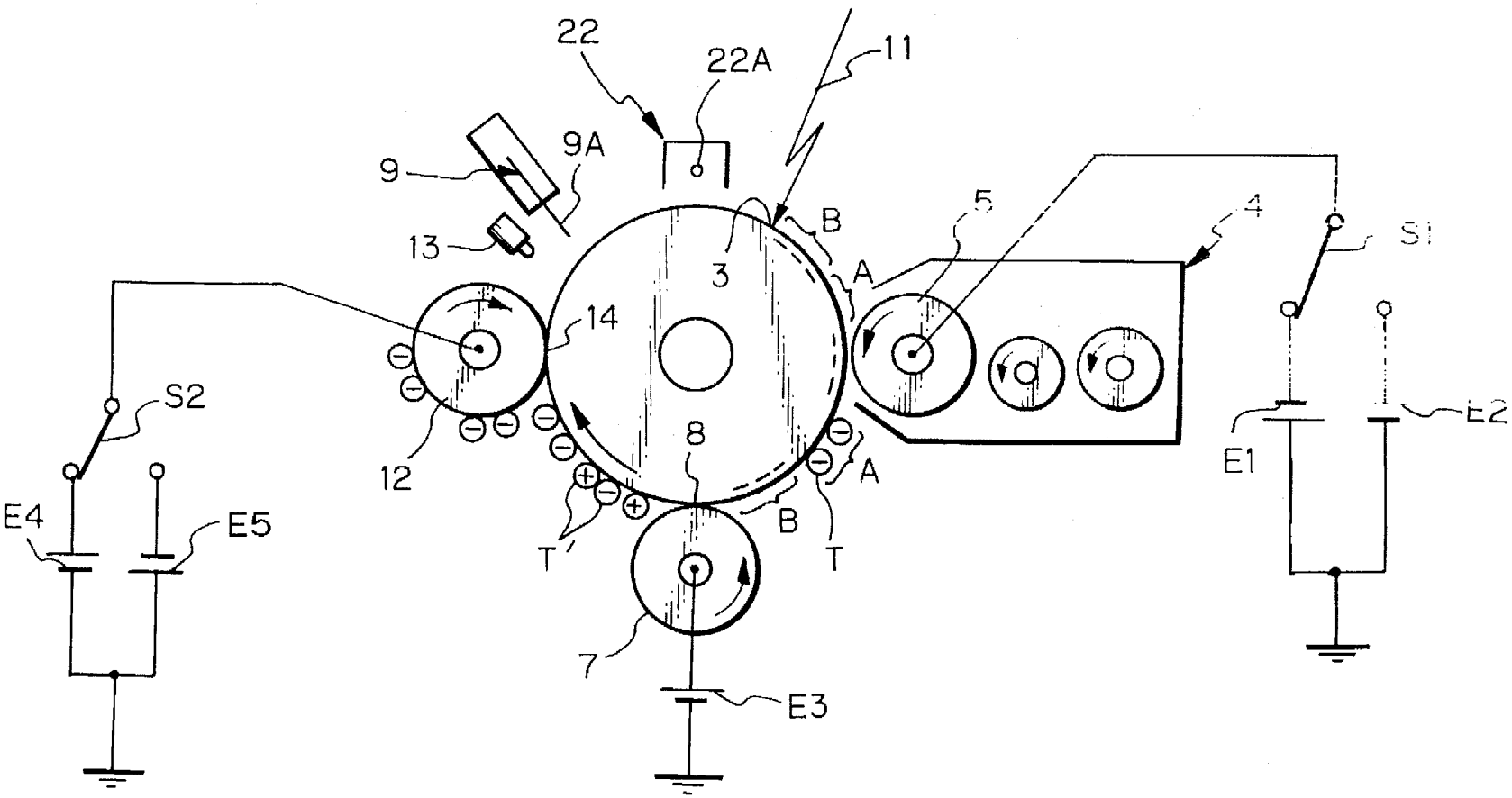
FIG. 12 shows a modification of the second embodiment.

The charge roller 2 may be replaced with a corona discharger 22 shown in FIG. 12, if desired. The charge roller 2 is contact type charging means contacting the drum 1 while the corona discharger 22 is non-contact type charging means. The voltage identical in polarity with the charge originally deposited on the toner for development is also applied to a charge wire 22A. Again, the charger 9 protects the charge wire 22A from contamination ascribable to the toner of opposite polarity and moved away from the cleaning roller 12.

Figure 13:
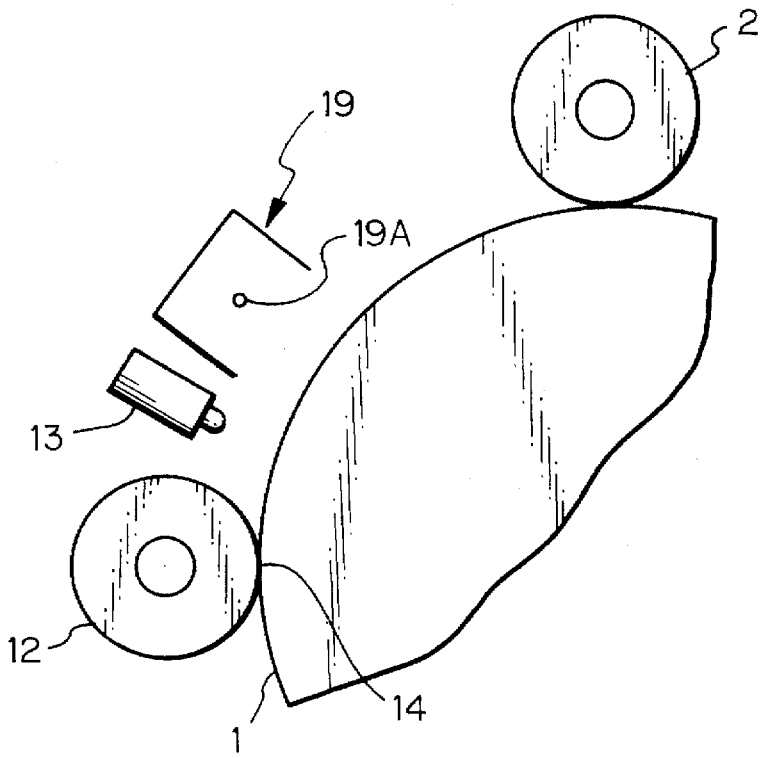
FIGS. 13 and 14 each shows a specific form of charge regulating means included in the second embodiment.
Figure 14:
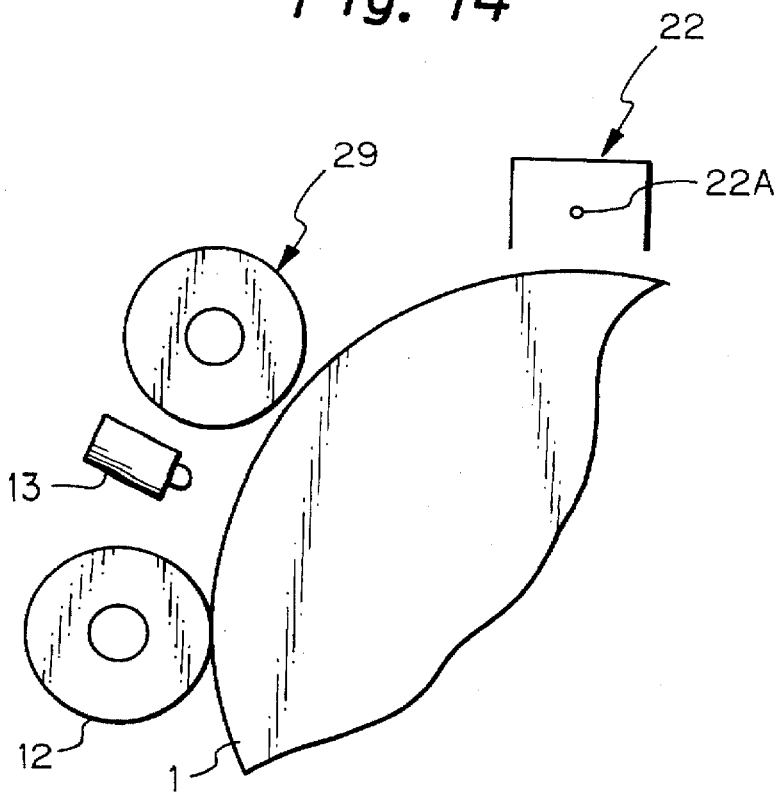

FIG. 13 shows a corona discharger 19 which may be used in placed of the needle electrode type charger 9. The corona discharger 19 also has a charge wire 19A to which a negative voltage is applied from a power source, not shown. The corona discharger 19 is identical in role with the charger 9. Further, as shown in FIG. 14, use may be made of a conductive roller 29 capable of charging the toner to the desired polarity without contacting the drum 1.

The needle electrode type charger 9, corona discharger 19 and conductive roller 29 are specific forms of non-contact type charge regulating means not contacting the drum 1. This type of charge regulating means, compared to contact type regulating means, allows a minimum of toner moved away from the cleaning position 14 to deposit thereon and is therefore free from contamination and faults ascribable thereto. A blade, not shown, may be held in contact with the roller 29 in order to remove the toner, if any, from the roller 29.

As shown in FIG. 11, when the toner is charged by friction between the cleaning roller 12 and the drum 1, it is necessary not only to regulate the polarity of the charge but also to increase the charge to a preselected level. In practice, however, the toner unavoidably contains some particles of short charge despite that the frictional charging effected by the roller 12. Particularly, it is likely that the particles of polarity opposite to the original polarity remain short of charge even when restored to the original polarity. In addition, the particles of opposite polarity is apt to deposit on the roller 12. Assume that the particles of short charge and the particles of opposite polarity are collected by the roller 12, returned to the drum 1, and then collected by the developing unit 4. Then, the paddles 10A and 10B must be driven at a high speed in order to increase the amount of charge of the toner to a preselected level. This undesirably increases power for driving the paddies 10A and 10B and thereby increases the load on the developing unit 4.

In the developing unit 4, the toner for development must be charged to, e.g., −20 μc/g by the paddles 10A and 10B. So long as the charge of the entire toner returned from the cleaning roller 12 to the drum 1 is −17 μc/g or so, the load on the developing unit 4 is not critical. However, when the toner includes particles whose charge is −5 μc/g or so, the load on the developing unit 4 is heavy. Moreover, when the paddles 10A and 10B are rotated at a high speed, the developer is apt to deteriorate due to stresses acting on the toner contained therein. This is also true even when use is made of a developer containing toner, but lacking carrier. To solve this problem, at least the surface of the cleaning roller 12 is formed of a material capable of charging the toner, including the particles of opposite polarity, to the original polarity. In addition, the charge regulating means, e.g., needle electrode type charger 9 shown in FIG. 11 is positioned downstream of the roller 12, but upstream of the charge roller 2.

Even when the toner returned from the cleaning roller 12 to the drum 1 passes by the charger 9, the DC voltage identical in polarity with the charge originally deposited on the toner is applied to the charger 9. The resulting discharge current charges the toner deposited on the drum 1 to its original polarity (negative polarity in the embodiment). As a result, the charge of the toner is increased. This successfully reduces stresses acting on the toner and apt to accelerate the deterioration of the toner. In addition, the efficient toner collection by the developing roller 5 is enhanced because the charge of the toner is increased in such a direction that the toner flies toward the developing unit 4.

With any one of the charge regulating means 9, 19 and 29 shown in FIGS. 11, 13 and 14, it is also possible to charge the surface of the drum 1 moved away from the cleaning position 14 to a preselected potential, e.g., about −800 V. The bias voltages of −600 V and +150 V are respectively applied to the developing roller 5 in the event of development and in the event of toner collection, as stated earlier. If the surface of the drum 1 is charged to −800 V before the toner collection by the developing unit 4, then it is needless to switch the bias voltage to be applied to the developing roller 5. That is, only if the power source $E_1$ continuously applies the bias voltage of −600 V to the roller 5, the toner can be electrostatically transferred from the drum 1 to the roller 5 due to the potential difference of 200 V between the drum 1 and the roller 5. Consequently, the apparatus is simplified in construction and reduced in cost.

The above charger 9, charger 19 and roller 29 each constitutes charge regulating means for charging up the toner returned from the cleaning roller 12 to the drum 1. If desired, such charge regulating means may be replaced with non-contact type regulating means, e.g., the charger 22 shown in FIG. 12, in which case the charger 22 will be provided with a function of charging up the toner in addition to the function of charging the toner uniformly. This kind of schemes allows the charger 9, 19 or 29 to be omitted so as to further reduce the cost of the apparatus. However, if the voltage applied to the charger 22 for charging up the toner is as high as the voltage for charging the drum 1 uniformly, then the toner with an excessive charge is redeposited on the developing unit 4. Consequently, in the case of toner and carrier mixture, the toner adheres to the carrier with an excessive force and is deteriorated or spent.

In light of the above, switching means may be used to raise the voltage to be applied to the charger 22 when the drum 1 should be uniformly charged, and to lower it when the toner redeposited on the drum 1 should be charged. The lowered voltage is also successful to prevent the deterioration of the drum 1 from being accelerated.

While the embodiment has also concentrated on negative-to-positive development, it is also practicable with positive-to-positive development. The cleaning roller 12 may be replaced with an endless belt, if desired. Likewise, the photoconductive drum 1 may be replaced with a photoconductive belt. In addition, the apparatus may be so modified as to transfer the toner image from the drum 1 to a paper by way of an intermediate image transfer body.

As stated above, this embodiment prevents the toner returned from the cleaning roller 12 to the drum 1 and moved away from the roller 12 from depositing on the charger and lowering the quality of toner images. The embodiment not only regulates the polarity of such toner, but also increases the amount of charge deposited thereon. This reduces the load acting on the developing unit 4 which charges the toner by friction. In addition, because the above toner should only be charged to a moderate degree, the toner is free from stresses and therefore from noticeable deterioration.

3rd Embodiment

Figure 15:
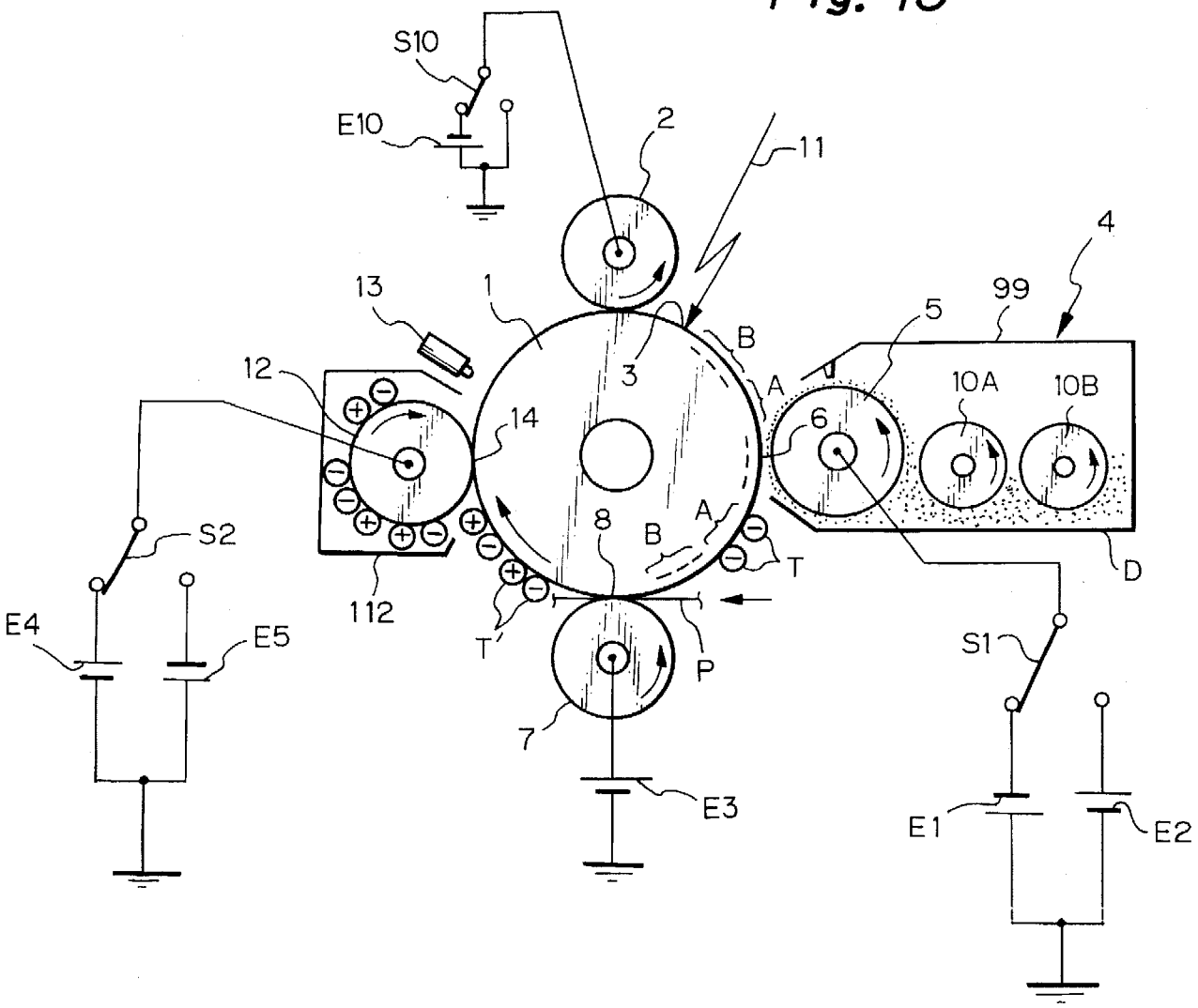
FIG. 15 is a view showing the general construction of a third embodiment of the present invention.

This embodiment is a solution to the problem (3). As shown in FIG. 15, the drum 1 is also rotated clockwise by drive means, not shown. The main charger or charge roller 2 charges the surface of the drum 1 in rotation uniformly to the preselected polarity. In the illustrative embodiment, the charge roller 2 is connected to the negative voltage source $E_{10}$ and charges the surface of the drum 1 to negative polarity in contact therewith. Specifically, the roller 2 charges the surface of the drum 1 to −850 V. The roller 2 may be replaced with, e.g., a corona discharger capable of charging the drum 1 without contacting it. At the exposing position 3, the modulated laser beam 11 scans the charged surface of the drum 1 and thereby electrostatically forms a latent image thereon. Again, the surface of the drum 1 has its potential varied to about −150 V in the portion A scanned by the laser beam 11, while maintaining the potential of about −850 V in the other portion B.

The developing unit 4 includes the developing roller or developer carrier 5 facing the drum 1, and the paddles 10A and 10B. The developing roller 5 and paddles 10A and 10B are rotatably mounted on a casing 99. The voltage source $E_1$ applies a bias voltage of, e.g., about −600 V to the developing roller 5. The voltage applied to the roller 5 is of the same polarity as the charge deposited on the drum 1. In the embodiment, the developing unit 4 also stores a two-ingredient type developer D. The toner of the developer D is charged to the same polarity as the charge deposited on the drum 1, i.e., negative polarity by friction due to the rotation of the paddies 10A and 10B. In this manner, the toner has been charged to negative polarity at the time of development.

The developing roller 5 conveys the developer toward the developing position 6 while rotating counterclockwise, as viewed in FIG. 11. At the developing position 6, the toner identical in polarity with the drum 1 and contained in the developer is electrostatically transferred from the roller 5 to the scanned portion A of the drum 1, thereby developing the latent image. This embodiment also uses the reversal or negative-to-positive developing system.

The transfer roller or image transfer unit 7 is positioned below the drum 1. The transfer roller 7 is rotated in the same direction as the drum 1 and held in contact with the drum 1 to define the image transfer position 8. A paper or similar recording medium P is fed to the image transfer position 8. The roller 7 transfers the toner image formed on the drum 1 by the developing unit 4 to the paper P. Specifically, the power source E3 applies a voltage opposite in polarity to the charge of the toner deposited on the drum 1, e.g., +950 V to the roller 7. As a result, the toner, labeled T and schematically shown in FIG. 15, is electrostatically transferred from the drum 1 to the paper P. The paper P with the toner image is separated from the drum 1 by the separating device, not shown, and then fed to the fixing unit. The fixing unit fixes the toner image on the paper P.

After the above image transfer, a part of the toner T remains on the surface of the drum 1. This part of the toner, labeled T', is conveyed to the cleaning position 14 by the drum 1. The cleaning roller or cleaning member 12 collects the toner T' from the drum 1.

The toner T moving away from the developing position 6 toward the image transfer position 8 is substantially entirely of negative polarity. On the other hand, the toner T' left on the drum 1 after the image transfer is partly of positive polarity due to the positive bias applied to the transfer roller 7. Specifically, about 80% of the toner T' is of positive polarity while the rest is of negative polarity. In any case, the toner T' consisting of particles of positive polarity and particles of negative polarity reaches the cleaning position 14.

The cleaning roller 12 is formed of, e.g., a foam material having a medium specific volume resistivity. The roller 12 is rotated clockwise, as viewed in FIG. 1, in frictional contact with the surface of the drum 1. As shown in FIG. 2, at the nip N between the drum 1 and the roller 12, the roller 12 is elastically deformed by the drum 1 while pressingly contacting it. The nip N defines a cleaning region. At the nip N, both the positive and negative particles of the toner T' are charged to the same polarity as the toner T (negative polarity in the embodiment) by friction while contacting the roller 12.

As stated above, when the toner reached the cleaning roller 12 contains particles of opposite polarity, the roller 12 charges the toner by friction in order to restore it to the original polarity. For this purpose, the roller 12 is formed of a material capable of charging the toner to the original polarity, i.e., negative polarity in the embodiment.

Referring again to FIG. 15, the voltage source E4 applies a bias voltage opposite in polarity to the charge of the toner, e.g., +200 V to the cleaning roller 12. In this condition, the toner T' reached the cleaning position 14 is electrostatically transferred to the roller 12 and collected thereby. As a result, the surface of the drum 1 is cleaned. Specifically, the bias voltage applied to the roller 12 forms an electric field between the roller 12 and the drum 1 in the direction tending to transfer the toner from the drum 1 to the roller 12.

The discharge lamp or discharger 13 discharges the surface of the drum 1 having been cleaned by the cleaning roller 12. Thereafter, the previously stated image forming procedure is repeated. After the trailing edge of the image area has moved away from the charge roller 2, the roller 2 is released from the surface of the drum 1. At this instant, the switch $S_{10}$ is operated to interrupt the bias voltage to the charge roller 2. After the trailing edge of the image area has moved away from the developing roller 5, the switch $S_1$ is operated to connect the roller 5 to the voltage source $E_2$. The voltage source $E_2$ applies a bias voltage opposite in polarity to the charge of the toner, e.g., +500 V to the roller 5 in order to prevent the toner from depositing on the drum 1. After the trailing edge of the image area has moved away from the image transfer position 8, the application of the voltage to the transfer roller 7 is interrupted.

Further, after the trailing edge of the image area of the drum 1 has moved away from the cleaning roller 12, the switch $S_2$ is operated to connect the roller 12 to the voltage source $E_5$. The voltage source $E_5$ applies a voltage identical in polarity with the charge of the toner, e.g., −500 V to the roller 12. As a result, an electric field is formed between the roller 12 and the non-image area of the drum 1 in the direction tending to return the toner from the roller 12 to the drum 1. By this electric field, the toner collected on the roller 12 is redeposited on the non-image area of the drum 1. The toner redeposited on the drum 1 is conveyed by the drum 1 to the developing unit 4 via the discharge lamp 13 and charge roller 2 now released from the drum 1. The developing roller 5 applied with the positive bias electrostatically collects the toner of negative polarity from the drum 1 and introduces it into the developer existing in the developing unit 4.

When the image forming operation is continuously performed, the above procedure is repeated a preselected number of times.

As stated above, the toner remaining on the drum 1 after image transfer is collected by the cleaning roller 12, then returned from the roller 12 to the drum 1, and then collected by the developing unit 4 to be reused. This makes it needless to discard the collected toner. In addition, a piping or similar exclusive passageway for returning the toner collected by the roller 12 to the developing unit 4 is not necessary.

The toner is returned from the drum 12 to the non-image area of the drum 1 following the trailing edge of the image area. Therefore, the toner redeposited on the drum 1 does not effect either the latent image formed first or a latent image to be formed next. If desired, the toner may be returned from the roller 12 to a trailing portion of the inside of the image area.

The cleaning roller 12 regulates the toner T' containing the particles of opposite polarity and moved away from the image transfer position 8 by friction, as stated earlier. However, it is difficult to charge the entire toner to its original polarity at the nip N shown in FIG. 2. The bias voltage applied to the roller 12 and opposite in polarity to the charge of the toner is expected to cause the roller 12 to electrostatically collect the toner. However, even the particles of opposite polarity are transferred to the roller 12 due to the mechanical scraping force of the roller 12, resulting in the contamination of the background of an image and that of the charge roller 2.

To solve the above problem, in the event of transfer of the toner T' from the drum 1 to the cleaning roller 12, the roller 12 is moved in the direction counter to the drum 1, as seen at the nip N. In addition, the roller 12 completes the toner collection by less than one rotation thereof. This prevents the toner T collected by the roller 12 from again contacting the drum 1 during the toner collection. Further, the particles of opposite polarity are prevented from being electrostatically transferred to the surface of the drum 1 cleaned by the roller 12.

Assume that the cleaning roller 12 is moved in the same direction as the drum 1, as seen at the nip N shown in FIG. 2, during toner collection. Then, the collected toner, labelled T", exists on the downstream portion of the roller 12 with respect to the direction of rotation of the drum 1. If the toner T" is of opposite or positive polarity, then it is electrostatically transferred to the drum 1 due to the positive bias voltage applied to the roller 12. This not only brings about defective cleaning but also causes the toner T" to deposit on the charge roller 2 and contaminate the background of toner images to be formed later. This is why the roller 12 is moved in the opposite direction to the drum 1. Assume that the roller 12 collects the toner from the drum 1 by one or more rotations. Then, the toner T" containing the particles of opposite polarity again deposits on the drum 1 and renders the cleaning of the drum 1 defective. This is why the roller 12 collects the toner from the drum 1 by less than one rotation.

By the above configuration, the toner of opposite polarity is prevented from being transferred to the drum 1 during toner collection. Assume that when the toner collected by the developing roller 12 is to be redeposited on the drum 1, a bias voltage of the same polarity as the original charge of the toner, i.e., of the opposite polarity to the particles of opposite polarity is applied to the roller 12. Then, the particles of opposite polarity remain on the roller 12 without being transferred to the drum 1. As a result, at the time of the next toner collection, the particles of opposite polarity are transferred to the drum 1 because the voltage of the same polarity as the charge of such particles is applied to the roller 12. This contaminates the background of a toner image and the charge roller 2, resulting in the previously stated problems.

In light of the above, when the voltage of the same polarity as the original charge of the toner is applied to the cleaning roller 12 for the redeposition of the toner on the drum 1, the roller 12 is caused to perform at least one rotation. While the direction of this rotation of the roller 12 is open to choice, the embodiment rotates the roller 12 such that it moves in the same direction as the drum 1, as seen at the nip N shown in FIG. 2. During the at least one rotation of the roller 12, the toner of original or negative polarity is electrostatically transferred from the roller 12 to the drum 1 and redeposited thereon. This toner is collected by the developing unit 4 later, as stated previously. Substantially the entire toner of negative polarity deposited on the roller 12 is transferred to the drum 1 and then collected by the developing unit 4.

After the above redeposition process, a voltage opposite in polarity to the original charge of the toner is applied to the cleaning roller 12. For example, the switch $S_2$ (FIG. 15) is operated to connect the roller 12 to the power source $E_4$ so as to apply a positive bias voltage to the roller 12. As a result, the toner particles of opposite polarity and existing on the roller 12 are electrostatically transferred from the roller 12 to the drum 1. These particles are also conveyed to the developing unit 4 by the drum 1 and collected thereby.

The redeposition process using the positive bias voltage is also continued until the cleaning roller 12 completes at least one rotation. Therefore, the toner of opposite polarity and collected by the roller 12 is substantially entirely transferred to the drum 1 and collected by the developing unit 4. While the direction of this rotation of the roller 12 is also open to choice, the embodiment rotates the roller 12 such that it moves in the same direction as the drum 1, as seen at the nip N shown in FIG. 2.

The two consecutive steps described above allow both the particles of original polarity and those of opposite polarity to be transferred form the cleaning roller 12 to the drum 1. Because the roller 12 performs at least one rotation at each time of redeposition, substantially the entire toner can be returned from the roller 12 to the drum 1. This protects the charge roller 2 from contamination ascribable to the toner which would otherwise deposit on the drum 1 at the time of the next collection. The charge roller 2 can therefore charge the drum 1 uniformly and insures desirable image quality.

While the embodiment redeposits the toner of original or negative polarity on the drum 1 and then redeposits the toner of opposite or positive polarity, it may redeposit the latter on the drum 1 prior to the former, if desired.

The above control is executed by cleaning member control means, not shown. The control means causes the redeposition process in which the cleaning roller 12 performs at least one rotation to occur twice. At the time of one of the two consecutive redeposition processes, the control means applies the voltage of the same polarity as the original charge of the toner to the roller 12 in order to redeposit the toner of original polarity on the drum 1. At the time of the other redeposition process, the control means applies the voltage opposite in polarity to the original charge of the toner to the roller 12 in order to redeposit the toner of opposite polarity on the drum 1.

Further, when the toner is to be collected by the cleaning roller 12 from the drum 1, the control means applies the bias voltage opposite in polarity to the original charge of the toner to the roller 12. At the same time, the control means causes the roller 12 to rotate such that it moves in the opposite direction to the drum 1, as seen at the nip N shown in FIG. 2. In addition, the control means causes the roller 12 to collect the toner from the drum 1 by less than one rotation thereof.

Assume that the toner of negative polarity and the toner of positive polarity are sequentially redeposited on the drum 1 in this order, as stated above. Then, in the developing unit 4, the switch $S_1$ is operated to connect the developing roller 5 to the power source $E_2$ first. In this condition, a positive bias voltage is applied to the roller 5 in order to electrostatically collect the toner of negative polarity from the drum 1. Subsequently, the switch $S_1$ is operated to connect the roller 5 to the power source $E_1$ with the result that a negative bias voltage is applied to the roller 5 to collect the toner of positive polarity from the drum 1. When the above order of toner redeposition on the drum 1 is reversed, the order of voltages to be applied to the roller 5 will also be reversed. The power sources $E_1$ and $E_2$ and switch $S_1$ constitute voltage applying means in combination.

Figure 16:
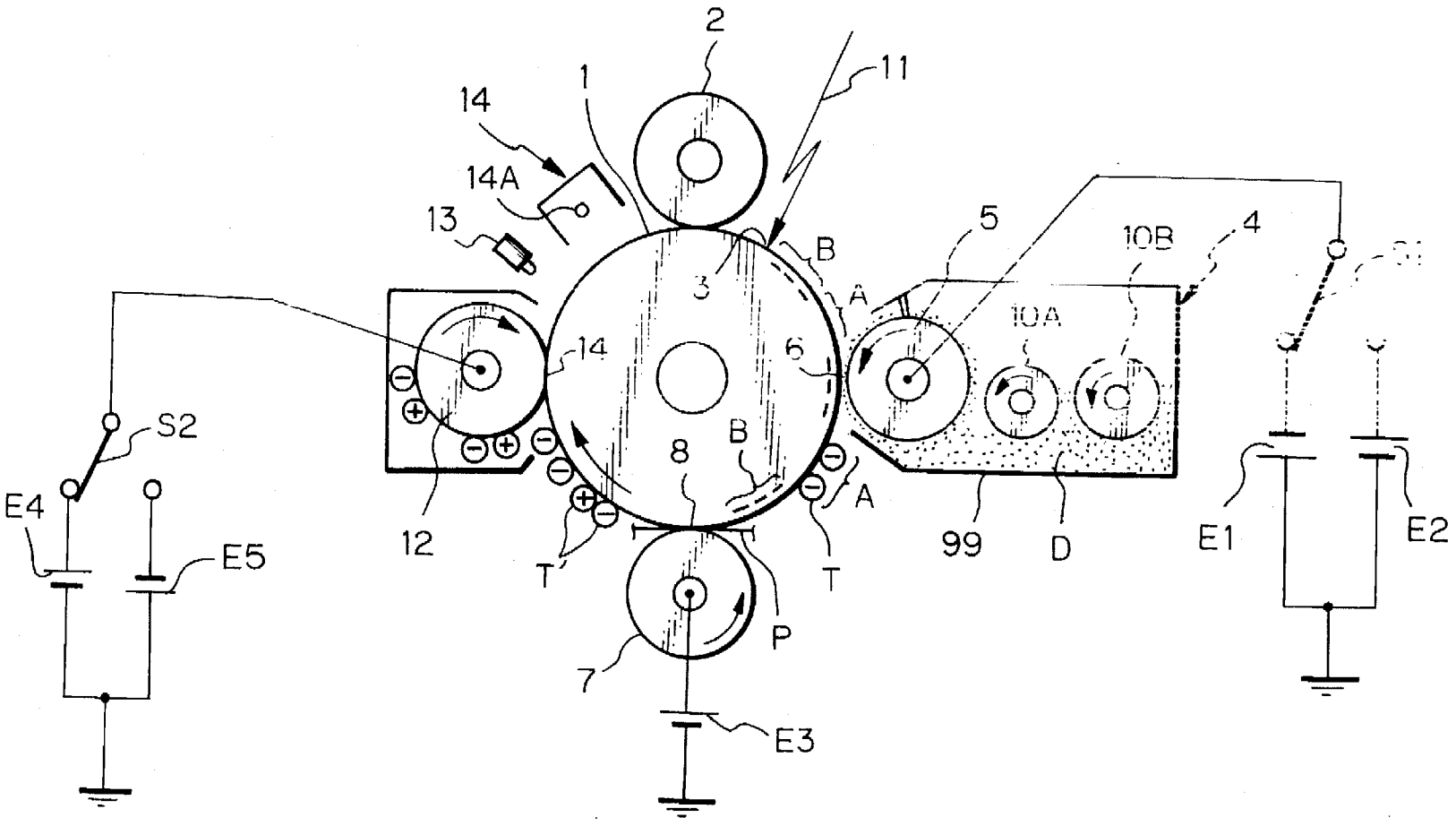
FIG. 16 shows a modification of the third embodiment.

FIG. 16 shows an alternative implementation for allowing the developing roller 5 to collect the toner particles of two polarities one after the other. As shown, a charger 14 is implemented by a corona discharger and located to face the drum 1. The charger 14 is positioned downstream of the cleaning roller 12, but upstream of the charge roller 2, in the direction of rotation of the drum 1. The charger 14 charges the toner of opposite polarity and redeposited on the drum 1 to the original polarity. With this implementation, it is possible to omit the switching of the voltages to be applied to the roller 5.

When the toner of opposite polarity and redeposited on the drum 1 reaches the charger 14, a voltage of the same polarity (negative) as fie original charge of the toner is applied to a charge wire 14A included in the charger 14. As a result, the toner of opposite polarity is charged to its original or negative polarity by corona discharge. Therefore, when the developing unit 4 collects the toner from the drum 1, a positive bias voltage should only be applied to the roller 5 without regard to the polarity which the toner had on the cleaning roller 12. Specifically, because the toner of opposite polarity is charged to negative polarity by the charger 14, the roller 5 should only be continuously connected to the power source $E_2$. This simplifies the control over the developing unit 4.

Figure 17:
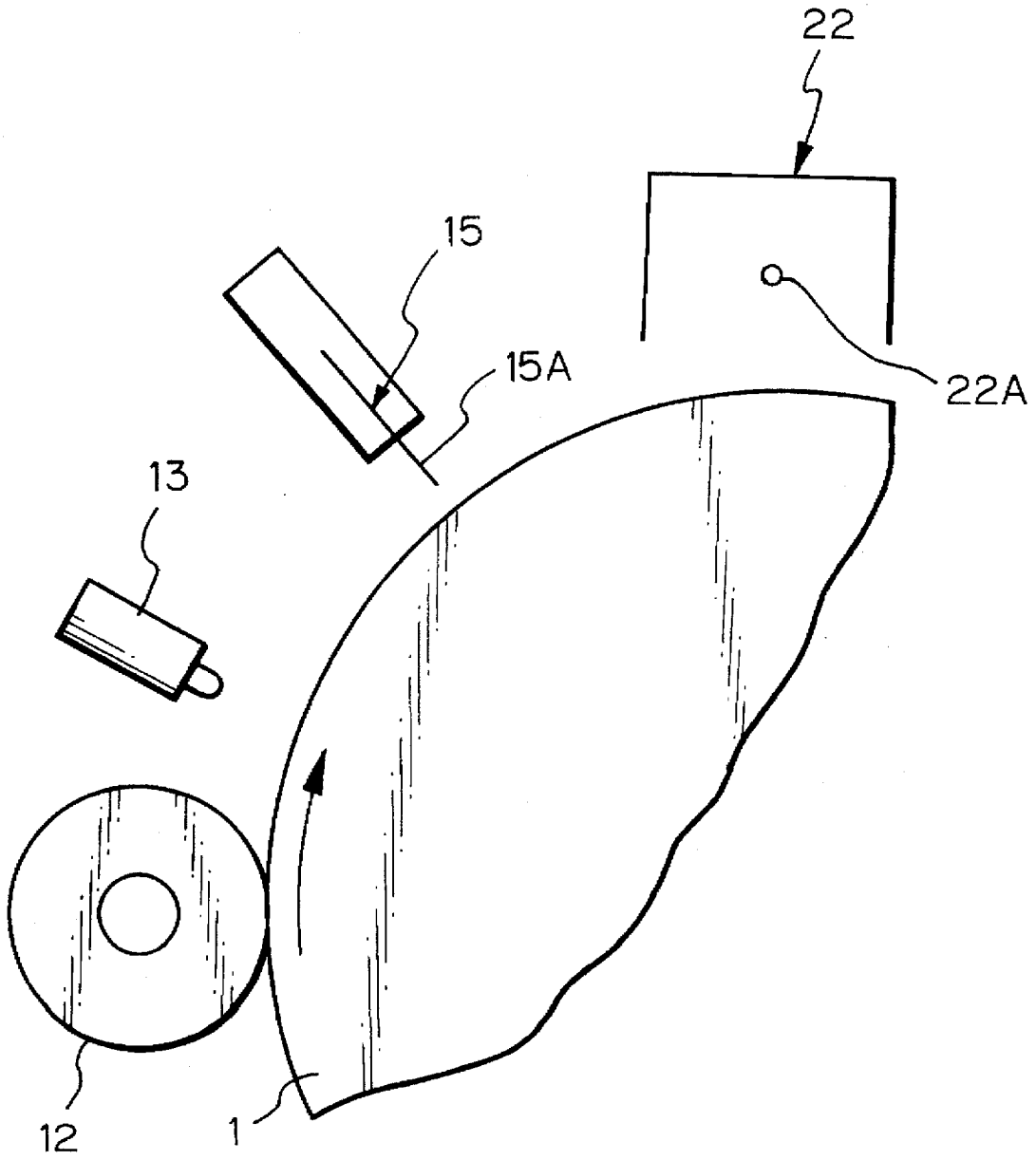
FIG. 17 shows a specific form of charge regulating means included in the third embodiment.

FIG. 17 shows a needle electrode type charger 15 which may be used in place of the above charger 14. When the charger 15 is used, the surface of the drum 1 is uniformly charged by a charger implemented as a corona discharger 22, as shown in FIG. 17. The charger 15 is another specific form of non-contact type charge regulating means spaced from the drum 1. The charger 15 is implemented as an about 0.1 mm thick sheet of, e.g., stainless steel. The edge portion of the sheet facing the drum 1 is formed with a number of needle-like electrodes 15A arranged in the axial direction of the drum 1. The electrodes 15A are spaced from the surface of the drum 1. When the toner of opposite polarity and redeposited on the drum 1 arrives at the charger 15, a voltage source, not shown, applies a voltage of the same polarity as the original charge of the toner to the charger 15 in order to cause a discharge current to flow between the electrodes 15A and the drum 1. As a result, the toner of opposite is charged to the original polarity by the electrodes 15A With the needle electrode type charger 15, it is also possible to omit the switching of voltages of the developing unit 4 as with the charger 14.

The charger 14 or 15 not contacting the drum 1 allows a minimum of toner redeposited on the image carrier 1 to deposit thereon, compared to contact type charge regulating means. The charger 14 or 15 is therefore free from contamination ascribable to such toner and faults ascribable to the contamination.

The above chargers 14 and 15 each constitutes charge regulating means for charging the toner of opposite polarity to its original polarity. If desired, such charge regulating means may be implemented by non-contact type regulating means, e.g., the charger 22 shown in FIG. 17. When the toner of opposite polarity and redeposited on the drum 1 arrives at the charger 22, a voltage of the same polarity as the original charge of the toner is applied to the charge wire 22A of the charger 22 in order to charge the toner to its original polarity. In this case, the needle electrode type charger 15 is not necessary. In this manner, when the charger 22 has a function of charging the toner to its original polarity in addition to a function of charging the drum 1 uniformly, the charger 14 or 15 is not necessary. This successfully reduces the cost of the apparatus.

If the voltage applied to the charger 22 for charging the toner of opposite polarity is as high as the voltage for charging the drum 1 uniformly, then the toner with an excessive charge is returned to the developing unit 4.

Consequently, in the case of toner and carrier mixture, the toner adheres to the carrier with an excessive force and is deteriorated or spent. In light of this, switching means may be used to raise the voltage to be applied to the charger 22 when the drum 1 should be uniformly charged, and to lower it when the toner of opposite polarity 1 should be charged.

Even with the charger 14, 15 or 22, it is possible to enhance the efficient collection the toner of original or negative polarity if the toner is charged to have its charge increased.

While the above charge regulating means charges the toner of opposite polarity to its original polarity, it may additionally charge the surface of the drum 1 moved away from the cleaning position 14 to a preselected potential. For example, the regulating means may charge the surface of the drum carrying the redeposited toner thereon to about −800 V. Specifically, a bias voltage of, e.g., −600 V and a bias voltage of, e.g., +500 V are respectively applied to the developing roller 5 at the time of development and at the time of collection of the toner of negative polarity, as stated earlier. Assume that the regulating means charges the drum 1 to −800 V before the collection of the toner of positive polarity and that of negative polarity in the developing unit 4, as mentioned above. Then, if the regulating means charges the toner of opposite polarity and redeposited on the drum 1 to the original polarity, it is possible to collect the entire redeposited toner in the unit 4 without resorting to voltage switching. That is, only if the voltage of −600 V is continuously applied from the power source E1 to the roller 5, the entire toner can be electrostatically transferred from the drum 1 to the roller 5 due to the difference of 200 V between the drum 1 and the roller 5. Of course, the same voltage should only be applied to the roller 5 at the time of development. This practically eliminates the need for the switching of voltages to the roller 5 and thereby simplifies the apparatus while reducing its cost.

While the embodiment has also concentrated on negative-to-positive development, it is also practicable with positive-to-positive development. The cleaning roller 12 may be replaced with an endless belt, if desired. Likewise, the photoconductive drum 1 may be replaced with a photoconductive belt. In addition, the apparatus may be so modified as to transfer the toner image from the drum 1 to a paper by way of an intermediate image transfer body.

As stated above, in the above embodiment, even when the toner of positive polarity and that of negative polarity exist on the cleaning member 12 together, both of them can be efficiently redeposited on the image carrier 1 before the next toner collection. The toner is therefore prevented from depositing on the charge regulating means and lowering the quality of toner images. In addition, the background of toner images are free from contamination. When the toner of original polarity and that of opposite polarity are collected by the developing unit 4 one after the other, the polarity of a voltage applied to the developer carrier 5 is switched over. Therefore, the entire toner can be surely collected by the developing unit 4.

4th Embodiment

This embodiment is a solution to the previously discussed problem (4). The embodiment to be described is substantially identical with the third embodiment as to the construction, image formation, toner collection by the cleaning roller, toner redeposition on the drum, and toner collection by the developing roller. The following description will concentrate on the difference between the two embodiments.

Figure 18:
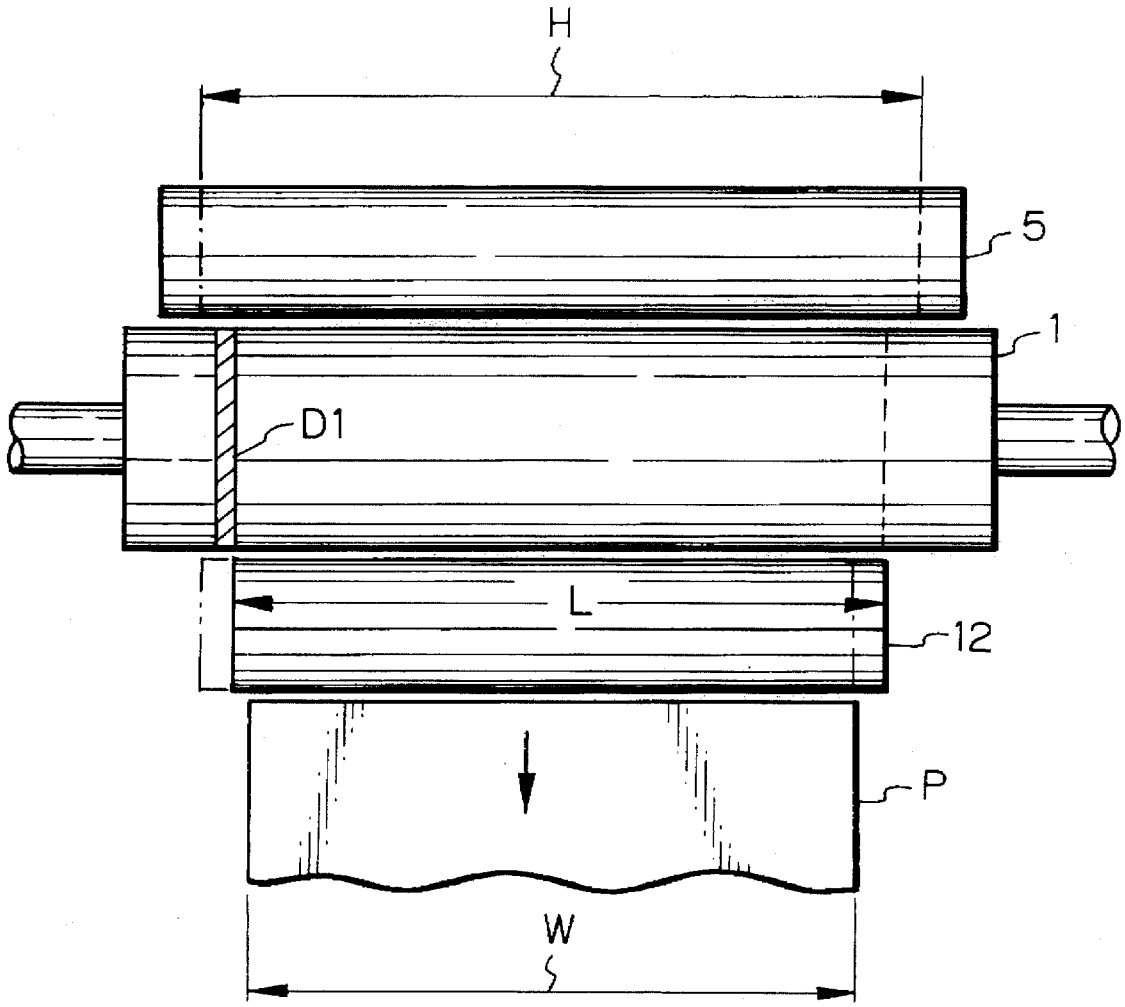
FIG. 18 shows a relation between an effective developing width and a cleaning roller and a positional relation between them, the photoconductive element and a paper particular to a fourth embodiment of the present invention.

FIG. 18 shows an arrangement unique to this embodiment, i.e., a positional relation between the drum 1, developing roller 5, cleaning roller 12, and paper P. The paper P is conveyed in a direction indicated by an arrow in FIG. 18 with its center in the direction perpendicular to the above direction, i.e., in the widthwise direction aligning with the center of the drum 1 in its axial direction. The cleaning roller 12 has an axial length L which is, of course, greater than the width W of the paper P of maximum size, because the roller 12 is used to collect the toner remaining on the drum 1.

The developing roller 5 conveys the developer to the developing position 6 in order to develop a latent image formed on the drum 1, as shown in FIG. 15. The range, labeled H, in which the roller 5 effects development is referred to as an effective developing width, as mentioned earlier. If the developing unit 4 is of the type forming a magnet brush on the roller 5, then the effective developing width H is the axial length of the roller 5 over which the magnet brush is formed. The toner redeposited on the drum 1 by the cleaning roller 12 is collected by the developing unit 4 within the above width H.

As shown in FIG. 18, the width H is selected to be greater than the length L of the cleaning roller 12. Specifically, the length L and width H are selected such that the length L is smaller than the width H while the overall length of the roller 12 is confined in the width H for the following reasons.

Figure 19:
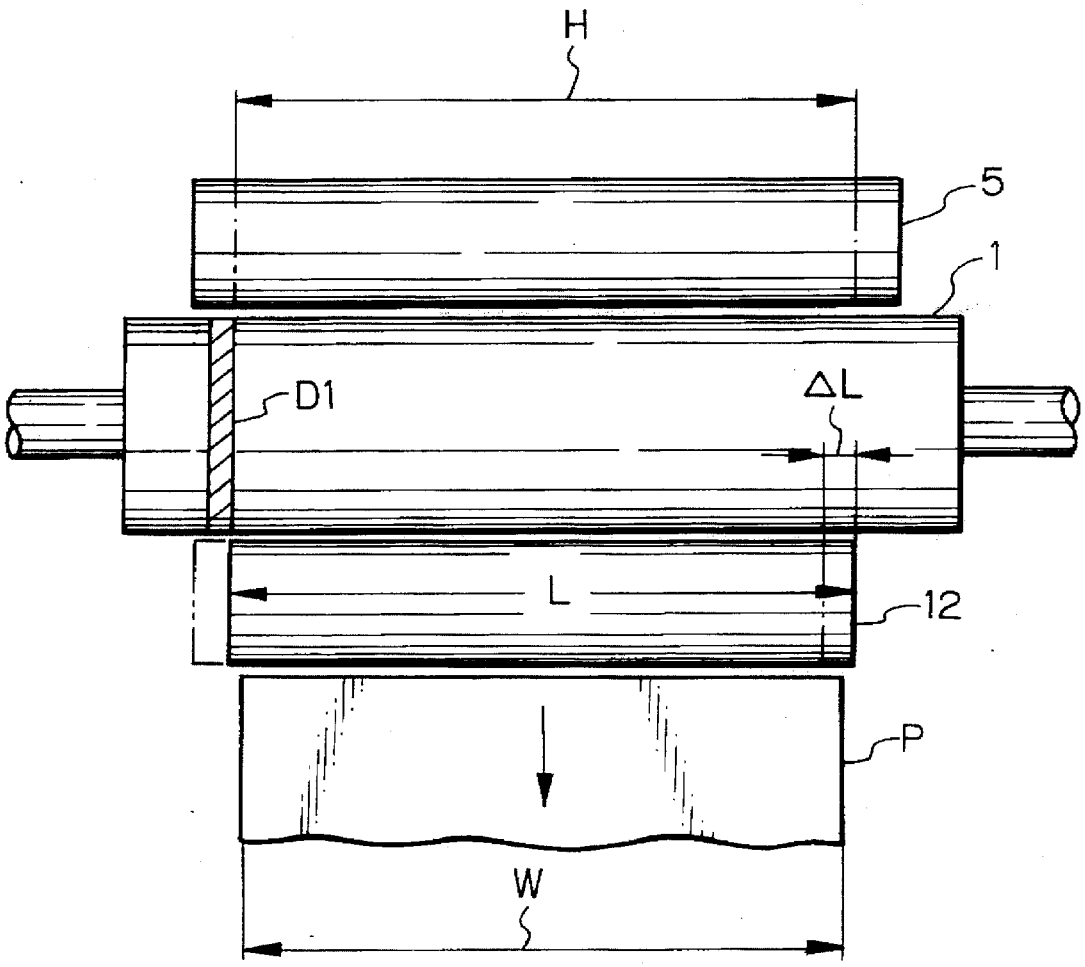
Fig. 19 PRIOR ART
FIG. 19 a view is similar to FIG. 18, showing such relations particular to a conventional image forming apparatus.

The drum 1, developing roller 5, cleaning roller 12 and other rotary members each oscillates, if a little, in its axial direction during operation. The oscillation or play amounts even up to about 1 mm. As shown in FIG. 19, assume that the effective developing width H is equal to or smaller than the length L of the cleaning roller 12. Also, as shown in FIG. 19 in an exaggerated view, assume that the roller 12 rotates while axially oscillating between a solid line position and a phantom line position with a play ΔL. Then, the toner transferred from the roller 12 to the drum 1 is redeposited even on a portion D1 of the drum 1, as indicated by hatching. However, because the width H is equal to or smaller than the length L of the roller 12, the toner deposited on the portion D1 misses the width H when brought to the developing device 4. As a result, such toner is simply left on the drum 1.

The toner on the portion D1 of the drum 1 and not collected by the developing roller 5 contaminates the background of an image. This is also true when the drum 1 or the roller 5 oscillates in its axial direction or when the paper P skews in the axial direction of the drum 1 or when they are combined.

In the illustrative embodiment, the effective developing width is selected to be greater than the length L of the roller 12. Therefore, even when the roller 12 oscillates in the axial direction, the toner deposited on the portion D1 of the drum 1 can be surely connected by the roller 5 because the width H covers the portion D1. This is also true when the roller 12 oscillates to the right in the axial direction, as seen in FIG. 18.

Figure 20:
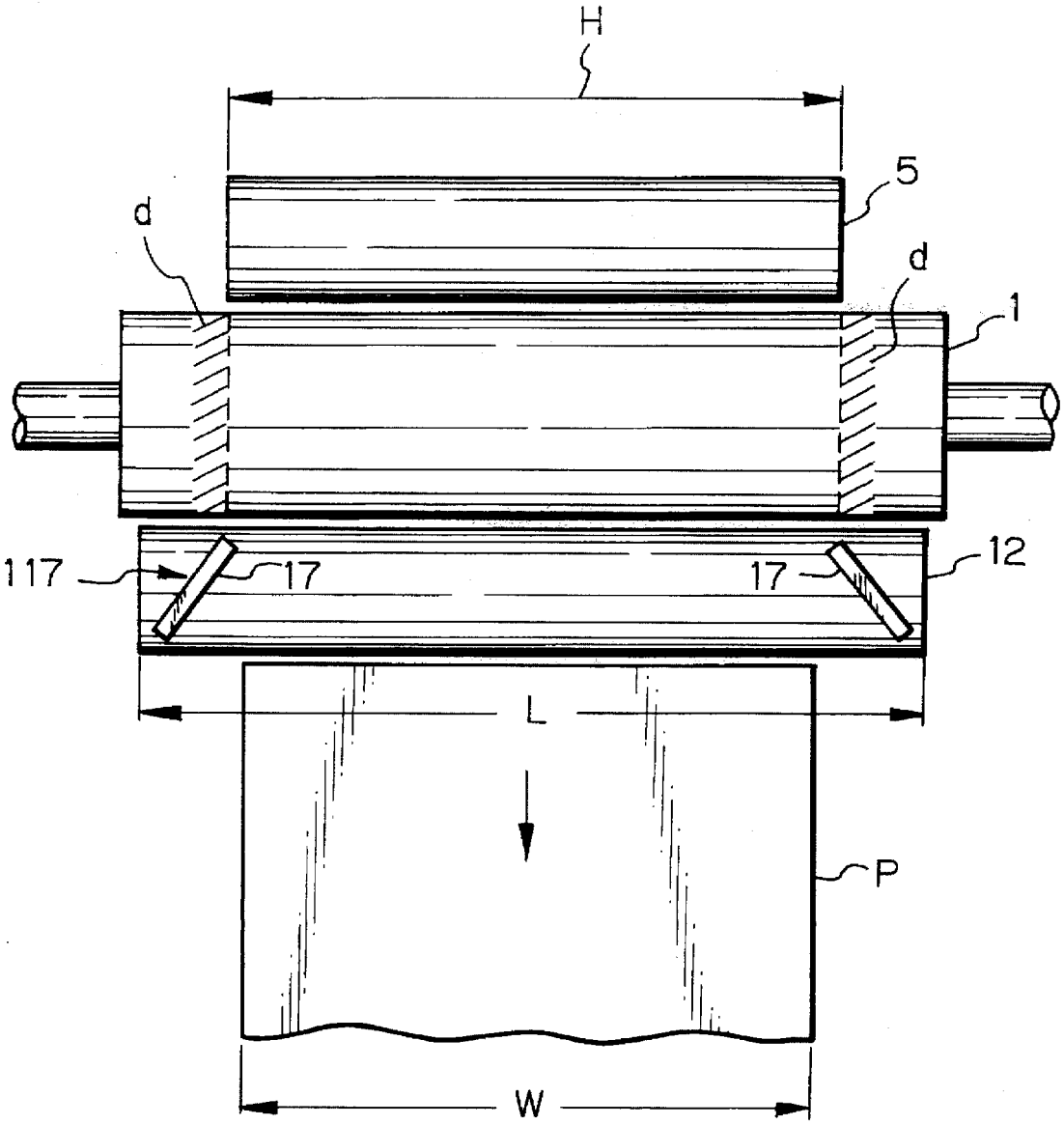
FIG. 20 is a view associated with FIG. 18.

On the other hand, to allow the cleaning roller 12 to collect the toner from the drum 1 efficiently, i.e., to enhance the cleaning of the drum 1, it is preferable that the length L of the roller 12 be greater than the effective developing width H. FIG. 20 also shows a positional relation between the developing roller 5, its effective developing width H, drum 1, cleaning roller 12, and paper P. Again, the paper P is conveyed in a direction indicated by an arrow in FIG. 20 with its center in the direction perpendicular to the above direction, i.e., in the widthwise direction aligning with the center of the drum 1 in its axial direction. The cleaning roller 12 has the length L greater than the width W of the paper P of maximum size. What is unique to the relation shown in FIG. 20 is that the length L of the roller 12 is greater than the effective developing width H of the developing roller 5, i.e., the width H is confined in the length L.

In the arrangement of FIG. 20, even when the toner flies about and deposits on the end portions d of the drum 1 outside of the width H, it can be surely collected by the cleaning roller 12. As a result, the drum 1 can be efficiently cleaned over its entire axial length.

However, if the above scheme is used alone, the toner deposited on the end portions d of the drum 1 and then collected by the cleaning roller 12 again deposits on the portions d. Because the end portions d are positioned outside of the effective developing width H, it cannot be collected by the developing unit 4. The toner so left on the drum 1 brings about the previously stated problem.

In this embodiment, not only the length of the cleaning roller 12 is greater than the effective developing width H, but also shifting means 117 for shifting the toner collected by the roller 12 is provided. Briefly, when the toner collected by the roller 12 is to be redeposited on the drum 1, the shifting means 117 shifts the toner into a range smaller than the width H inclusive.

Figure 21:
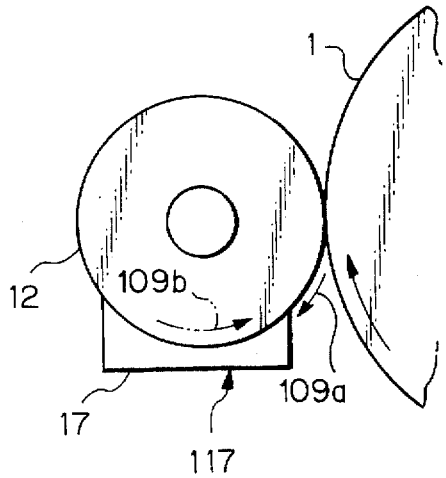
FIG. 21 is a fragmentary front view of the arrangement shown in FIG. 20.

Specifically, as shown in FIG. 20, the shifting means 117 is implemented as a pair of shift members 17 for shifting the toner on the developing roller 12 into a range that is smaller than the width H, inclusive, while the roller 12 is in rotation. The shift members 17 are mounted on a cleaning casing 112 (FIG. 15) on which the roller 12 is rotatably supported. The shift members 17 are held in contact with axially opposite end portions of the circumference of the roller 12. As shown in FIG. 21, the shift members 17 are positioned below the roller 12.

When the roller 12 is rotated in a direction indicated by an arrow 109*a* in FIG. 21, the toner is transferred from the drum 1 to the roller 12 and then conveyed thereby in the direction 109*a*. At this instant, the shift members 17 sequentially shift the toner into the range smaller than the effective developing width H inclusive.

Figure 22:
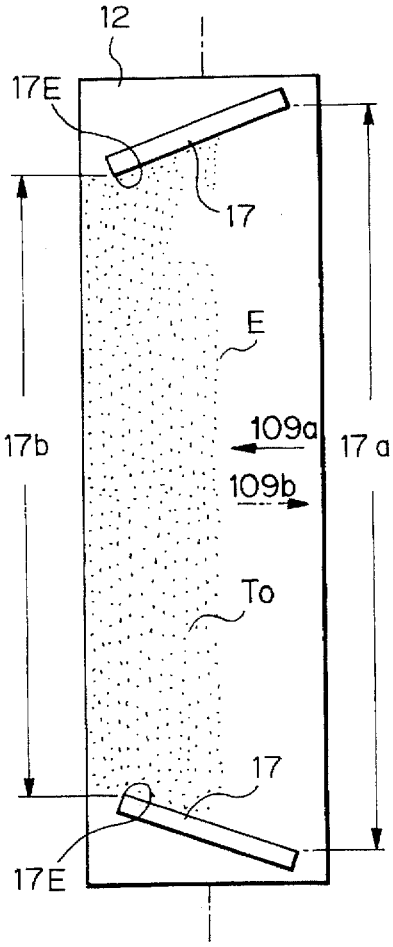
FIG. 22 shows how a pair of shift members included in the fourth embodiment shift a toner layer collected by the cleaning roller.

FIG. 22 is a bottom view of the roller 12 and shift members 17 contacting it. As shown, the toner layer, labeled $T_o$, deposited on the roller 12 moves in the direction 109*a* together with the roller 12 while being sequentially shifted toward the center of the roller 12 in the axial direction of the roller 12 by the shift members 17. Finally, the toner layer $T_o$ is confined in the range smaller than the effective developing width H inclusive. Specifically, the shift members 17 face each other at a distance 17*a* at the upstream side with respect to the direction of rotation of the roller 12 for collecting the toner from the drum 1, and at a distance 17*b* at the downstream side with respect to the same direction. The distance sequentially decreases form the distance 17*a* to the distance 17*b*. The roller 12 is continuously rotated in the direction 109*a* until the trailing edge 110 of the toner layer $T_o$ moves away from the ends of the shift members 17 spaced the distance 17*b*. This successfully shifts the entire toner layer $T_o$ toward the center of the roller 12. Such a collecting operation ends before the roller 12 completes one rotation, as stated earlier.

Subsequently, the roller 12 is rotated in a direction indicated by an arrow 109*b* in FIG. 22 in order to redeposit the toner on the drum 1. Because the redeposited toner extends over a width equal to or smaller than the effective developing width H, it can be surely collected by the developing roller 5 (FIG. 20).

As stated above, the shift members 17 insure the collection of the toner by the developing unit (FIG. 15) and thereby frees the background of an image from contamination. In addition, because the length L of the roller 12 is greater than the effective developing width H, the surface of the drum 1 can be efficiently cleaned over its axial range.

The shift members 17 shown in FIGS. 20–21 may be held in contact with the surface of the drum 1 in order to confine the toner redeposited on the drum 1 in the range smaller than the width H inclusive. However, the shift members 17 would accelerate the wear of the drum 1 and would thereby lower the image quality.

In the apparatus shown in FIG. 15, the roller 12 is rotated in the direction 109*a* shown in FIG. 22 in the event of toner collection, but in the direction 109*b* in the event of toner redeposition, as stated earlier. This is done by drive means, not shown. When such a configuration of the roller 12 is combined with the shift members 17 shown in FIGS. 20–22, the following problems is given rise to. Assume that the roller 12 is rotated in the direction 109*b* for toner redeposition while oscillating in its axial direction. Then, it is likely that the toner collected by the roller 12 hits against the ends 17E of the shift members 17 and drops, contaminating the interior of the apparatus.

Figure 23:
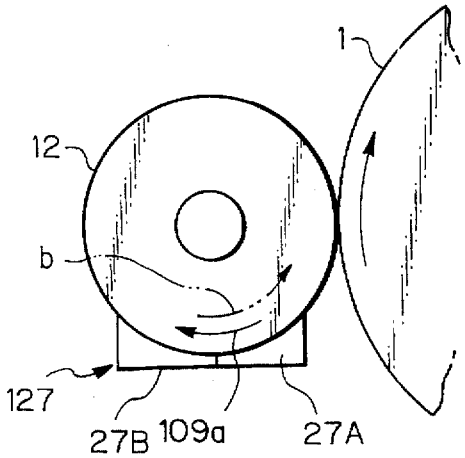
FIG. 23 is a fragmentary view of the fourth embodiment.
Figure 24:
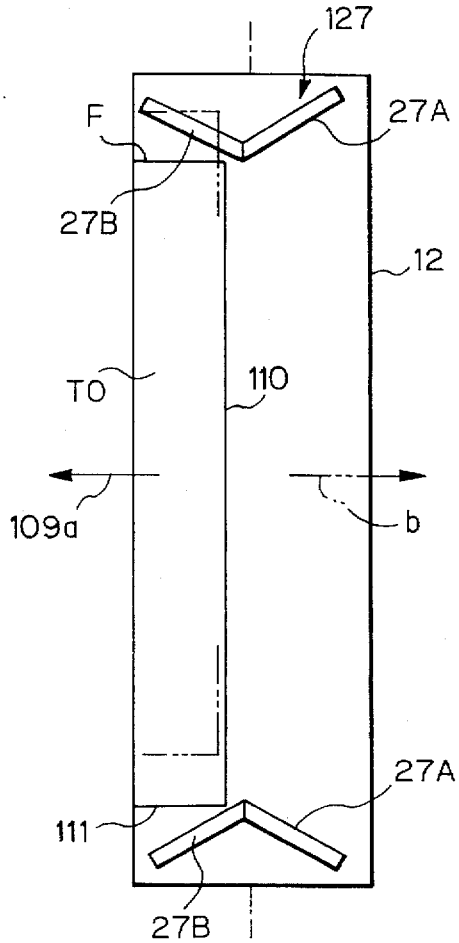
FIG. 24 is a fragmentary view of the fourth embodiment, demonstrating the transition from toner collection to toner redeposition.

FIGS. 23 and 24 show a modification of the above embodiment and capable of solving the above problem. As shown, shifting means 127 is made up of a pair of first shift members 27A and a pair of second shift members 27B. When the roller 12 is rotated for collecting the toner from the drum 1, the first shift members 27A shift the toner into the range smaller than the effective developing width H inclusive. When the roller 12 is rotated for redepositing the toner on the drum 1, the second shift members 27B also shift the toner into the above range. FIG. 24 is a bottom view of the roller 12 and shifting means 127.

The first shift members 27A are identical in configuration with the shift members 17 shown in FIGS. 20–22. The second shift members 27B are sequentially flared away from each other in the opposite relation to the first shift members 27A. The shift members 27A and 27B are mounted on the cleaning case 112 (FIG. 15) and held in contact with the axially opposite end portions of the roller 12. Each shift member 27A and the shift member 27B adjoining it may be implemented as a single member or may be spaced from each other in the circumferential direction of the roller 12.

FIG. 24 shows the roller 12 in a condition wherein it has completed the collection of the toner from the drum 1, i.e., the rotation in the direction 109*a*. As shown, the toner layer $T_o$ collected by the roller 12 exists in the area delimited by lines 110 and 111; E shows the trailing edge of the area. It will be seen that even in the configuration shown in FIGS. 23 and 24, the roller 12 completes toner collection after the trailing edge E of the toner layer $T_o$ has moved away from the smallest distance between the shift members 27A.

Assume that after the roller 12 has started rotating in the direction 109*b* for redeposition, the area where the toner layer To is present is shifted due to the axial play of the roller 12 to a position indicated by a phantom line in FIG. 24 in an exaggerated view. Then, the second shift members 27B shift the toner toward the center of the roller 12. This allows the toner to be redeposited on the drum 1 over the range smaller than the effective developing width H inclusive. At the same time, the shift members 27B prevent the toner from dropping when the roller 12 is rotated in the reverse direction for redeposition.

The shift members 17 or the shift members 27A and 27B constituting the shifting means are simple in configuration and low cost.

While the embodiment has also concentrated on negative-to-positive development, it is also practicable with positive-to-positive development. The cleaning roller 12 may be replaced with an endless belt, if desired. Likewise, the photoconductive drum 1 may be replaced with a photoconductive belt. In addition, the apparatus may be so modified as to transfer the toner image from the drum 1 to a paper by way of an intermediate image transfer body.

As stated above, in the above embodiment, when the toner collected by the cleaning member 12 is to be redeposited on the image carrier 1, it can be confined in the range smaller than the effective developing width inclusive. The developing unit 4 can therefore collect the entire toner from the drum 1, thereby freeing the background of an image from contamination. Even when the member 12 oscillates in the axial direction during rotation for toner redeposition, the toner is prevented from dropping from the shift members.

5th Embodiment

This embodiment addressing the previously stated problem (5) will be described with reference to FIG. 25. As shown, as soon as the drum 1 starts rotating, the discharge lamp 13 is turned on to discharge the surface of the drum 1. The charge roller 2 is movable into and out of contact with the drum 1. The charge roller 2 is driven by the drum 1 when brought into contact with the drum 1. A bias voltage source $E_{10}$ applies a bias voltage to the charge roller 2 and causes it to charge the surface of the drum 1 uniformly to, e.g., about −850 V.

The modulated laser beam 11 scans the charged surface of the drum 1 at the exposing position 3. As a result, a latent image is electrostatically formed on the drum 1. Specifically, the portion of the drum 1 scanned by the laser beam 11 has its potential varied to, e.g., about −150 V. Optics for emitting the laser beam 11 and the charge roller 2 constitute a specific form of latent image forming means.

The developing unit 4 faces the drum 1 and includes the casing 99 storing the two-ingredient type developer D. The paddles 10A and 10B are rotated to charge the toner of the developer D to preselected polarity, i.e., negative polarity in the embodiment. The charged toner D is deposited on the developing roller 5. The roller 5 is rotated such that it moves in the same direction as the drum 1, as seen as the nip. The voltage source $E_1$ applies a bias voltage of the same polarity as the original charge of the toner, e.g., about −600 V to the roller 5.

While the roller 5 conveys the developer toward the developing position 6, a doctor blade 16 regulates the thickness of the toner. The developer regulated by the blade 16 forms a magnet brush on the roller 5. At the developing position 6, the toner of the developer is electrostatically transferred from the roller 5 to the latent image formed on the drum 1, thereby transforming it to a corresponding toner image.

The paper P is fed from a registration roller pair 20 to the image transfer position 8 where the drum and transfer roller 7 contact each other. The voltage source $E_3$ applies a bias voltage opposite in polarity to the original charge of the toner, e.g., about +500 V to the transfer roller 7. As a result, the toner image is transferred from the drum 1 to the paper P passing through the position 8. A separation charger, not shown, separates the paper P from the drum 1, and then the paper P is driven out of the apparatus via the fixing unit, not shown.

If desired, the paper P may be replaced with an intermediate transfer body. In such a case, the toner image transferred to the intermediate body will be transferred to a recording medium.

A cleaning unit 24 faces the developing unit 4 with the intermediary of the drum 1 and includes a rotatable cleaning roller 25. While the cleaning roller is implemented as a sponge roller in the embodiment, it may be replaced with an endless belt, if desired. The cleaning unit 24 removes the toner remaining on the drum 1 after the image transfer.

Figure 26:
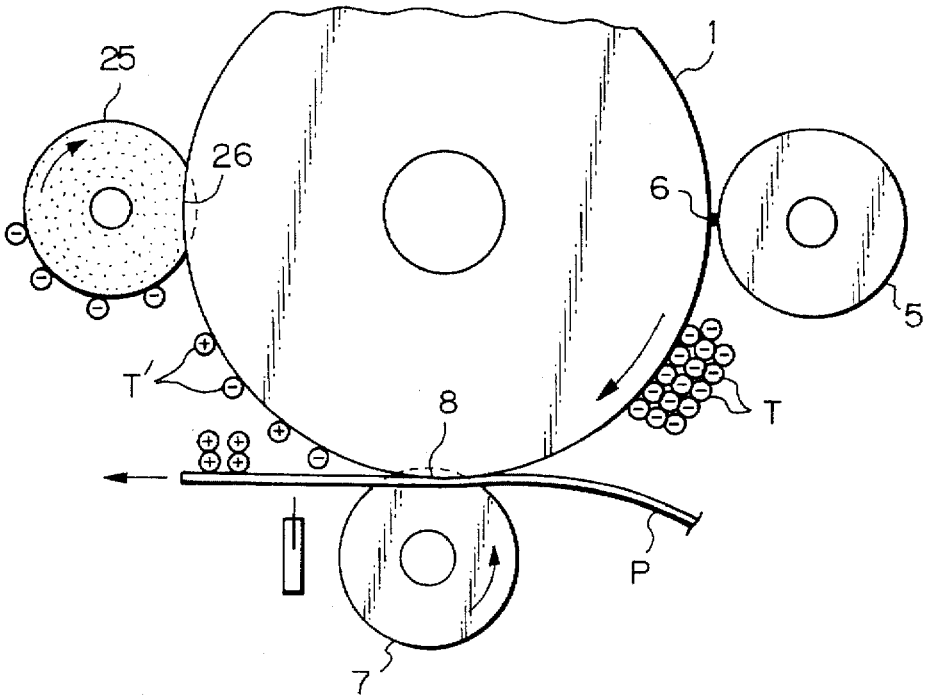
FIG. 26 is a view for describing an image transfer process and a cleaning process particular to the fifth embodiment.
Figure 27:
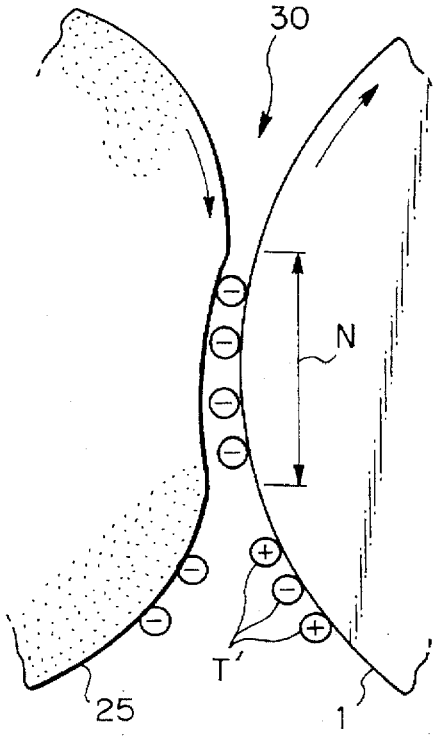
FIG. 27 is an enlarged sketch demonstrating how toner is charged between the cleaning roller and the photoconductive element by friction.

As shown in FIG. 26, the toner T moving away from the developing position 6 toward the image transfer position 8 is substantially entirely of negative polarity. On the other hand, the toner T' left on the drum 1 after the image transfer is partly of positive polarity due to the positive bias applied to the transfer roller 7. Specifically, about 80% of the toner T' is of positive polarity while the rest is of negative polarity. In any case, the toner T' consisting of particles of positive polarity and particles of negative polarity reaches a cleaning position 26. The cleaning roller 25 bites into the drum 1 to a predetermined depth and forms the previously stated nip N, as shown in FIG. 27. The nip N defines the cleaning position 26.

As shown in FIG. 26, the cleaning roller 25 is rotated clockwise, i.e., counter to the direction in which the drum 1 rotates, rubbing itself against the drum 1. As shown in FIG. 27, at the nip N, the toner T' containing positive particles and negative particles is entirely charged to its original or negative polarity in contact with the roller 25. For this purpose, the roller 25 is formed of a material capable of charging the toner to negative polarity.

Figure 25:
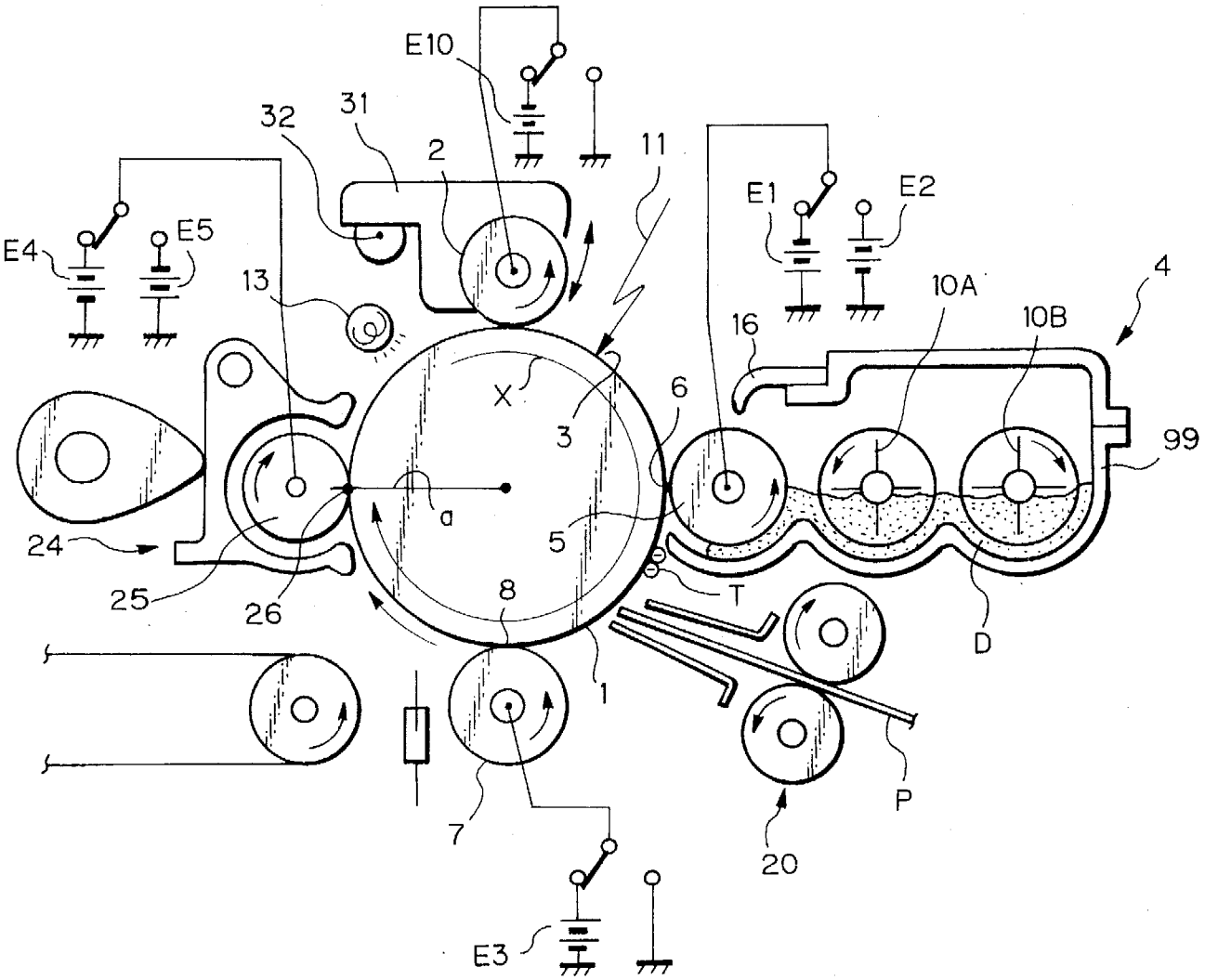
FIG. 25 is a view showing a fifth embodiment of the present invention.

As shown in FIG. 25, the voltage source $E_4$ applies a bias voltage opposite in polarity to the charge deposited on the toner by the roller 25, e.g., about +300 V. At the nip N, the charged toner is electrostatically transferred to the roller 25. The roller 25 is conductive enough to be applied with such a voltage. The surface potential of the drum 1 moving from the image transfer position 8 toward the cleaning position 26 is about +20 V.

Figure 28:
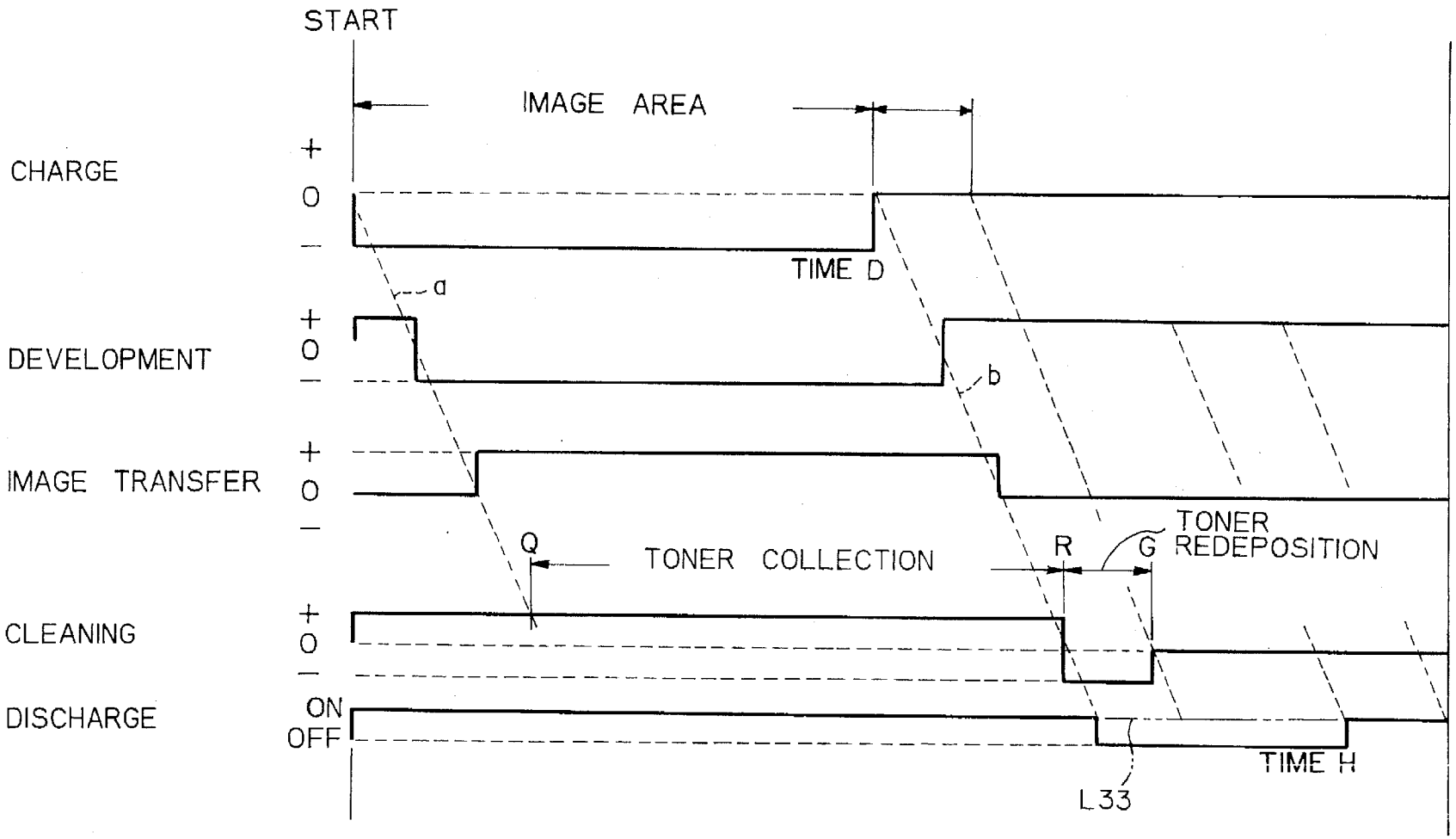
FIG. 28 is a timing chart showing a specific operation of the fifth embodiment.
Figure 29:
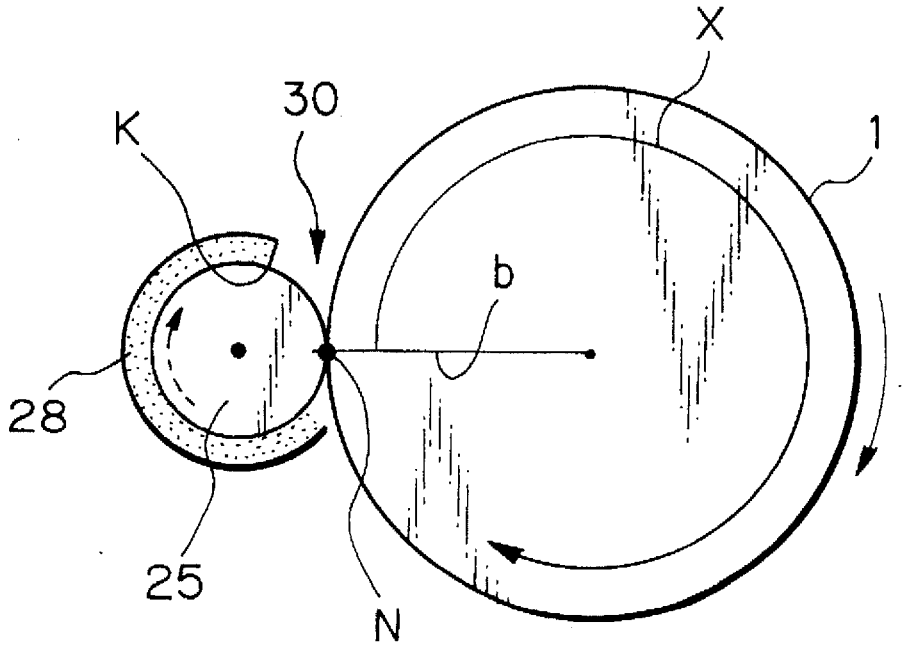
FIG. 29 shows a condition wherein the cleaning roller has ended collecting the toner from the photoconductive element.

As shown in FIG. 25, an image is formed on the drum 1 over an area X. As shown in FIGS. 25 and 28, the image area X has a leading edge a. As shown in FIGS. 28 and 29, the image area X has a trailing edge b. As shown in FIG. 25, when the leading edge a moved away from the image transfer position 8 arrives at the cleaning position 26, the roller 25 starts collecting the toner from the drum 1, i.e., the cleaning unit 24 performs its toner removing function. As shown in FIG. 29, when the trailing edge b arrives at the cleaning position 26, the cleaning unit 24 completes its function. In FIG. 29, the toner collected by the roller 25 from the image area X is labeled 28. In FIG. 28, the roller 25 starts collecting the toner at a time Q and ends collecting it at a time R. FIG. 29 shows a condition corresponding to the time R.

When the charge roller 2 fully charges the image area X of the drum 1 (time D, FIG. 28), the bias voltage to the roller 2 is interrupted while the roller 2 is released from the drum 1. Specifically, the roller 2 is rotatably supported by an arm 31 which is rotatable about a fulcrum 32. After the roller 2 has been released from the drum 1, the surface potential of the drum 1 becomes substantially zero volt.

As shown in FIG. 28, when the developing roller 5 develops the image area X up to its trailing edge b, the voltage to the roller 5 is switched from, e.g., about −600 V to about +150 V. That is, in FIG. 25, the bias voltage source $E_2$ is connected to the roller 5 in place of the bias voltage source $E_1$. When the trailing edge b of the developed image is transferred to the paper P, the bias voltage to the transfer roller 7 is interrupted.

After the cleaning unit 24 has collected the toner from the drum 1 with the roller 25, it redeposits the toner on the drum 1, as follows. The roller 25 having been connected to the bias voltage source $E_4$ is connected to the voltage source $E_5$ at the time F shown in FIG. 28. As a result, a bias voltage of, e.g., about +300 V having been applied to the roller 25 is replaced with a bias voltage of, e.g., about −500 V opposite in polarity to the charge of the toner 28 collected by the roller 25. As a result, the toner 28 on the roller 25 is electrostatically transferred to and redeposited on the drum 1 due to the difference in potential between the roller 25 and the drum 1. At this instant, the roller 25 in rotation charges the drum 1 to about −50 V. The toner is redeposited on the non-image area of the drum 1 which does not effect the next latent image to be formed. In FIG. 28, the redeposition of the toner on the drum 1 occurs from the time F to a time G. The bias voltage to the roller 25 is zero volt from the time G until the next image formation. To redeposit all the toner collected by the roller 25 on the drum 1, the roller 25 performs, e.g., one or more rotations.

As the drum 1 is continuously rotated clockwise, as viewed in FIG. 25, the toner redeposited on the non-image area of the drum 1 is conveyed to the developing unit 4. At this instant, the toner does not deposit on the charge roller 2 because the roller 2 has already been released from the drum 1.

While the toner is conveyed to the developing position 6 (FIG. 25) by the drum 1, the bias voltage of, e.g., +150 V is applied to the developing roller 5 from the voltage source $E_2$. As a result, the toner of negative polarity is electrostatically transferred from the drum 1 to the magnet brush formed on the roller 5 and reused by the developing unit 4.

By the above procedure, the toner collected by the cleaning unit 24 is returned to the developing unit 4 without resorting to any exclusive passageway. The apparatus can therefore reuse the toner while having its cost reduced. Because the toner returned to the developing unit 4 is of the same polarity (negative) as the toner existing in the unit 4, the period of time necessary for the collected toner to be charged to a preselected level by friction is reduced. This allows the unit 4 to reuse the toner of preselected charge immediately.

The discharge lamp 13 is continuously turned on until the trailing edge b of the image area moves away from it. Then, as shown in FIG. 28, the lamp 13 is turned off and continuously turned off until the entire non-image area moves away from it. Alternatively, as indicated by a dash-and-dots line L33 in FIG. 28, the lamp 13 may be continuously turned on even for the non-image area in order to discharge it. In such a case, the surface potential of the drum 1 moved away from the lamp 13 becomes substantially zero volt and reduces the adhesion of the redeposited toner to the drum 1.

After the toner has been fully collected by the developing roller 5 from the non-image area of the drum 1, the non-image area arrives at the discharge lamp 13. Then, the lamp 13 is turned on at a time H shown in FIG. 28. As a result, the portion of the drum 1 having the surface potential of −50 V is discharged by the lamp 13. Subsequently, the various bias voltages and the rotation of the drum 1 are interrupted. This is the end of an image forming process corresponding to a single recording.

Figure 30:
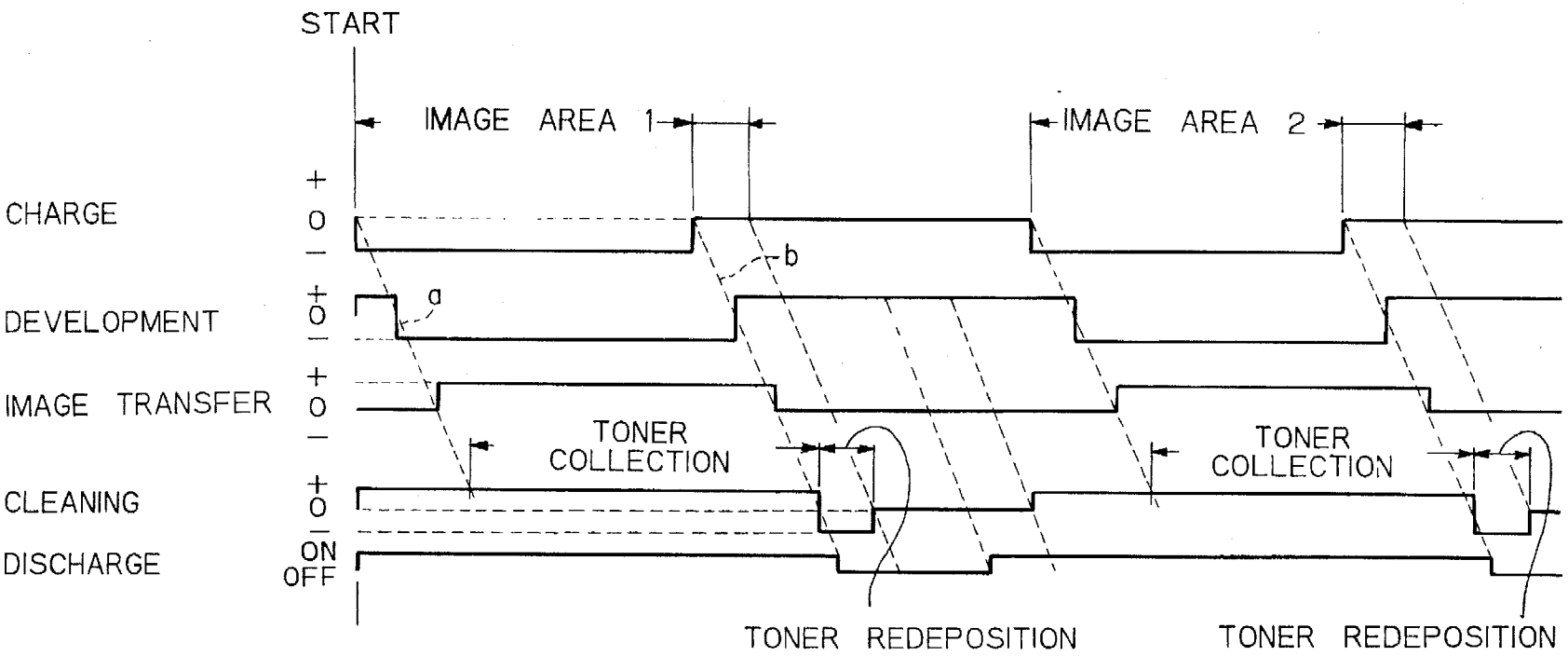
FIG. 30 is a timing chart showing another specific operation of the fifth embodiment.

FIG. 30 demonstrates a mode in which the above image forming process is repeated.

The toner T' shown in FIG. 27 and containing particles of positive polarity and particles of negative polarity are charged by the cleaning roller 25 to negative polarity, as stated earlier. However, although the total polarity of the toner T' may be regulated to negative polarity, it is difficult to charge all the particles to negative polarity. The particles of positive polarity and the particles of short charge close to zero volt will be collectively referred to as defective toner or defective toner particles hereinafter.

Figure 31:
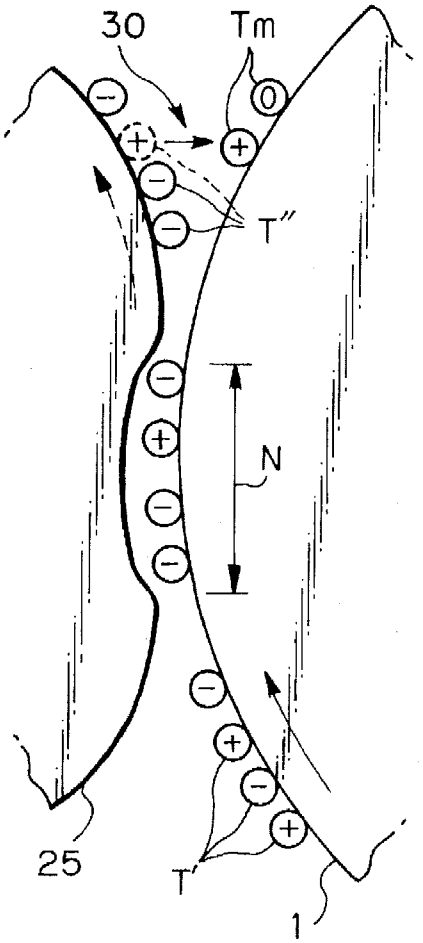

Even when the cleaning roller 25 is moved in the same direction at the drum 1, as seen at the nip, it can charge the toner to negative polarity by friction in cooperation with the drum 1 if a difference in speed exists between the roller 25 and the drum 1. Specifically, as shown in FIG. 31, it is possible charge the toner by friction at the nip N by rotating the roller 25 in a direction indicated by a phantom arrow. However, the collected toner, labeled T", exists on the roller 25 at a gap 30 downstream of the nip N in the direction of rotation of the drum 1. The toner T" includes the defective particles. The bias voltage of, e.g., about +300 V applied to the roller 25 at the beginning of toner collection is apt to return the defective particle (phantom line) from the roller 25 to the drum 1. In any case, the defective toner, labeled Tm, of positive polarity or of nearly zero volt is transferred to the image area of the drum 1 at the gap 30. This results in defective cleaning.

Figure 32:
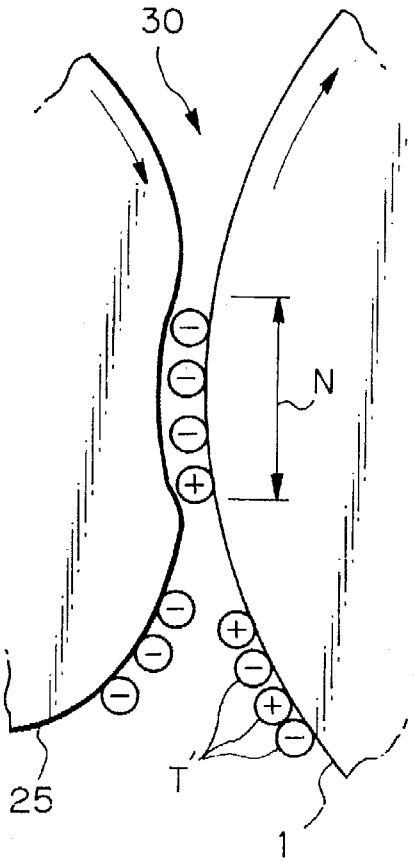
FIGS. 31 and 32 are fragmentary enlarged views of the cleaning roller and photoconductive element, each showing how defective toner particles are transferred to the photoconductive element at the end of toner collection.

As shown in FIG. 32, when the roller 25 is moved in the opposite direction to the drum 1, as seen at the nip N, at the time of toner collection, it can collect the toner while charging it at the nip N. However, assuming that the roller 25 collects the toner by one or more rotations, the defective toner on the roller 25 is also transferred to the drum 1 at the gap 30 and deposits on the image area. In this case, the defective toner deposits on the charge roller 2 and contaminates it. Further, the toner deposited on the roller 2 is again returned to the drum 1 and contaminates the background of an image. In addition, when the defective toner deposits on the magnet brush, it also contaminates the background of an image and brings about irregular image transfer.

In light of the above, in the illustrative embodiment, rotation control means controls the rotation of the cleaning roller 25, as follows. In the event of toner collection, the surface of the roller 25 facing the drum 1 is moved in the opposite direction to the surface of the drum 1. Subsequently, the roller 25 is caused to perform less than one rotation such that the leading portion of the roller 25 in the direction of rotation of the roller 25 reaches a position where the toner located at the leading portion cannot be transferred to the drum 1.

Specifically, FIG. 29 shows a condition wherein the roller 25 has fully collected the toner 28 from the image area X of the drum 1. For the collection, the roller 25 is rotated such that it moves in the opposite direction to the drum 1, as seen at the nip N. Then, before the point K of the roller 25 where the collection has begun reaches the nip N, the roller 25 is caused to end the collection. Subsequently, the roller 25 is moved in, e.g., the same direction as the drum 1, as seen at the nip N, in order to redeposit the toner on the drum 1.

Consequently, at the end of toner collection, the toner 28 collected by the roller 25 is prevented from existing at the gap 30 defined between the drum 1 and the roller 25 and at the downstream side with respect to the direction of rotation of the drum 1. In this manner, the previously stated defective cleaning can be obviated if the roller 25 has its diameter and rotation speed determined in relation to the size of the image area in the circumferential direction of the drum 1 such that the roller 25 can collect the toner from the image area with its surface portion short of its entire circumference.

On the other hand, assume that the roller 25 is rotated at the above speed even at the time of redeposition of the toner on the drum 1. Then, because the rotation speed is low, a disproportionate period of time is necessary for the toner on the roller 25 to be redeposited on the drum 1. This increases the interval between the consecutive image areas of the drum 1 (interval between papers) and thereby obstructs the application of the apparatus to high-speed recording. For example, assume that the surface of the drum 1 moves at a linear velocity of 180 mm/sec and includes an image area of 420 mm in the circumferential direction of the drum 1 and corresponding to format A3, and that the roller 25 has a circumferential length of 60 mm. Then, if the roller 25 collects the toner from the image area of the drum 1 by one rotation, a period of time of 420 (mm)/180 (mm/sec)=2.3 seconds is needed. If the roller 25 redeposits the toner on the drum 1 at the above speed, then, a period of time as long as 2.3 seconds is also needed. As a result, the image area must be enlarged in the circumferential direction of the drum 1.

To solve the above problem, the rotation control means further controls the roller 25 such that the roller 25 rotates at a higher speed during toner redeposition than during toner collection. This allows the toner 28 on the roller 25 to be redeposited on the drum 1 in a short period of time and thereby reduces the size of the image area.

The direction in which the roller 25 rotates for toner redeposition is open to choice. When the roller 25 is moved in the same direction as the drum 1, as seen at the nip N, the resistance to be exerted by the drum 1 on the toner either mechanically or physically is zero or at least reduced. As a result, the redeposition efficiency of the toner on the drum 1 is enhanced. In this case, the rotation control means controls the roller 25 at the time of redeposition such that it moves in the same direction as the drum 1, as seen at the nip N. At this instant, the drive transmission to the roller 25 should preferably be interrupted to cause the roller 25 to be driven by the drum 1. This further reduces the scraping force and other mechanical forces acting between the drum 1 and the roller 25 and between them and the toner, thereby promoting the efficient return of the toner from the roller 25 to the drum 1.

If the speed and direction of rotation of the roller 25 are switched after the trailing edge b of the image has moved away from the cleaning position 26, it is possible to surely charge the toner on the drum 1 by friction, transfer the charged toner to the roller 25, and then surely redeposit it on the non-image area (interval between image areas) of the drum 1.

Figure 33:
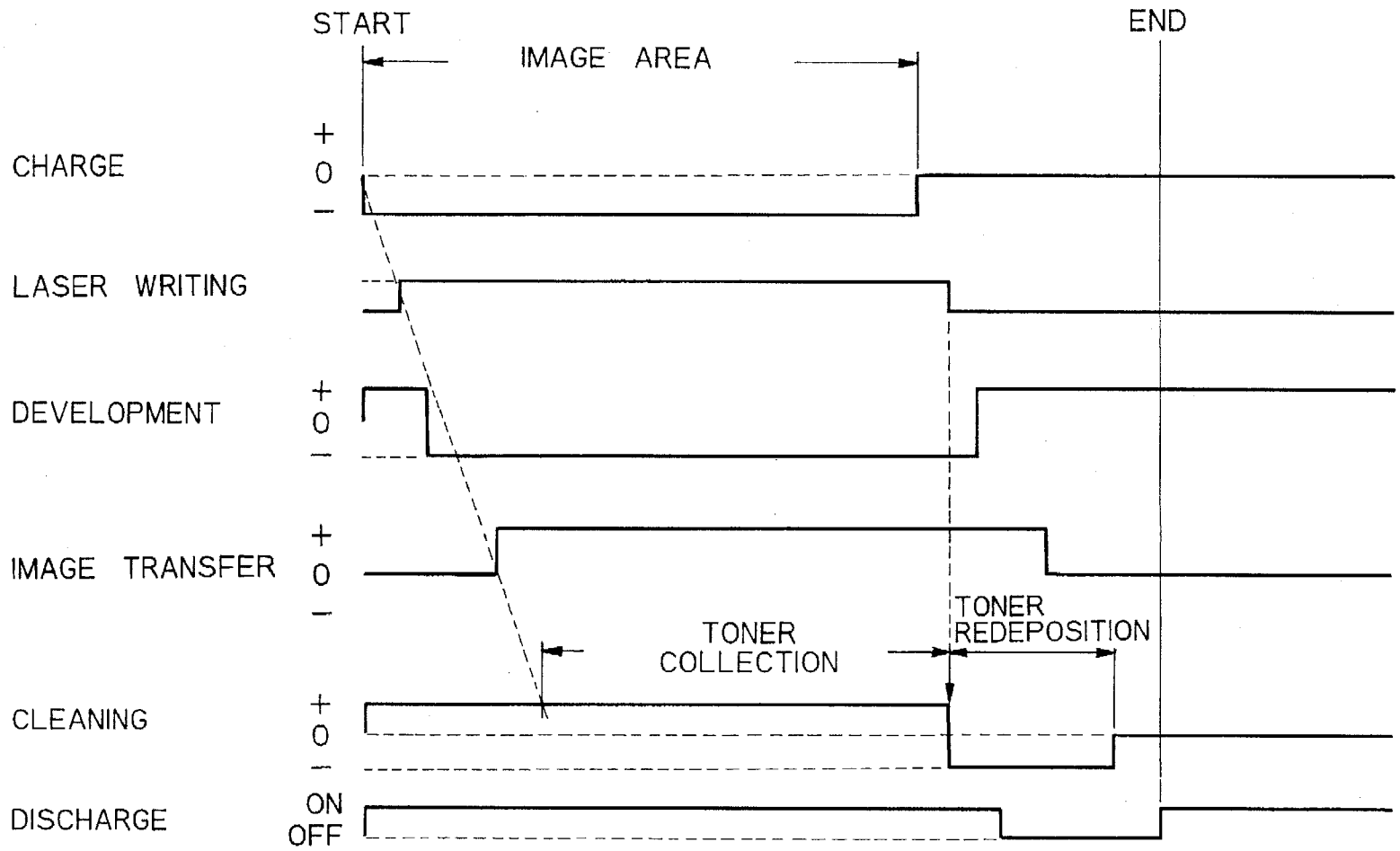
FIG. 33 is a timing chart showing a procedure in which the toner is redeposited on the photoconductive element after the trailing edge of an image has moved away from an exposing position.

When the speed and direction of rotation of the roller 25 are switched, as stated above, the drum 1 is apt to oscillate due to a shock, displacing an image formed thereon. This can be obviated if a latent image is not formed on the drum 1 at the time of switching. For example, the above factors of the roller 25 may be switched after the laser beam 11 has fully scanned the drum 1, i.e., after the trailing edge of the image area has moved away from the exposing position 3, as shown in FIG. 33 specifically. This is also done by the rotation control means.

While the embodiment has also concentrated on negative-to-positive development, it is also practicable with positive-to-positive development. The cleaning roller 25 may be replaced with an endless belt, if desired. Likewise, the photoconductive drum 1 may be replaced with a photoconductive belt.

As stated above, in the above embodiment, when the cleaning member 25 collects the toner from the image carrier 1, defective cleaning is obviated. This protects the charging means and the background of an image from contamination while eliminating irregular image transfer. Further, the period of time necessary for the toner to be redeposited on the drum 1 is reduced to further enhance high-speed recording. Moreover, although a shock may occur when the toner collecting function of the member 25 is replaced with the toner redepositing function, it does not effect image formation at all.

6th Embodiment

This embodiment is a solution to the previously discussed problem (6). The construction and operation of this embodiment will be described with reference to FIGS. 34 and 35.

Figure 34:
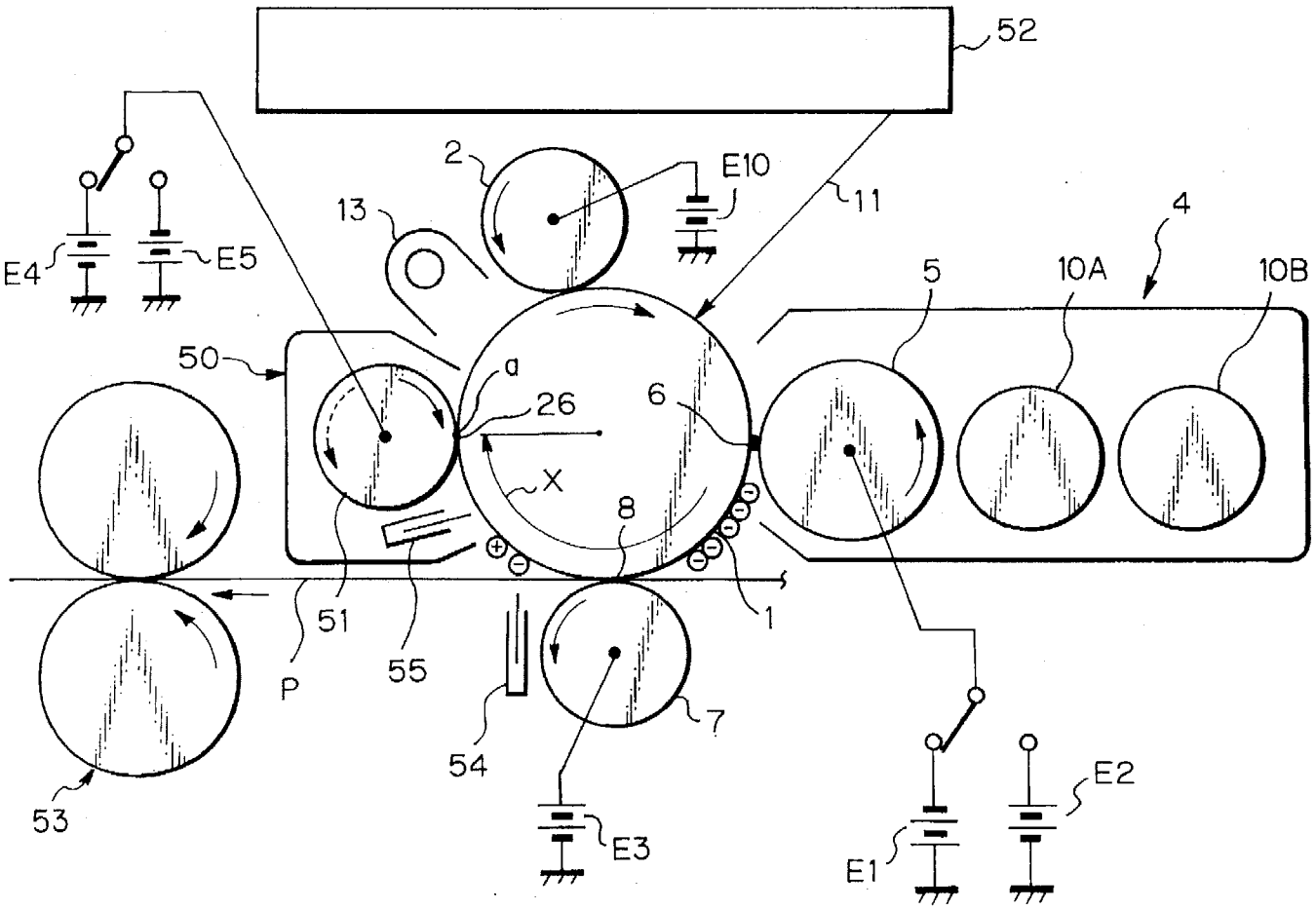
FIG. 34 is a view showing a sixth embodiment of the present invention.

On the start of an image forming operation, the drum 1 having an organic photoconductor layer is driven clockwise, as viewed in FIG. 34, by drive means, not shown. As shown in FIG. 34, the charge roller 2, laser optics 52, developing unit 4, transfer roller 7, a separation charger 54, a precleaning charger 55, a cleaning unit 50, and the discharge lamp 13 are sequentially arranged around the drum 1 in this order in the direction of rotation of the drum 1.

When the drum 1 starts rotating, the discharge lamp 13 is turned on to discharge the surface of the drum 1. The charge roller 2 is movable into and out of contact with the drum 1 and is driven by the drum 1 when brought into contact therewith. The power source $E_{10}$ applies a bias voltage to the charge roller 2. The roller 2 therefore charges the drum 1 uniformly to preselected polarity, i.e., −700 V in the embodiment over its entire image forming area which will be described.

The laser optics 52 scans the charged surface of the drum 1 with the modulated laser beam 11, thereby electrostatically forming a latent image on the drum 1. Specifically, the drum 1 has its surface potential varied to −100 V in the illuminated area or image area while substantially maintaining original −700 V in the other area or background area. The laser beam 11 scans the drum 1 in the axial direction of the drum 1 via a polygonal mirror, not shown, rotating at a high speed. The drum 1 is rotated at a speed far lower than the scanning speed of the laser beam 11, so that its entire surface can be scanned by the beam 11. The charge roller 2 and laser optics 52 constitute latent image forming means.

The developing device stores a two-ingredient type developer. The developer is deposited on the developing roller 5 and forms a magnet brush thereon. The roller 5 is rotated counterclockwise, as viewed in FIG. 34. The voltage source $E_1$ applies a bias voltage of predetermined polarity, e.g., −550 V in the embodiment to the roller 5 at the time of development. The bias voltage should advantageously be DC −550 V biased by an AC 4 kHz, 2 kV (peak-to-peak) component. The paddles 10A and 10B are rotated to agitate the developer. As a result, the toner of the developer is charged to preselected polarity, i.e., negative polarity in the embodiment by friction. Of course, the two-ingredient type developer may be replaced with magnetic or nonmagnetic toner, i.e., a single-ingredient type developer.

The developing roller 5 in rotation conveys the developer deposited thereon to the developing position 6 where the roller 5 faces the drum 1. At the position 6, the negatively charged toner is electrostatically transferred from the roller 5 to the latent image formed on the drum 1, thereby producing a corresponding toner image.

The paper P is fed from a paper feed section, not shown, to the image transfer position 8 by way of a registration roller pair, not shown, in synchronism with the leading edge of the toner image. At the position 8, the transfer roller 7 transfers the toner image from the drum 1 to the paper P. Specifically, the transfer roller 7 is rotated in the direction indicated by an arrow in FIG. 34. The voltage source $E_3$ applies a bias voltage opposite in polarity to the original charge of the toner, i.e., +950 V to the transfer roller 7. The paper P with the toner image is separated from the drum 1 by the separation charger 54 and then driven out of the apparatus via the fixing unit 53.

After the image transfer, the toner not transferred to the paper P is left on the drum 1. Generally, the image transfer ratio is about 70% to 90%. The toner left on the drum 1 is collected by the cleaning unit 50. The toner being conveyed toward the image transfer position 8 by the drum 1 has been substantially entirely charged to negative polarity. However, the positive voltage applied to the transfer roller 7 causes a charge to be injected from the roller 7 into a part of the toner left on the drum 1 after the image transfer. As a result, the toner left on the drum 1 contains particles of positive polarity. These particles of positive polarity are again charged to negative polarity by a negative corona fed from the precleaning charger or PCC 55.

The cleaning unit 50 has a casing on which a cleaning roller is rotatably mounted. To clean the drum 1, the voltage source $E_4$ applies a bias voltage opposite in polarity to the original charge of the toner, e.g., +500 V to the cleaning roller 51. At this instant, the roller 51 is rotated in contact with the drum 1 in a direction indicated by a solid arrow in FIG. 34. At the cleaning position 26, the toner remaining on the drum 1 and negatively charged by the PCC 55 is electrostatically transferred from the drum 1 to the roller 51 and collected thereby.

After the surface of the drum 1 has been cleaned by the cleaning roller 51, the discharge lamp 13 illuminates it in order to dissipate the negative charge. This is followed by the image forming process stated earlier. The area of the drum 1 where a single toner image is formed is the previously mentioned image area. While the length of the toner image in the circumferential direction of the drum 1 may be smaller than the circumferential length of the drum 1, it is a common practice to cause the drum 1 to perform one or more rotations for forming a single toner image.

FIG. 34 shows the image area X of the drum 1. The image area X has the leading edge a shown in FIGS. 34 and 35 and the trailing edge b shown in FIGS. 35 and 36. When the leading edge a of the image area X moved away from the image transfer position 8 arrives at the cleaning position 26, as shown in FIG. 34, the cleaning roller 51 starts collecting the toner remaining on the drum 1. In a repeat copy mode, the next toner image is formed in the next image area of the drum 1 downstream of the above area X in the direction of rotation of the drum 1.

The cleaning unit 50 also has both the toner collecting function and the toner redepositing function stated earlier. It has been customary with an image forming apparatus to cause a cleaning unit to stop collecting the toner when the trailing edge of an image area arrives at a cleaning position, and then cause it to redeposit the collected toner in a non-image area downstream of the image area. This prevents the redeposited toner from effecting the formation of the next latent image. This kind of scheme, however, has the following problem left unsolved.

The non-image area should extend over a substantial length in the circumferential direction of the drum, so that the toner can be redeposited on the drum between the preceding image area and the following image area. This makes it difficult to increase the image forming speed. Specifically, even when the portion of the drum where the toner is redeposited is charged by the charge roller 2 and then illuminated by the laser beam 11, a latent image cannot be formed there. It is therefore necessary to form the next latent image in the portion of the drum following the portion with the redeposited toner and moved away from the charge roller 2. As a result, a long non-image area for redepositing the toner is required and obstructs high-speed image formation.

In the illustrative embodiment, the function of the cleaning unit 50 is switched from the toner collecting function to the toner redepositing function before the trailing edge b of the image area of the drum 1 moves away from the cleaning roller 51. This is done by control means, not shown, when the intermediate between the leading edge a and the trailing edge b of the image area X, e.g., a portion d shown in FIG. 36 moves away from the roller 51.

Figure 35:
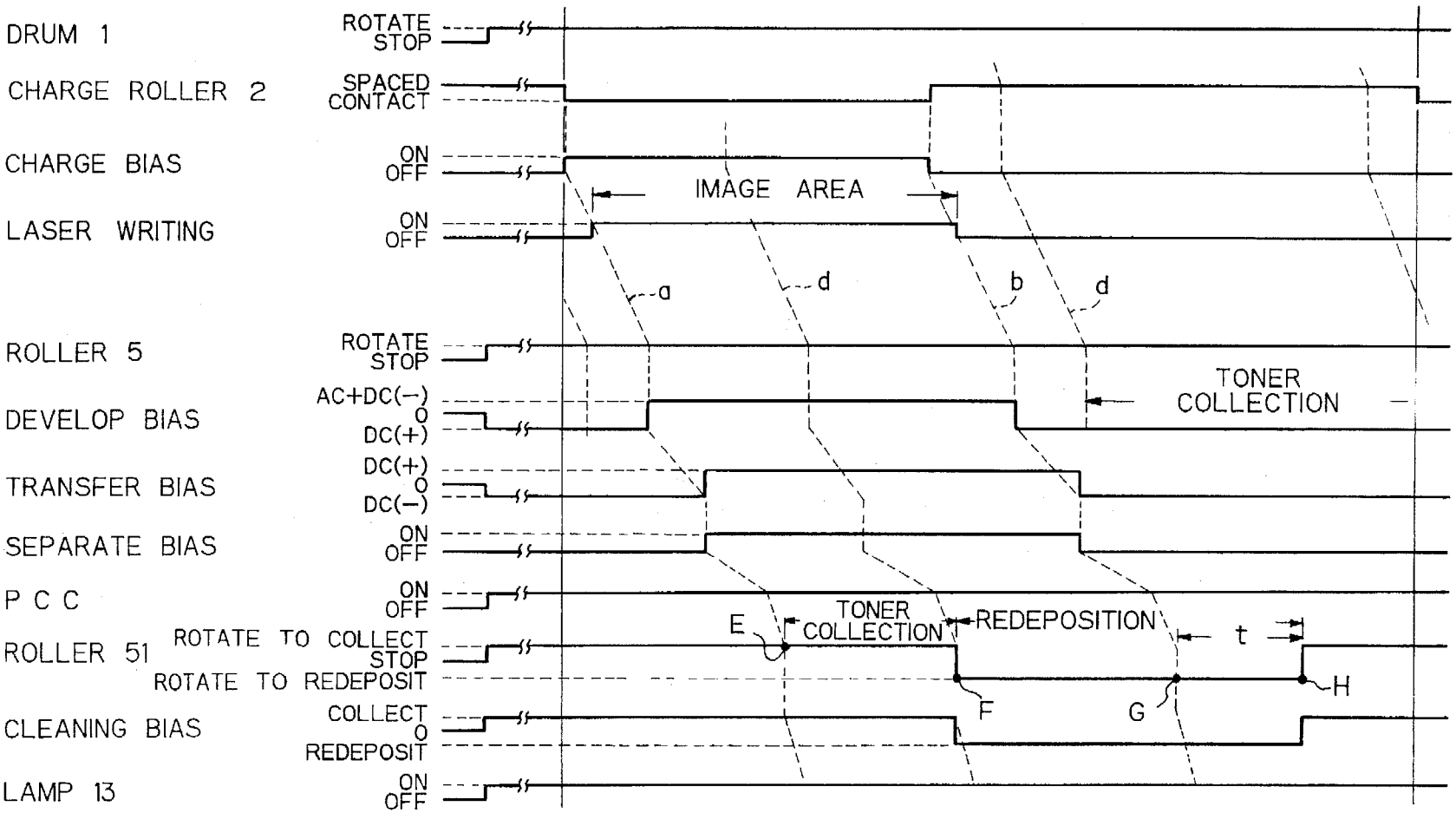
FIG. 35 is a timing chart representative of a specific operation of the sixth embodiment.
Figure 36:
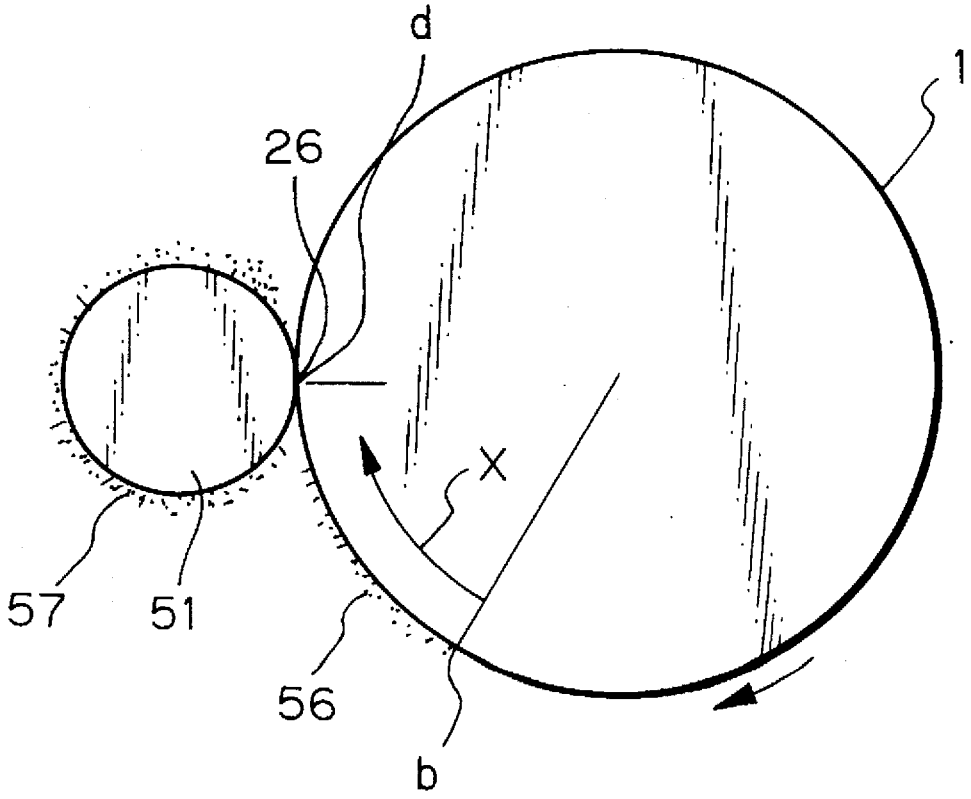
FIG. 36 shows a condition wherein the cleaning roller starts redepositing the toner on the photoconductive element.

Specifically, as shown in FIG. 35, when the leading edge a of the image area reaches the cleaning position 26, the cleaning roller 51 collects the residual toner from the drum 1 due to the electric field formed between the roller 51 and the drum 1 (time E, FIG. 35). Subsequently, the intermediate d between the leading edge a and the trailing edge b of the image area X arrives at the position 26 (time F, FIG. 35). At the time F, the cleaning roller 51 stops collecting the toner from the drum 1. FIG. 36 shows the toner 57 collected by the roller 51 and the toner 56 remaining on the portion of the drum 1 which is about to reach the roller 51. In this manner, the roller 51 stops its collecting operation while a part of the toner is still left on the drum 1.

At the time F, the power source connected to the roller 51 is switched from $E_4$ to $E_5$ (FIG. 34) in order to apply a negative bias voltage, e.g., −1000 V to the roller 51. Such a voltage is higher, at the negative side, than the surface potential of the negative charge existing on the drum 1. Consequently, the toner on the roller 51 rotating in contact with the drum 1 is transferred to the drum 1 due to the difference in potential between the roller 51 and the drum 1. Thereafter, the direction of the electric field between the roller 51 and the drum 1 is reversed in order to redeposit the toner collected by the roller 51 on the drum 1.

During the redeposition, the toner 56 (FIG. 36) remaining on the drum 1 arrives at the cleaning position 26. This part of the toner is not collected by the roller 51, but it is passed through the position 26 together with the toner redeposited on the drum 1. Specifically, because the toner 56 has also been charged to negative polarity by the PCC 55, it is not collected by the roller 51.

In the specific procedure shown in FIG. 35, the trailing edge b of the image area X moves away from the cleaning position 26 at a time G. Then, at a time H t seconds later than the time G, the voltage source connected to the roller 51 is switched from $E_5$ to $E_4$ in order to apply the positive voltage to the roller 51. This is the end of the redeposition of the toner on the drum 1.

Before the toner redeposited on the drum 1 arrives at the charge roller 2, the roller 2 is released from the drum 1. This prevents the toner from depositing on the charge roller 2. When the toner on the drum 1 reaches the discharge lamp 13, the lamp 13 illuminates the drum 1 in order to reduce its surface potential to substantially zero volt.

The voltage source connected to the developing roller 5 is switched from $E_1$ to $E_2$ before the toner redeposited on the drum 1 is brought to the developing unit 4. In this condition, a bias voltage opposite in polarity to the charge of the toner, e.g., DC +200 V is applied to the roller 5. As a result, the toner on the drum 1 and having a surface potential of substantially zero volt is electrostatically transferred to the roller 5 and collected in the developing unit 4. At this instant, the magnet brush formed on the roller 5 exerts an impact on the toner carried on the drum 1, thereby promoting the efficient collection of the toner.

By the above procedure, the toner returned from the roller 51 to the drum 1 can be substantially entirely collected in the developing unit 4 and reused for development without resorting to a special passageway. This reduces the cost of the image forming apparatus.

Before the trailing edge b of the image area X moves away from the cleaning position 26, the cleaning roller 51 starts redepositing the toner on the rear portion of the image area defined on the drum 1. Therefore, a broad area for redeposition is available in the image area. This makes it needless to provide a broad non-image area for redeposition between the consecutive image areas, so that the image forming speed can be increased.

To form the next image on the drum 1, after the trailing edge of the toner redeposited on the drum 1 has moved away from the charge roller 2, the roller 2 is again brought into contact with the drum 1 in order to charges it. Then, the laser beam 11 scans the charged surface of the drum 1 so as to form the next latent image. Therefore, the charge roller 2 is free from contamination due to the redeposited toner while the laser beam 11 is prevented from being intercepted by the redeposited toner. In addition, the toner particles of opposite polarity is prevented from entering the developing unit 4. Control means, not shown, may control the charge roller or latent image forming means 2 such that the roller 2 contacts the portion of the drum where the redeposited toner is absent, just after the arrival of the trailing edge of the redeposited toner at the roller 2. This will further reduce the interval between consecutive image areas and will thereby surely increase the image forming speed.

Figure 37:
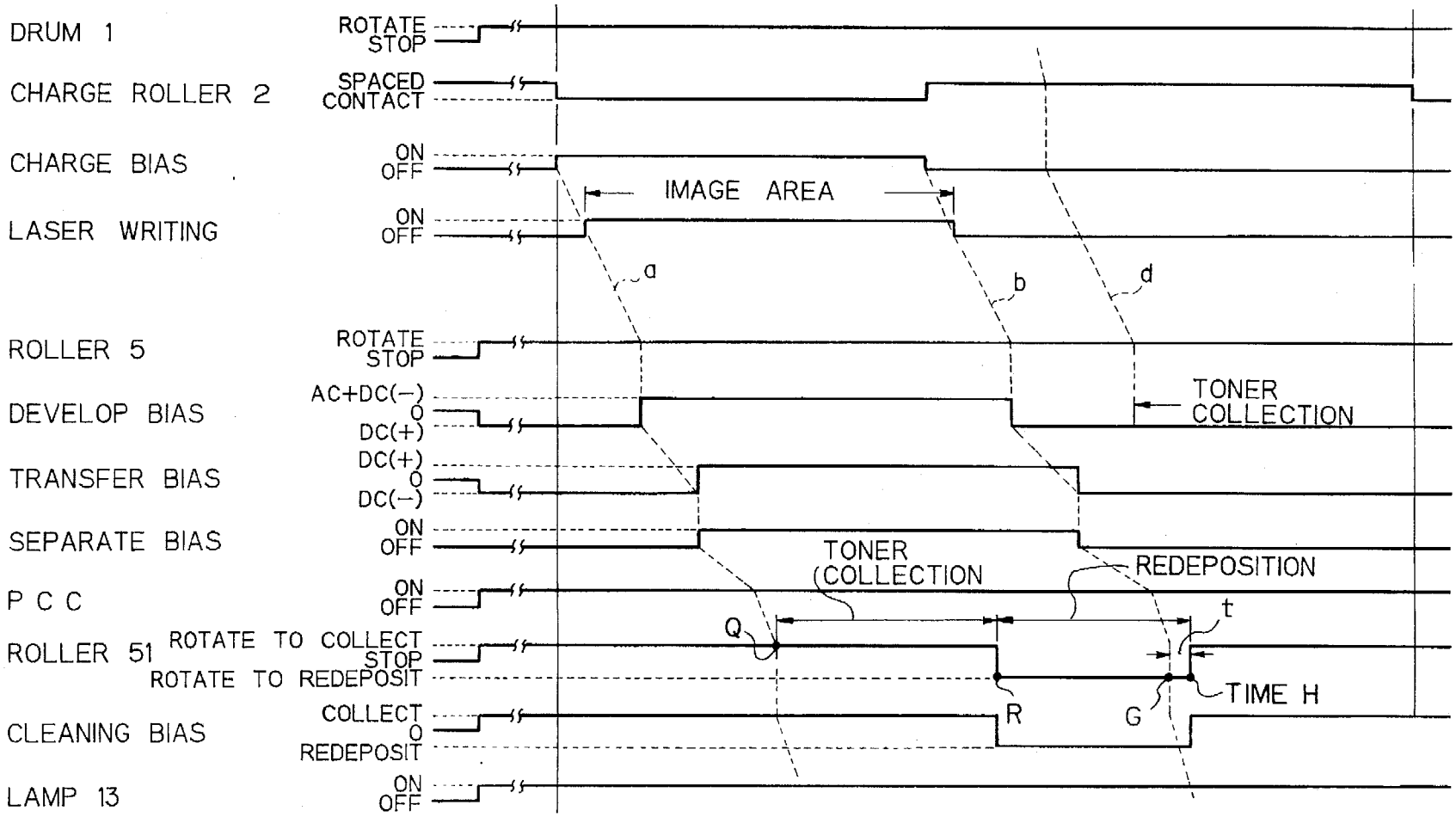
FIG. 37 is a timing chart showing another specific operation of the sixth embodiment.

As shown in FIG. 37, the period of time t shown in FIG. 35 may be further reduced in order to further reduce the length of the non-image area intervening between the image area X and the next image area. This is successful to implement a far higher image forming speed. Specifically, the control means assigned to the cleaning unit 50 controls the unit 50 such that it stops the redeposition of the toner on the drum 1 just after the trailing edge b of the image area X has moved away from the roller 51, i.e., such that the period of time t decreases. Regarding the rest of the procedure, FIG. 37 is identical with FIG. 35.

Theoretically, the non-image area between the image areas can even be practically eliminated if the cleaning unit 50 stops the redeposition under the control of the control means at the same time as the arrival of the trailing edge b of the image area X at the cleaning position 26, i.e., if the period of time t is zero.

In FIG. 34, during toner collection, the cleaning roller 51 is rotated such that its surface moves in the opposite direction to the surface of the drum 1, as seen at the nip. At this instant, the rotation speed of the roller 51 should preferably be selected such that the roller 51 ends a single toner collection by less than one rotation thereof. Then, at the time of collection, the toner left on the drum 1 constantly contacts the surface of the roller 51 where the collected toner is absent. This prevents the toner to be collected and the toner already collected from contacting each other and thereby enhances efficient collection.

Assume that the distance between the leading edge a and the intermediate d of the image area X in the circumferential direction of the drum 1 is varied due to the vairation of the size of the image area X. Then, the roller 51 may be so controlled as to rotate at a particular speed at each time of collection. For example, assume that the roller 51 collects the toner by one rotation thereof, and that one image area X has a size corresponding to format A4 fed vertically long (297 mm) while the other image area X has a size corresponding to format A3 fed vertically long (420 mm). Then, the roller 51 is rotated at a higher speed for the 420 mm image area X than for the 297 mm image area. This allows the roller 51 to collect the toner from the leading edge a up to the intermediate d by one rotation thereof.

Further, as shown in FIG. 35, the direction of rotation of the roller 51 is switched between toner collection and toner redeposition. During toner redeposition, the roller 51 is rotated in a direction indicated by a phantom arrow in FIG. 34.

During toner redeposition, the roller 51 is rotated such that it moves in the same direction as the drum 1, as seen at the nip, as stated above. In this case, the drum 1 and roller 51 should preferably be different in linear velocity from each other. The difference can be implemented if the rotation speed of the roller 51 is increased during toner redeposition. Particularly, it is desirable that the linear velocity of the roller 51 be higher than the linear velocity of the drum 1. Then, a shearing force and therefore an electrostatic force acts on the toner leaving the roller 51 and promotes the efficient transfer of the toner to the drum 1. By increasing the rotation speed of the roller 51, it is also possible to reduce the redeposition time of the toner on the drum 1. This is also true when the roller 51 is rotated for toner redeposition such that it moves in the opposite direction to the drum 1, as seen at the nip.

With the above configuration, the embodiment prevents the toner from remaining on the roller 51 and enhances the efficient cleaning of the drum 1 by the roller 51, thereby insuring toner images with clear background.

The intermediate d at which the roller 51 starts redeposition may be any position other than the leading edge a and trailing edge b of the image area X. However, if the distance between the leading edge a and the intermediate d is excessively short, then the toner redeposited on the drum 1 is apt to reach the charge roller 2 while a latent image is being formed in a single image area. Assume that the distance between the leading edge a and the intermediate d is selected to be greater than the distance between the leading edge a and the trailing edge b in order to obviate the above occurrence. Then, if the collection time and the redeposition time of the roller 51 are selected to be equal, the toner collected by the roller 51 cannot be redeposited in the image area of the drum 1. Moreover, the interval t (FIG. 35) between the arrival of the trailing edge b at the cleaning position 26 and the end of toner redeposition is wastefully increased. This makes it difficult to reduce the interval between the consecutive image areas and is likely to lower the image forming speed.

Preferably, therefore, the control means assigned to the cleaning unit 50 controls the unit 50 such that it completes toner redeposition in a shorter period of time than toner collection. For example, the roller 51 is rotated at a higher speed during toner redeposition than during toner collection. With this scheme, even if the distance between the leading edge a and the intermediate d is greater than the distance between the intermediate d and the trailing edge b, the roller 51 is capable of redepositing the toner in the image area or a region following it. That is, the period of time t is made extremely short or even zero. As a result, the interval between the image areas can be reduced even to zero so as to increase the image forming speed.

The charge roller 2 and transfer roller 7 each performs the respective function in contact with the drum 1. Therefore, the toner redeposited on the drum 1 is likely to deposit thereon. In light of this, after a sequence of continuous recording operations or after a preselected number of recording operations, a bias voltage for causing the toner to be electrostatically transferred from the roller 2 or 7 to the drum 1 may be applied to the roller 2 or 7. Alternatively, the roller 2 or 7 may be strongly pressed against the drum 1.

Figure 38:
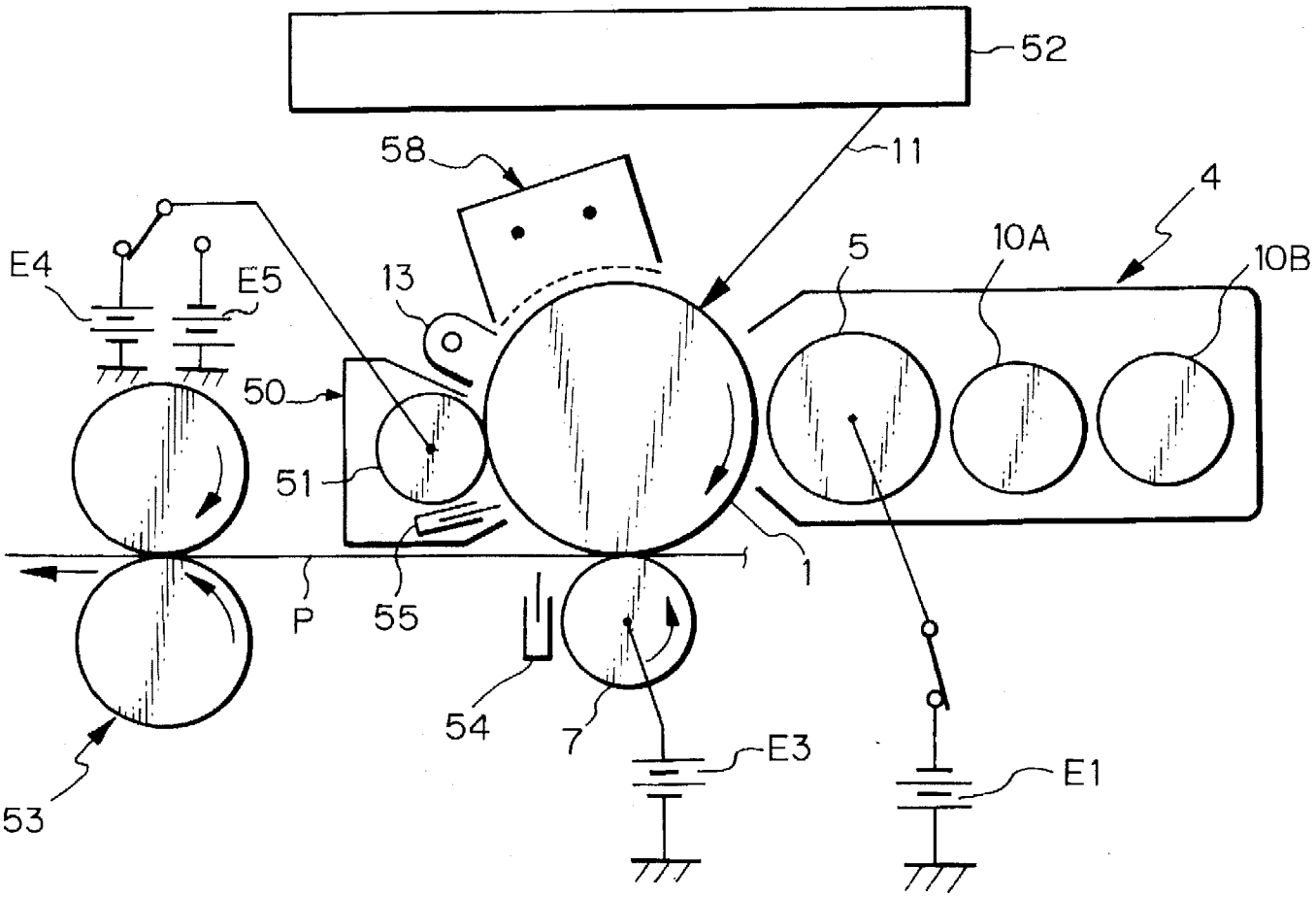
FIG. 38 shows a modification of the sixth embodiment.
Figure 39:
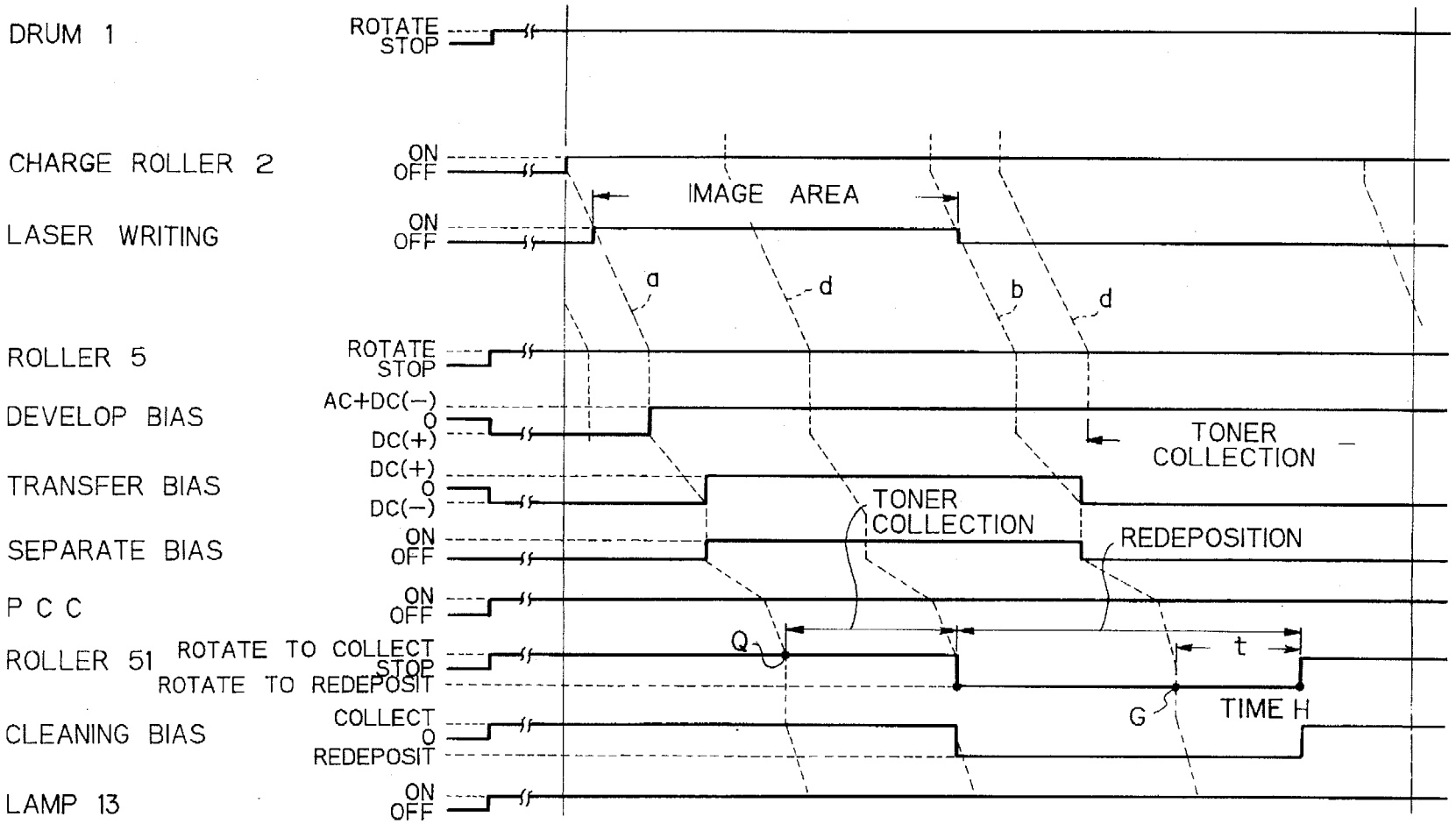
FIG. 39 is a timing chart showing a specific operation of the modification shown in FIG. 38.

As shown in FIG. 38, the charge roller 2 may be replaced with a scorotron charger 58 which is constantly spaced from the drum 1. FIG. 39 is a timing chart associated with FIG. 38. In this configuration, the drum 1 is also uniformly charged to −700 V by the charger 58 and then scanned by the laser beam 11 to form a latent image thereon. At this instant, the power source $E_1$ applies the bias voltage of −500 V to the developing roller 5. The following description will concentrate on the difference between the arrangement of FIG. 34 and that of FIG. 38.

As shown in FIG. 39, the charger 58 is continuously turned on even when the toner redeposited on the drum 1 arrives it. As also shown in FIG. 39, a single negative bias voltage is continuously applied to the developing roller 5 both during development and during toner collection. In this condition, the charger 58 charges the surface of the drum 1 carrying the redeposited toner to −700 V. When the redeposited toner is brought to the developing unit 4, the toner of negative polarity is electrostatically transferred from the drum 1 to the roller 5 due to the difference between −700 V and −500 V which is applied to the roller 5. Again, the magnet brush formed on the drum 5 exerts an impact on the toner so as to promote the efficient collection of the toner. This is also true when the two-ingredient type developer is replaced with a single-ingredient type developer in the form of magnetic toner.

The arrangement of FIG. 38 achieves the following advantages in addition to the advantages of the arrangement of FIG. 34. It is not necessary to bring a charging unit into and out of contact with the drum 1. Because the toner redeposited on the drum 1 is charger by the charger 58, the developing unit 4 can collect it without having the voltage applied to the roller 5 switched. In addition, an occurrence that toner of opposite polarity is introduced into the developing unit 4 is obviated.

The above embodiment is practicable with positive-to-positive development as with negative-to-positive development shown and described. Negative-to-positive development and positive-to-positive development are often applied to digital copiers and printers and analog copiers, respectively.

If desired, the drum 1 may be replaced with a photoconductive belt or even with an image carrier other than photoconductors. The paper may be replaced with an intermediate transfer body, in which case a toner image will be transferred from the image carrier to the paper by way of the intermediate body. Further, the cleaning roller 51 may be replaced with an endless cleaning belt.

As stated above the above embodiment allows the developing unit 4 to reuse the toner with a simple arrangement. In addition, the toner is returned from the cleaning roller 51 to the drum 1 before the trailing edge b of the image area X moves away from the roller 51, so that the non-image area between consecutive image areas can be reduced in size or can be eliminated. This successfully increases the image forming speed.

7th Embodiment

This embodiment is a solution to the previously discussed problem (7). This embodiment is substantially identical with the embodiment of FIG. 25 regarding image formation, toner collection by the cleaning member, toner redeposition on the image carrier, and toner collection by the developer carrier. What is unique to this embodiment is the configuration and arrangement of the cleaning roller 25. This will be described with reference to FIG. 40.

Figure 41:
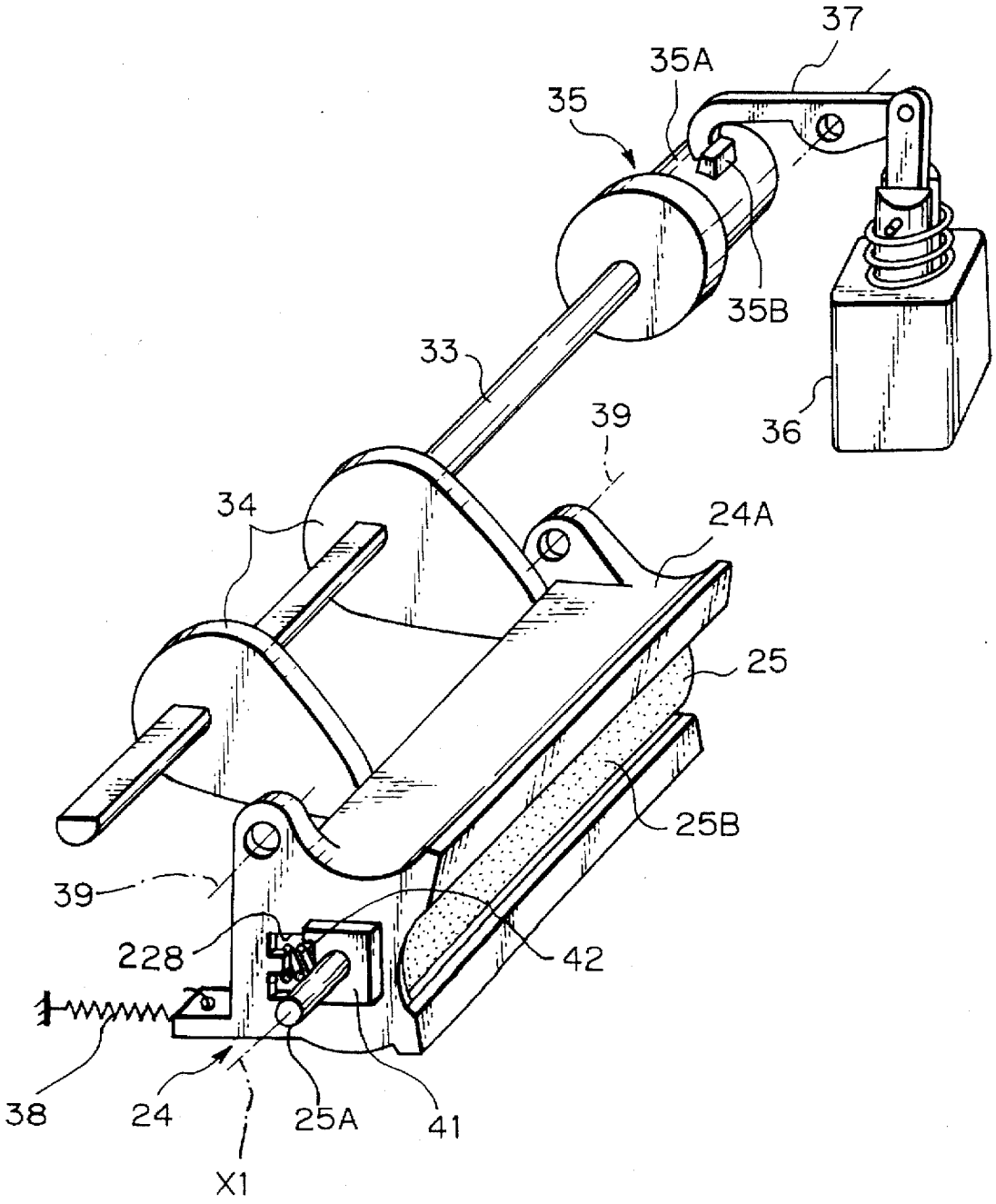
FIG. 41 is a fragmentary perspective view of the seventh embodiment.

As shown, the cleaning unit 24 has the casing 24A and cleaning roller 25 mounted thereon. The roller 25 is rotatable about an axis X1. As shown in FIG. 41 specifically, the roller 25 is made up of a roller shaft 25A formed of a rigid material and a roller body 25B formed of an elastic material and coaxial with the shaft 25A. The shaft 25A is journalled to the casing 24A at opposite ends thereof via bearings 41 (only one is visible in FIG. 41). The rigid material constituting the shaft 25A is conductive and may be implemented by metal. The elastic material constituting the body 25B may be implemented by foam resin or rubber having a medium resistance or conductive. In the illustrative embodiment, the body 25B is mounted on the shaft 25A.

The casing 24A may be affixed to the body of the image forming apparatus. This, however, maintains the body 25B of the roller 25 constantly pressed against the drum 1 and thereby causes the roller 25 to permanently deform at a relatively early stage. In addition, components contained in the body 25B are apt to adversely effect the photoconductor of the drum 1. In the illustrative embodiment, the roller 25 is spaced from the drum 1 when a power switch, not shown, provided on the apparatus is not turned on, as follows.

As shown in FIG. 41, a cam shaft 33 extends substantially parallel to the roller 25 and is journalled to a pair of side walls, not shown, included in the apparatus body. A pair of cams 34 are mounted on the cam shaft 33 while a one-way clutch 35 is mounted on one end of the shaft 33. The one-way clutch 35 is implemented as a spring clutch. When the power switch of the apparatus is not turned on, the cams 34 are held in their retracted position 180° apart from the illustrated position. When the cams 34 are in the retracted position, the roller 25 is spaced from the drum 1 by a tension spring 38.

On the turn-on of the power switch, a solenoid 36 is energized and rotates a clutch lever 37 via its plunger. As a result, the lever 37 is moved away from a projection 35B formed on a drum 35A included in the clutch 35, thereby releasing the drum 35A. In this condition, drive means, not shown, rotates the cam shaft 33 until the cams 34 reach the position shown in FIG. 41, moving 180° away from the retracted position. Another projection 35B is provided on the drum 35A although not shown in FIG. 41. When the solenoid 36 is deenergized, the clutch lever 37 catches the projection 35B not shown, thereby stopping the rotation of the drum 35A. As a result, the cams 34 are brought to a stop at the illustrated position.

The casing 24A is journalled to the pair of side walls of the apparatus body via a shaft represented by an axis 39. The tension spring 38 is loaded between the casing 24A and one of the side walls. The axis 39 about which the casing 24A is rotatable is parallel to the axis of the roller 25 and that of the drum 1.

Figure 40:
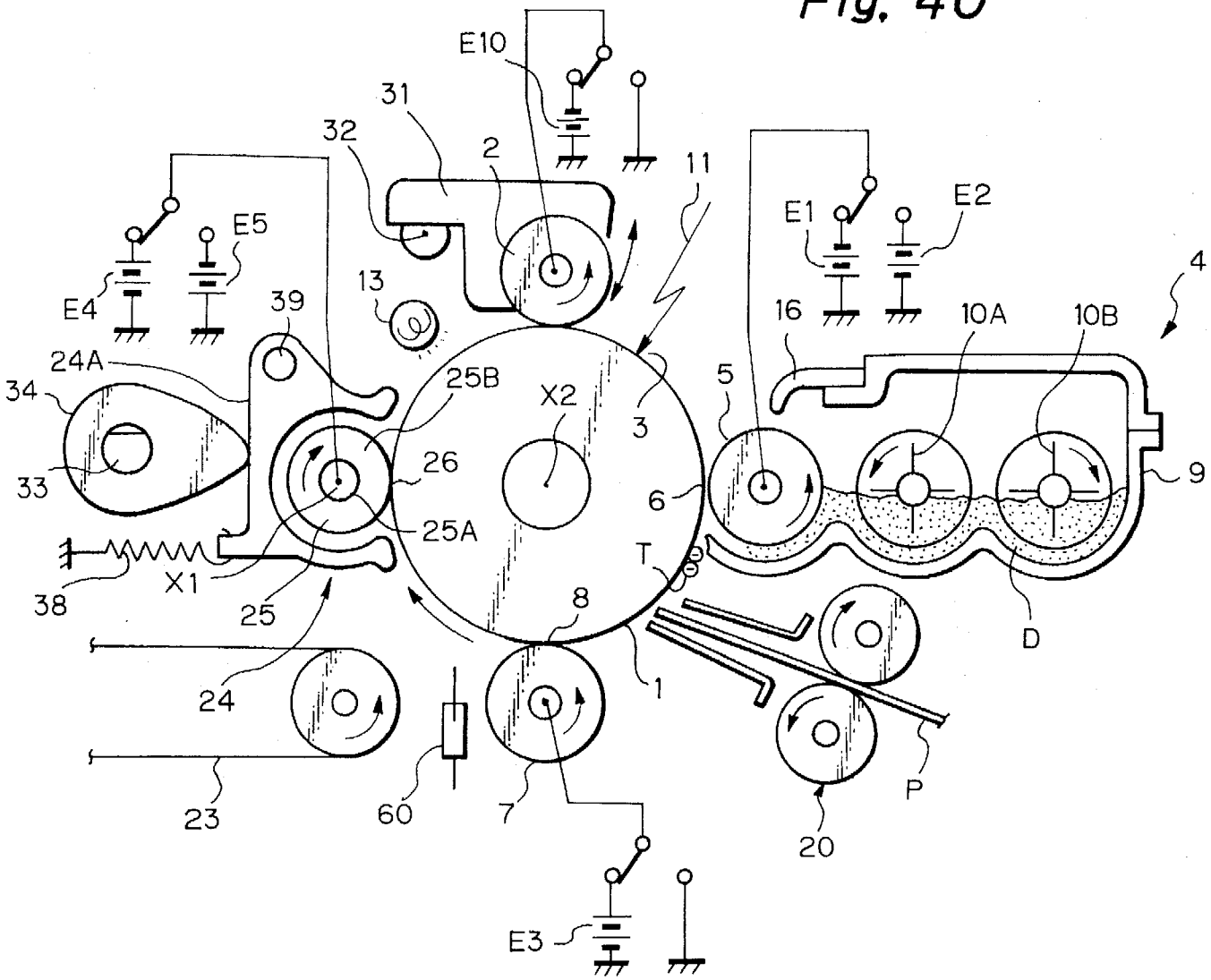
FIG. 40 is a view showing a seventh embodiment of the present invention.

The cams 34 moving toward the position shown in FIG. 41 move the casing 24A toward the drum 1 against the action of the spring 38. As a result, the body 25B of the roller 25 is pressed against the drum 1 while deforming itself. In this manner, the casing 24A is positioned relative to the drum 1 by the cams 34, as shown in FIG. 40.

The shaft 25A of the roller 25 is journalled to the casing 24A at opposite ends thereof. In the illustrative embodiment, opposite walls of the casing 24A are each formed with an opening 28 A bearing member 41 is received in the respective opening 228 in such a manner as to be movable toward and away from the drum 1. The shaft 25A is rotatably supported by such bearing members 41 at both ends thereof. A compression spring 42 is loaded in each opening 28 and constantly biases the bearing member 41 to the right, as viewed in FIG. 41. As a result, the roller 25 is constantly biased toward the drum 1. Therefore, the roller 25 is capable of rotating while being pressed against the drum 1.

Figure 42:
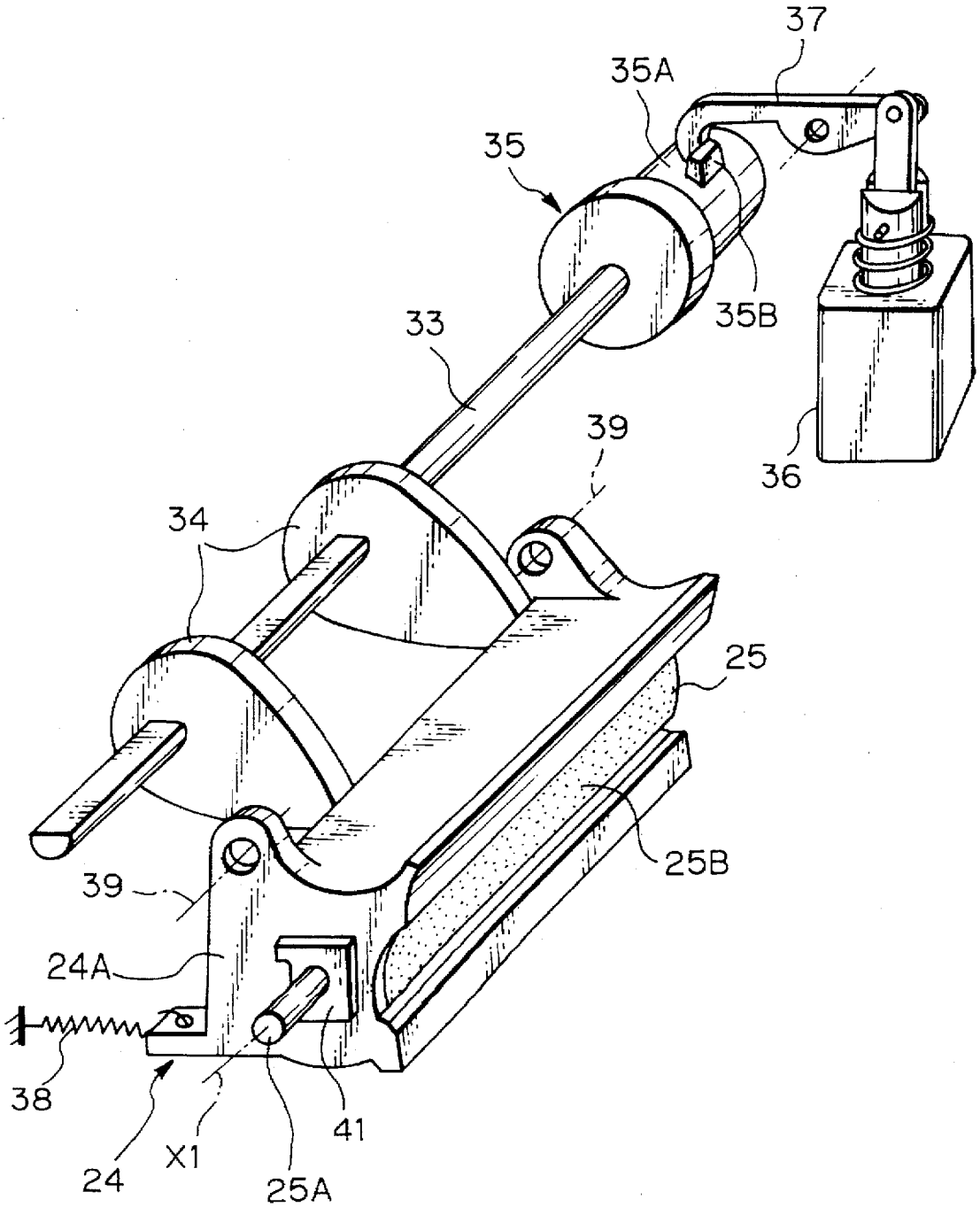
FIG. 42 is a fragmentary perspective view showing a modification of the seventh embodiment.

FIG. 42 shows a modification of the arrangement shown in FIG. 41. As shown, the bearing members 41 rotatably supporting the shaft 25A of the roller 25 are not movable relative to the casing 24A. In this configuration, the roller 25 is rotatable, but not movable relative to the casing 24A. The rest of the construction is the same as in FIG. 41.

Figure 43:
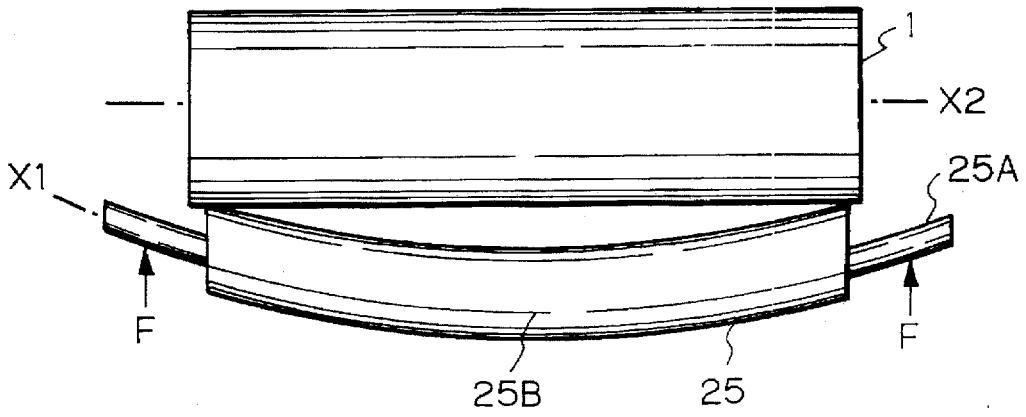
Fig. 43 PRIOR ART
FIG. 43 is an exaggerated view useful for understanding the problem of a conventional cleaning roller.

In any case, as shown in FIG. 43, forces F act on both end portions of the shaft 25A of the roller 25 because the shaft 25A is rotatably supported by the casing 24A. In this condition. The roller 25 is capable of surely collecting the toner remaining on the drum 1 and redepositing it on the drum 1 with its body 25B pressingly contacting the drum 1.

Because the forces F acting on the end portions of the shaft 25A press the body 25B against the drum 1, they intensity the pressure between the end portions of the body 25B and the drum 1. However, the pressure decreases at the intermediate portion of the body 25B in the axial direction of the body 25B. FIG. 43 is an exaggerated view useful for understanding the problem with a conventional cleaning roller. As shown, the conventional roller 25 has the same diameter over its entire length in the direction of the axis X1. Therefore, the roller 25 has its shaft 25A bent such that the shaft 25A moves away from the surface of the drum 1 at its intermediate portion, due to the forces F and the reaction of the drum 1. Such an irregular pressure distribution between the roller 25 and the drum 1 lowers the toner collection efficiency from the drum 1 and the toner redeposition efficiency on the drum 1 at the intermediate portion of the roller 25. As a result, the background of a toner image formed next is contaminated by the toner.

Further, when the charge roller 2, FIG. 40, is used to charge the drum 1 uniformly, the toner not collected by the roller 25 and moved away from the roller 25 deposits on and contaminates the charge roller 2, thereby bringing about various problems discussed earlier.

FIGS. 44–49 each shows a specific configuration of the cleaning roller 25 included in the illustrative embodiment and capable of eliminating the above occurrence.

Figure 44:
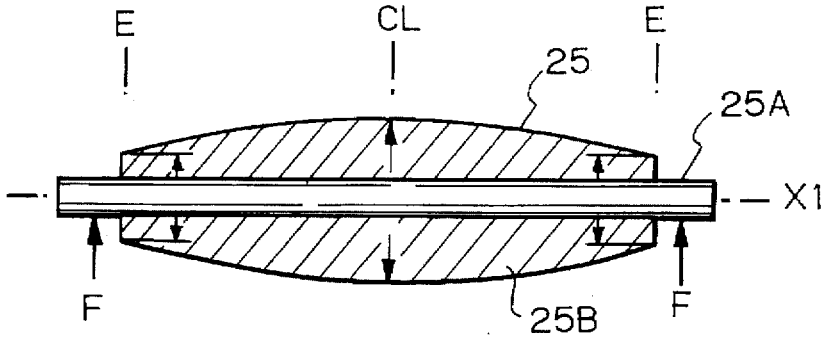
FIGS. 44–47 are sections each showing a specific configuration of a cleaning roller included in the seventh embodiment.

The roller 25 shown in FIG. 44 has the axis X1 substantially parallel to the axis X2 (FIG. 40) of the drum 1. The roller body 25B has an outside diameter D10 at its center CL in the axial direction of the roller 25, and an outside diameter D2 at its opposite ends E. The outside diameter D10 is greater than the outside diameter D2; that is, the outside diameter sequentially decreases from the center CL to the ends E. The shaft 25A has the same outside diameter throughout its length.

In the configuration of FIG. 44, the body 25B elastically deforms in contact with the drum 1 due to the forces F acting on the opposite ends of the shaft 25A. However, the intermediate portion of the body 25B including the center CL and greater in diameter than the ends E deforms more than the end portions. As a result, the body 25B is substantially uniformly pressed against the drum 1 over its entire length in the direction of the axis X1. In this condition, the roller 25 can collect the toner T' from the drum 1 uniformly and efficiently throughout its axial dimension. This is also true when the roller 25 redeposits the toner on the drum 1.

The roller 25 has at least its surface portion formed of a material capable of restoring the toner to its original polarity. In this respect, the roller 25 contacting the drum 1 uniformly can charge the toner to the above polarity by friction over its entire axial dimension. This insures the efficient collection and redeposition of the toner and thereby frees the next toner image from contamination.

Figure 45:
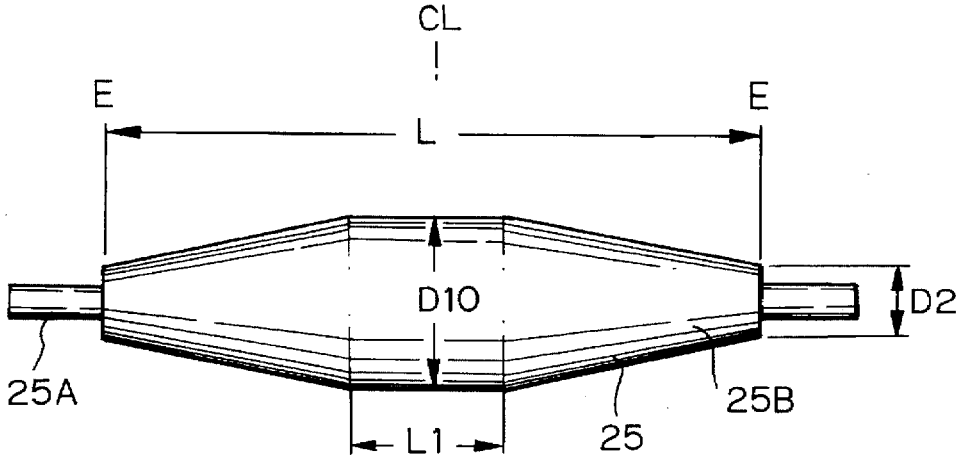

The roller 25 shown in FIG. 45 is a more specific form of the roller 25 shown in FIG. 44. As shown, the body 25B has an axial length L of 318 mm. The intermediate portion of the body 25B including the center CL has a length L1 of 50 mm and an outside diameter D1 of 15.9 mm. The ends E of the body 25B have an outside diameter D2 of 15.6 mm each.

Figure 46:
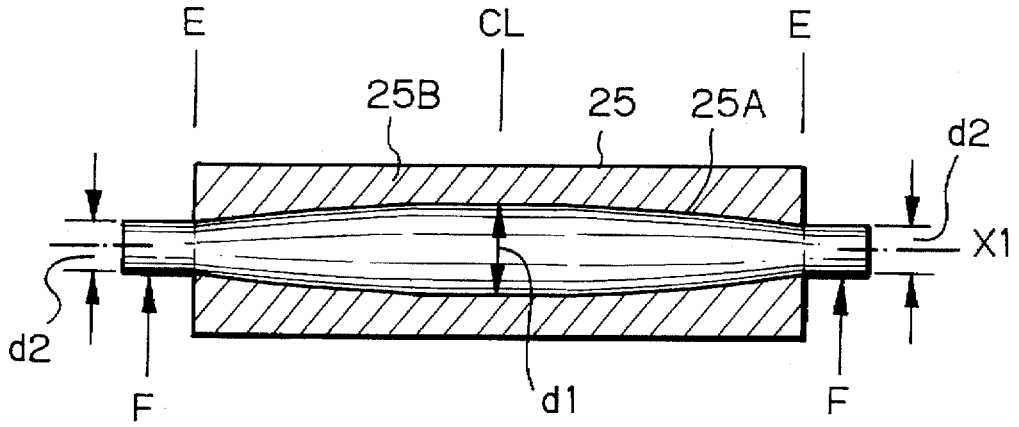

The roller 25 shown in FIG. 46 also has the axis X1 extending parallel to the axis X2 of the drum 1. The shaft 25A has an outside diameter d1 at its center CL in the axial direction which is greater than an outside diameter d2 at its ends. The outside diameter of the shaft 25A therefore sequentially decreases from the center CL to the ends E. On the other hand, the body 25B has the same outside diameter throughout its axial length. The body 25B with this configuration also elastically deforms in contact with the drum 1 due to the forces acting on the opposite ends of the shaft 25A. However, the pressure between the body 25B and the drum 1 is constant throughout the length of the body 25B because the center LC has a greater outside diameter than the ends E.

Figure 47:
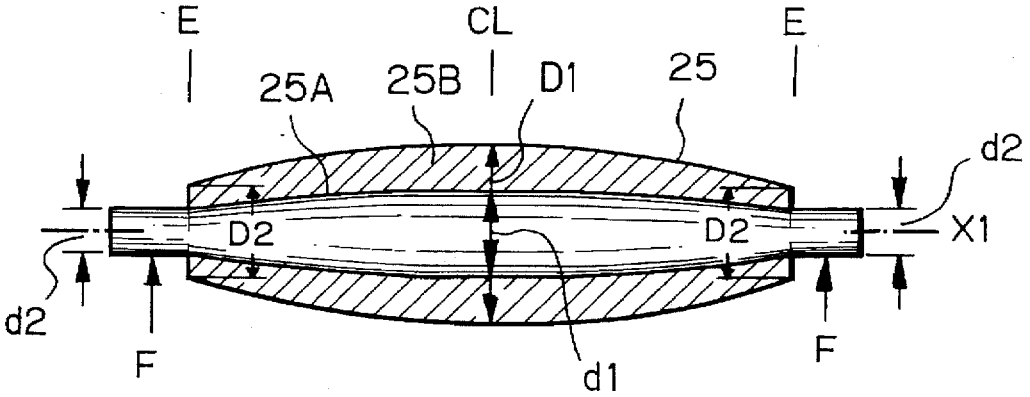

The body 25B shown in FIG. 44 and the shaft 25A shown in FIG. 46 may be combined, as shown in FIG. 47. This configuration is comparable in advantage with the configuration of FIG. 44.

Figure 48:
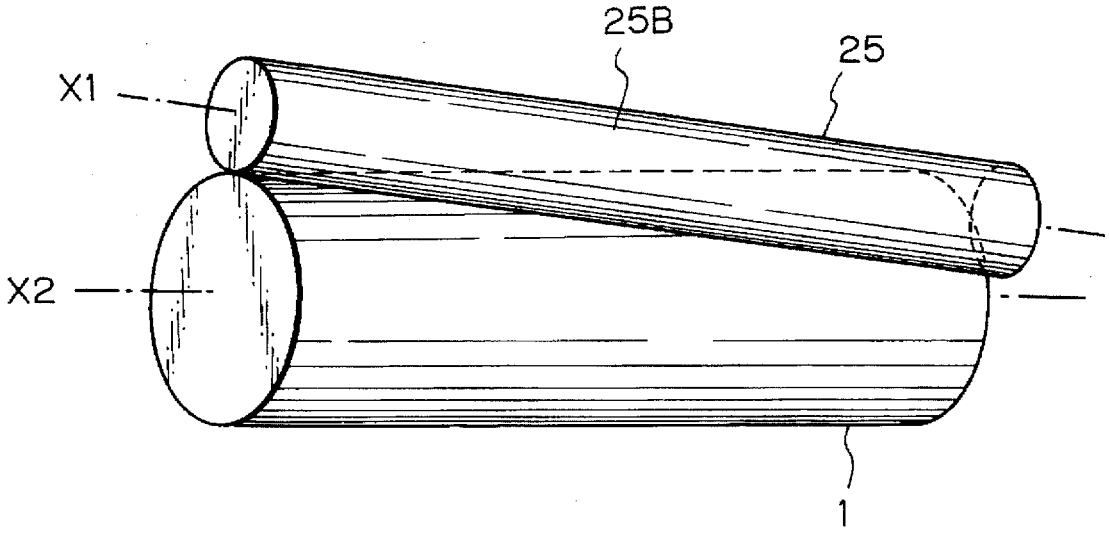
FIG. 48 is a perspective view showing a specific position of the cleaning roller of the seventh embodiment relative to the photoconductive element.

The roller 25 shown in FIG. 48 is has the axis X1 not parallel to or intersecting the axis X2 of the drum 1. In this condition, the body 25B collects the toner from the drum 1 and redeposits it on the drum 1 in pressing contact with the drum 1. The body 25B elastically deforms complementarily to the surface configuration of the drum 1. This roller 25 is also comparable in advantage with the roller 25 of FIG. 44.

Figure 49:
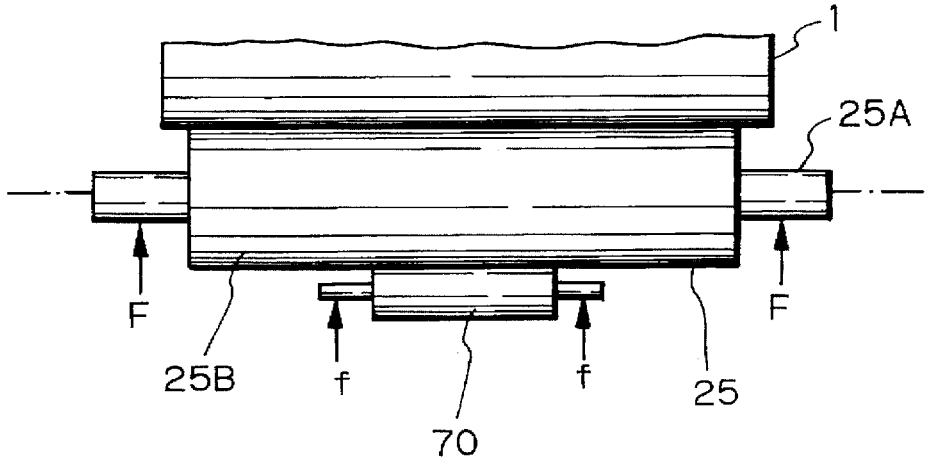
FIG. 49 shows a press roller pressing the cleaning roller against the photoconductive element.

As shown in FIG. 49, a press roller 70 may press only the intermediate portion of the roller 25 in the direction of the axis X1 against the drum 1. The press roller 70 has an axial length smaller than that of the roller 25. The press roller 70 is rotatably supported by, e.g., the casing 24A (FIG. 40) via bearings, although not shown in FIGS. 40–42. A shaft on which the press roller 70 is mounted is pressed by forces f at its opposite ends. The press roller 70 is rotated by the roller 25 during operation.

In FIG. 49, although the body 25B is pressed against the drum 1 with the shaft 25A being pressed by the forces F, it can contact the drum 1 uniformly over its entire length because the press roller 70 presses the intermediate portion of the body 25B. The roller 25 is therefore as effective as the roller 25 shown in FIG. 44.

To prevent the toner collected by the roller 25 from depositing on the press roller 70, it is preferable that the roller 70 be formed of metal or similar conductive material and be applied with the same voltage as the roller 25. If desired, a preselected voltage may be applied to the roller 25 via the roller 70.

The illustrative embodiment is also practicable even with positive-to-positive development. The embodiment may be modified such that a toner image is transferred from the drum 1 to a recording medium by way of an intermediate transfer body.

As stated above, in the above embodiment, the body 25B of the cleaning roller 25 can be uniformly pressed against the drum 1 in the axial direction thereof. This enhances the toner collection efficiency and toner redeposition efficiency of the roller 25 and thereby protects the background of toner images from contamination.

Various modifications will become possible for those skilled in the art after receiving the teachings of the present disclosure without departing from the scope thereof.

What is claimed is:

1. An image forming apparatus comprising:

a rotatable image carrier;

latent image forming means for electrostatically forming a latent image on a surface of said image carrier;

a developing unit for developing the latent image to thereby produce a corresponding toner image;

an image transfer unit for transferring the toner image to a recording medium;

a cleaning unit for collecting toner left on said image carrier after transfer of the toner image, and then redepositing the toner in an area of the surface of said image carrier which does not effect formation of a next latent image, wherein the toner redeposited on said image carrier is collected by said developing unit; and charge regulating means positioned downstream of said image transfer unit, but upstream of said cleaning unit, in a direction of rotation of said image carrier, and for charging the toner being conveyed by said image carrier toward said cleaning unit to an original polarity deposited on the toner at the time of development.

2. An apparatus as claimed in claim 1, wherein said cleaning unit comprises a cleaning member formed of a material capable of charging, when the toner is of polarity opposite to the original polarity, the toner to the original polarity.

3. An apparatus as claimed in claim 1, wherein said charge regulating means comprises a charging member not contacting said image carrier.

4. An apparatus as claimed in claim 3, wherein said charging member is applied with a DC voltage of polarity identical with the original polarity, and an AC voltage.

5. An apparatus as claimed in claim 1, wherein said charge regulating means comprises a frictional charging member.

6. An image forming apparatus comprising:

a rotatable image carrier;

charging means for charging a surface of said image carrier uniformly;

latent image forming means for exposing the charged surface of said image carrier to thereby electrostatically forming a latent image;

a developing unit for developing the latent image to produce a corresponding toner image;

an image transfer unit for transferring the toner image to a recording medium;

a cleaning unit for collecting toner left on said image carrier after transfer of the toner image, and then redepositing the toner in an area of the surface of said image carrier which does not effect formation of a next latent image, wherein the toner redeposited on said image carrier is collected by said developing unit; and charge regulating means positioned downstream of said cleaning unit, but upstream of said charging means, in a direction of rotation of said image carrier, and for charging the toner moved away from said cleaning unit and charged to a polarity opposite to an original polarity deposited on the toner at the time of development to the original charge.

7. An apparatus as claimed in claim 6, wherein said cleaning unit comprises a cleaning member formed of a material capable of charging, when the toner is of polarity opposite to the original polarity, the toner to the original polarity.

8. An apparatus as claimed in claim 6, wherein said charge regulating means comprises a charging member not contacting said image carrier.

9. An image forming apparatus comprising:

a rotatable image carrier;

charging means for charging a surface of said image carrier uniformly;

latent image forming means for exposing the charged surface of said image carrier to thereby electrostatically forming a latent image;

a developing unit for developing the latent image to produce a corresponding toner image;

an image transfer unit for transferring the toner image to a recording medium;

a cleaning unit for collecting toner left on said image carrier after transfer of the toner image, and then redepositing the toner in an area of the surface of said image carrier which does not effect formation of a next latent image, wherein the toner redeposited on said image carrier is collected by said developing unit; and charge regulating means positioned downstream of said cleaning unit, but upstream of said charging means, in a direction of rotation of said image carrier, and for charging the toner redeposited on said area of said image carrier to a polarity identical with an original polarity deposited on the toner at the time of development.

10. An apparatus as claimed in claim 9, wherein said cleaning unit comprises a cleaning member formed of a material capable of charging, when the toner is of polarity opposite to the original polarity, the toner to the original polarity.

11. An apparatus as claimed in claim 9, wherein said charge regulating means comprises another charging means not contacting said image carrier for charging the toner.

12. An apparatus as claimed in claim 9, wherein said charge regulating means comprises a charging member not contacting said image carrier.

13. An image forming apparatus comprising:

a rotatable image carrier;

charging means for charging a surface of said image carrier uniformly;

latent image forming means for exposing the charged surface of said image carrier to thereby electrostatically form a latent image;

a developing unit for developing the latent image to produce a corresponding toner image;

an image transfer unit for transferring the toner image to a recording medium;

a cleaning member for collecting toner left on said image carrier after transfer of the toner image, and then redepositing the toner in an area of the surface of said image carrier which does not effect formation of a next latent image, wherein the toner redeposited on said image carrier is collected by said developing unit; and control means for causing, when said cleaning member collects the toner from said image carrier, a voltage of polarity opposite to an original polarity deposited on the toner at the time of development to be applied to said cleaning member to thereby electrostatically transfer the toner of the original polarity to said cleaning member, and for causing said cleaning member to rotate in an opposite direction to said image carrier at a nip between said image carrier and said cleaning member, and for causing said cleaning member to collect the toner by less than one rotation.

14. An apparatus as claimed in claim 13, wherein said control means causes, when said cleaning member redeposits the collected toner on said image carrier, said cleaning member to perform two consecutive redepositing operations in each of which said cleaning member performs at least one rotation, wherein said control means causes, during either one of said two redepositing operations, a voltage of a same polarity as the original polarity of the toner to be applied to said cleaning member to thereby redeposit the toner of the original polarity on said image carrier, and wherein said control means causes, during the other redepositing operations, a voltage of polarity opposite to the original polarity of the toner to be applied to said cleaning member to thereby redeposit the toner of polarity opposite to the original polarity on said image carrier.

15. An apparatus as claimed in claim 14, wherein said developing unit comprises a developer carrier for conveying a developer deposited thereon, and wherein said apparatus further comprises voltage applying means for causing, when said developing unit collects the toner of the original polarity and redeposited on said image carrier, a voltage of polarity opposite to the original polarity of the toner to be applied to said developer carrier, and for causing, when said developing unit collects the toner of polarity opposite to the original polarity, a voltage of a same polarity as the original polarity to be applied to said developer carrier.

16. An apparatus as claimed in claim 14, further comprising charge regulating means positioned downstream of said cleaning member, but upstream of said charging means, in a direction of rotation of said image carrier, and for charging the toner of polarity opposite to the original polarity and redeposited on said image carrier to the original polarity.

17. An apparatus as claimed in claim 16, wherein said charge regulating means comprises charging means not contacting said image carrier for charging the toner.

18. An apparatus as claimed in claim 16, wherein said developing means comprises a developer carrier for conveying a developer deposited thereon, and wherein said apparatus further comprises voltage applying means for applying a voltage of a same polarity as the original polarity of the toner both when said developing unit collects the toner charged to the original polarity on said cleaning member and redeposited on said image carrier and when said developing unit collects the toner charged to the polarity opposite to the original polarity and redeposited on said image carrier.

19. An image forming apparatus comprising:

a rotatable image carrier;

charging means for charging a surface of said image carrier uniformly;

latent image forming means for exposing the charged surface of said image carrier to thereby electrostatically form a latent image;

a developing unit comprising a developer carrier for conveying a developer deposited thereon, and for developing the latent image to produce a corresponding toner image; and a cleaning member for collecting toner left on said image carrier after transfer of the toner image, and then redepositing the toner in an area of the surface of said image carrier which does not effect formation of a next latent image, wherein the toner redeposited on said image carrier is collected by said developing unit;

wherein an effective developing width over which said developer carrier actually develops the latent image in an axial direction thereof is greater than an axial length of said cleaning member such that said cleaning member is confined in the effective developing width.

20. An apparatus as claimed in claim 19, further comprising control means for causing said cleaning member to rotate in an opposite direction to said image carrier at a nip between said image carrier and said cleaning member, and for causing said cleaning member to collect the toner by less than one rotation.

21. An image forming apparatus comprising:

a rotatable image carrier;

charging means for charging a surface of said image carrier uniformly;

latent image forming means for exposing the charged surface of said image carrier to thereby electrostatically form a latent image;

a developing unit comprising a developer carrier for conveying a developer deposited thereon, and for developing the latent image to produce a corresponding toner image;

an image transfer unit for transferring the toner image to a recording medium;

a cleaning member for collecting toner left on said image carrier after transfer of the toner image, and then redepositing the toner in an area of the surface of said image carrier which does not effect formation of a next latent image, wherein the toner redeposited on said image carrier is collected by said developing unit, and wherein an effective developing width over which said developer carrier actually develops the latent image in an axial direction thereof is smaller than an axial length of said cleaning member; and shifting means for shifting, when said cleaning member redeposits the toner on said image carrier, the toner on said cleaning member such that the toner lies in a range smaller than the effective developing width inclusive.

22. An apparatus as claimed in claim 21, wherein said shifting means comprises a pair of shift members for causing the toner to lie in said range when said cleaning member rotates to collect the toner from said image carrier.

23. An apparatus as claimed in claim 21, further comprising control means for causing said cleaning member to rotate in one direction when collecting the toner from said image carrier, but in the other direction when redepositing the toner on said image carrier.

24. An apparatus as claimed in claim 23, wherein said shifting means comprises:

a pair of first shift members for causing the toner to lie in said range when said cleaning member rotates to collect the toner from said image carrier; and a pair of second shift members for causing the toner to lie in said range when said cleaning member rotates to redeposit the toner on said image carrier.

25. An apparatus as claimed in claim 21, further comprising control means for causing said cleaning member to rotate in an opposite direction to said image carrier at a nip between said image carrier and said cleaning member, and for causing said cleaning member to collect the toner by less than one rotation.

26. An image forming apparatus comprising:

a rotatable image carrier;

latent image forming means for electrostatically forming a latent image on a surface of said image carrier;

a developing unit for developing the latent image to thereby produce a corresponding toner image;

an image transfer unit for transferring the toner image to a recording medium;

a cleaning unit comprising a rotatable cleaning member, and for collecting toner left on said image carrier after transfer of the toner image, and then redepositing the toner in an area of the surface of said image carrier which does not effect formation of a next latent image, wherein an electric field is formed between said cleaning member and said image carrier to cause said cleaning member to electrostatically collect the toner from said image carrier, and then the electric field is switched in direction to cause said cleaning member to redeposit the toner in an area of the surface of said image carrier which does not effect formation of a next latent image, and wherein the toner redeposited on said image carrier is electrostatically collected by said developing unit; and control means for controlling rotation of said cleaning member such that said cleaning member moves, when collecting the toner, in an opposite direction to said image carrier at a nip between said cleaning member and said image carrier, and ends collecting the toner from an image forming area of said image carrier by less than one rotation such that a leading edge, in a direction of rotation of said cleaning member, of the toner collected by said cleaning member is brought to a position where the toner cannot be transferred to said image carrier, and for causing said cleaning member to rotate at a higher speed when collecting the toner than when redepositing the toner.

27. An apparatus as claimed in claim 26, wherein said control means controls the rotation of said cleaning member such that said cleaning member moves in a same direction as said image carrier at a nip between said cleaning member and said image carrier when redepositing the toner on said image carrier.

28. An apparatus as claimed in claim 27, wherein said control means causes a surface of said cleaning member to move at a same linear velocity as the surface of said image carrier or to be driven by the surface of said image carrier when redepositing the toner on said image carrier.

29. An apparatus as claimed in claim 26, wherein said control means switches a direction of rotation of said cleaning member after said latent image forming means has fully formed a latent image.

30. An apparatus as claimed in claim 26, wherein said control means switches a rotation speed of said cleaning member after said latent image forming means has fully formed a latent image.

31. An image forming apparatus comprising:

a rotatable image carrier;

latent image forming means for electrostatically forming a latent image on a surface of said image carrier;

a developing unit for developing the latent image to thereby produce a corresponding toner image;

an image transfer unit for transferring the toner image to a recording medium;

a cleaning unit for collecting toner left on said image carrier after transfer of the toner image, and then redepositing the toner in an area of the surface of said image carrier which does not effect formation of a next latent image; and cleaning control means for controlling said cleaning unit such that when an intermediate between a leading and a trailing edge of an image forming area defined on said image carrier moves away from said cleaning member, a function of said cleaning member is switched from toner collection to toner redeposition.

32. An apparatus as claimed in claim 31, further comprising latent image formation control means for controlling said latent image forming means such that just after a trailing edge of the toner redeposited on said image carrier in a direction of rotation of said image carrier has reached said latent image forming means, said latent image forming means starts forming the next latent image on an area of said image carrier where the toner is not redeposited.

33. An apparatus as claimed in claim 31, wherein said cleaning control means controls said cleaning means such that just after the trailing edge the image forming area has moved away from said cleaning member, said cleaning unit stops redepositing the toner on said image carrier.

34. An apparatus as claimed in claim 31, wherein said cleaning control means controls said cleaning unit such that at the same time as the trailing edge of the image forming area moves away from said cleaning member, said cleaning member stops redepositing the toner on said image carrier.

35. An apparatus as claimed in claim 31, wherein said cleaning control means causes said cleaning unit to complete toner collection in a shorter period of time than toner redeposition.

36. An apparatus as claimed in claim 31, wherein said cleaning control means controls said cleaning unit such that an electric field is formed between said cleaning member and said image carrier to cause said cleaning member to electrostatically collect the toner from said image carrier, and then the electric field is switched in direction to cause said cleaning member to redeposit the toner on said image carrier.

37. An image forming apparatus comprising:

a rotatable image carrier;

latent image forming means for electrostatically forming a latent image on a surface of said image carrier;

a developing unit for developing the latent image to thereby produce a corresponding toner image;

an image transfer unit for transferring the toner image to a recording medium; and a cleaning roller for collecting toner left on said image carrier after transfer of the toner image, and then redepositing the toner in an area of the surface of said image carrier which does not effect formation of a next latent image;

said cleaning roller comprising a rigid shaft rotatably supported at axially opposite ends thereof, and an elastic body mounted on said shaft, wherein said cleaning roller collects the toner from said image carrier and redeposits the toner on said image carrier with a circumference of said roller pressingly contacting the surface of said image carrier.

38. An apparatus as claimed in claim 37, wherein said cleaning roller has an axis not parallel to or crossing an axis of said image carrier.

39. An apparatus as claimed in claim 37, wherein a press roller is pressed against an intermediate portion of said cleaning roller in the axial direction of said cleaning roller to thereby press said cleaning roller against said image carrier.

40. An apparatus as claimed in claim 37, wherein said body has at least a surface portion thereof formed of a material capable of charging, when the toner includes particles of polarity opposite to an original polarity deposited on the toner at a time of development, the toner to the original polarity by friction.

* * * * *

UNITED STATES PATENT AND TRADEMARK OFFICE

CERTIFICATE OF CORRECTION

PATENT NO. : 5,740,494

DATED : April 14, 1998

INVENTOR(S) : Hisashi SHOJI, et al.

It is certified that error appears in the above-identified patent and that said Letters Patent is hereby corrected as shown below:

On the title page, item [54], and on top of column 1, the title should read as follows:

--[54] IMAGE FORMING APPARATUS CONFIGURED TO ENHANCE TONER COLLECTING EFFICIENCY AND TONER REDEPOSITING EFFICIENCY--

Signed and Sealed this

Seventh Day of July, 1998

Bruce Lehman

*Attest:*

BRUCE LEHMAN

*Attesting Officer*

*Commissioner of Patents and Trademarks*